US010947808B2

(12) United States Patent
Angers, Jr.

(10) Patent No.: US 10,947,808 B2
(45) **Date of Patent: *Mar. 16, 2021**

(54) CONTAINMENT SYSTEMS FOR SEALING A PASS-THROUGH IN A WELL, AND METHODS THEREFORE

(71) Applicant: John W Angers, Jr., Youngsville, LA (US)

(72) Inventor: John W Angers, Jr., Youngsville, LA (US)

( * ) Notice: Subject to any disclaimer, the term of this patent is extended or adjusted under 35 U.S.C. 154(b) by 168 days.

This patent is subject to a terminal disclaimer.

(21) Appl. No.: 15/965,818

(22) Filed: Apr. 27, 2018

(65) Prior Publication Data

US 2018/0347305 A1 Dec. 6, 2018

Related U.S. Application Data

(63) Continuation-in-part of application No. 15/608,783, filed on May 30, 2017, now Pat. No. 10,808,486.

(51) Int. Cl.

| | |
|---|---|
| ***E21B 33/04*** | (2006.01) |
| ***E21B 33/072*** | (2006.01) |
| ***E21B 33/068*** | (2006.01) |
| *E21B 43/12* | (2006.01) |

(52) U.S. Cl.

CPC ..... *E21B 33/072* (2013.01); *E21B 33/04* (2013.01); *E21B 33/0407* (2013.01); *E21B 33/068* (2013.01); *E21B 43/128* (2013.01)

(58) Field of Classification Search

CPC ..... E21B 23/01; E21B 23/02; E21B 33/072; E21B 33/04; E21B 33/0407; E21B 33/068; E21B 43/128; E21B 33/0415; E21B 33/047; E21B 33/037

See application file for complete search history.

(56) References Cited

U.S. PATENT DOCUMENTS

| | | | | |
|---|---|---|---|---|
| 3,781,456 A | | 12/1973 | Knowles et al. | |
| 4,121,660 A | * | 10/1978 | Koleilat | E21B 23/02 166/123 |
| 4,214,778 A | * | 7/1980 | Diehl | E21B 33/04 166/89.2 |
| 4,388,971 A | * | 6/1983 | Peterson | E21B 23/02 166/124 |

(Continued)

FOREIGN PATENT DOCUMENTS

WO WO-2015034694 A2 3/2015

*Primary Examiner* — Yong-Suk (Philip) Ro

(74) *Attorney, Agent, or Firm* — Joseph T Regard Ltd PLC

(57) ABSTRACT

A system formed to provide sealed passage through the wellhead for cables, lines, tubes or the like for down-hole applications. A unitary or split/wrap around hanger having a main seal is formed to receive and provide sealed passage therethrough of power and control cables, lines, conduits, or other threaded components having various configurations and applications. Hinged side doors to engage and support various configuration (via interchangeable inserts) and/or various size cable, line, conduit, etc in the hanger. The present invention teaches permanent as well as temporary applications, can be used in other applications besides hangers (for example, down-hole packers) and is designed to provide a low to medium pressure seal. Also taught is a bowl cap, tubing adapter or other surface component with adapters to allow sealed pass-through utilizing a compression seal.

32 Claims, 41 Drawing Sheets

(56) References Cited

U.S. PATENT DOCUMENTS

| | | | | |
|---|---|---|---|---|
| 4,583,804 | A | 4/1986 | Thompson | |
| 4,665,979 | A * | 5/1987 | Boehm, Jr. | E21B 33/04 166/208 |
| 5,148,864 | A | 9/1992 | Willis et al. | |
| 5,289,882 | A | 3/1994 | Moore | |
| 5,332,043 | A * | 7/1994 | Ferguson | E21B 33/0422 166/379 |
| 5,944,111 | A * | 8/1999 | Bridges | E21B 43/101 166/348 |
| 6,234,252 | B1 * | 5/2001 | Pallini, Jr. | E21B 33/038 166/345 |
| 6,332,499 | B1 | 12/2001 | Kobylinski et al. | |
| 6,530,433 | B2 | 3/2003 | Smith et al. | |
| 6,688,386 | B2 | 2/2004 | Cornelssen et al. | |
| 7,162,933 | B2 | 1/2007 | Thompson et al. | |
| 7,232,347 | B1 | 6/2007 | Moore | |
| 7,405,358 | B2 | 7/2008 | Emerson | |
| 7,798,208 | B2 * | 9/2010 | Purkis | E21B 33/04 166/75.14 |
| 8,297,345 | B2 | 10/2012 | Emerson | |
| 8,485,262 | B1 * | 7/2013 | Angers | E21B 33/043 166/339 |
| 9,316,062 | B2 | 4/2016 | Emerson et al. | |
| 2004/0231835 | A1 | 11/2004 | Thai et al. | |
| 2008/0026623 | A1 | 1/2008 | Emerson | |
| 2008/0110644 | A1 | 5/2008 | Howell et al. | |
| 2008/0230233 | A1 * | 9/2008 | Fay | E21B 23/01 166/382 |
| 2013/0277067 | A1 | 10/2013 | Emerson et al. | |
| 2014/0151069 | A1 * | 6/2014 | Kajaria | E21B 33/047 166/382 |
| 2017/0211339 | A1 | 7/2017 | Emerson et al. | |

* cited by examiner

64"
94
57
94'
51
93

CONTAINMENT SYSTEMS FOR SEALING A PASS-THROUGH IN A WELL, AND METHODS THEREFORE

STATEMENT OF CONTINUING APPLICATION

The present application is a continuation in part of U.S. patent application Ser. No. 14/608,783 filed May 30, 2017, listing John W Angers, Jr as inventor, entitled "Side Door Hanger System for Sealing a Pass-Through in a Wellhead, and Method Therefore".

FIELD OF THE INVENTION

The present invention relates to wellheads, and in particular reconfigurable pass-through hangers, packers, and tubing head caps for allowing the sealed passage of cables, lines, tubes or the like therethrough. The preferred embodiment of the present invention contemplates a hanger system having a side door system providing reconfigurable pass-through inserts having customized configurations for various applications, providing reconfigurable sealed pass-through options to support changes in the production profile over the life of the well. An alternative embodiment of the present system provides a packer having reconfigurable pass-through capabilities utilizing a similar side-door system with modular inserts for down-hole applications. The present invention further provides a bowl cap to seal off and envelope the tubing head, while providing a sealed pass-through capability as well as being reconfigurable utilizing adapters for allowing sealed pass-through with various configurations, including for receiving compression fittings about the conduit and capillaries, sealing and locking the installation.

GENERAL BACKGROUND DISCUSSION OF THE INVENTION

Downhole components requiring wiring, capillaries, lines, and/or tubing are increasingly used in petroleum wells. For example, electronic submersible pumps have enjoyed a substantial growth in use in the industry, providing a reliable and efficient means of lifting fluid from the wellbore. Unlike the old "pumpjack" reciprocating piston oil pumps, ESP's can be quickly and easily implemented in a well. The need for a reliable, safe, and relatively easily implemented system to temporarily hang an ESP during installation on a temporary as well as permanent basis has been a long felt, but unresolved need in the industry.

ESP's, along with numerous other downhole devices/applications, require a power cable or other lines, conduits or the like, which must pass through the wellhead to be operative. To allow these devices to operate unattended and be in compliance with regulatory requirements, the wellhead must be sealed. Prior systems have attempted a temporary as well as permanent sealed pass-through for power, capillary and other types of cables and lines, for example in the form of an eccentric hanger and penetrator, but they are believed for the most part to be ineffective, generally requiring repeated cutting and splicing during when implementing prior art systems on a temporary basis to provide a sealed "pass-through" of the well. Further, packers and the like may also be utilized to segregate operating zones in a well or seal off zones, or other applications, and may in today's operating environment likewise require sealed pass-through of cables, lines and the like as well. Accordingly, there exists a need to seal the various cable(s) and other components including lines, conduits, tubes and the like utilized in such various components temporarily as well as permanently in the wellhead for unattended operation, allowing the passage therethrough of power and control lines and the like without the need for cutting and splicing.

SUMMARY DISCUSSION OF THE INVENTION

The present invention comprises a unique hinged, split wrap-around or unitary (non-split) hanger having a main seal formed to receive lines, conduits, cables, wires and other threaded components therethrough, the hanger formed to engage and support a tubing string in a tubing head bowl, utilizing the weight of the tubing string and/or lock down pins to compress the main seal (the seal preferably formed of compressible material such as, for example, elastomeric material) to seal the wellhead, providing a sealed pass-through for the components threaded therethrough, dispensing without the need for cutting and splicing as in prior art systems.

The preferred embodiment of the invention provides effective, sealed pass-through of power and control cables, lines, conduits, or other components such as for powering an electric submersible pump (ESP) via electrical cable(s), conduit(s) or the like, while effectively packing off and sealing the well bore.

When the hanger is installed on a tubing string with threaded components and positioned to rest in the bowl of the tubing head, the lower string weight (or the lock down pins, depending on which system is used) compresses the main seal around the pipe, wire conduit, capillary tube or other components as well as the bowl, sealing off the well bore below.

The hanger of the present invention has side doors formed therein to engage and anchor or grip the line, conduit, cable and/or wire (the exemplary embodiment shows the sealing of an ESP power conduit), as well as a capillary line or other components passing though the hanger seal, forming the component seal.

An alternative to the hanger of the present invention contemplates a packer having the side doors with interchangeable profile inserts and/or seals, providing sealed pass-through of cables, conduits, lines or the like, providing a means of sealing or segregating the well, but without the hanging feature of hangers, supporting concentric completion capability as well as other operations.

The present invention teaches permanent as well as temporary versions of the installation, and is designed to provide a pressure seal, the permanent version contemplating a hanger formed to engage the tubing and further including a cap formed to envelope the tubing head. The cap utilizes compression fittings about the conduit and capillaries, sealing and locking the installation. The temporary version can be used with any conventional wellhead system, allowing the well to be secured overnight without having to cut the ESP power conduit or capillary line to seal the well.

The present thereby provides an easily implemented, reliable, cost effective, unique and innovative system to accommodate changes in operating requirements of a well, allowing reconfiguration of the hanger, bowl cap/adapter and even packer(s) to accommodate the various operations accomplished over the life of a well including drilling, completion, production and even plug and abandon operations. Whereas the prior art would require replacing these components for different configurations depending on the application, the present invention allows the components to be reconfigurable depending on the operational criteria of the well at the time.

For example, during production, the type of lift system may change over the life of the well, from straight production, to pump jacks or ESP's, to gas lifts, as the production profile changes over time. The present system allows the same hanger, bowl cap/adapter, and packer(s) to be used, as required, by simply removing the existing inserts as required, and changing same with inserts having the required profile to facilitate sealed pass-through of the various cables, conduits, etc as needed for the operation at hand. Similarly, the bowl cap allows for changes in sealed component pass through via various adapter and seal configurations which are easily implemented as required over the life of the well.

Accordingly, the present system:

1) Supports multiple types of artificial lift systems without the need to change hangers or adapters;

2) Is easily configurable for ESP suspension without the need for wire splicing or the need for replacing surface equipment such as hangers, bowl caps, etc (which are reconfigurable in the present system.);

3) Converts to Gas lift with the same hangers/adapters with simple changing of inserts to accommodate the require profile for the cables, conduits, lines, etc passing through;

4) Provides a cost effective, easily implemented and reliable means to convert the hanger and bowl cover to operational reconfigurations during the life of the well including drilling, rod completion, hydraulic, straight production, even plug and abandon and other phases in well operation.

In summary, the present invention provides a unique and innovative system to provide sealed pass-through in well operations which is easily reconfigurable via the utilization of inserts and adapters. Unlike the prior art, there is no need to replumb after completion switch over.

The present invention thereby provides cost effective options for sealed-pass through with hangers and the like, whether said operations entail temporary hang off to permanent completion, utilizing the same, reconfigurable equipment.

The system of the present invention has been tested up to 5 k working pressure. String weight is handled with a bottom plate to facilitate maximum load capacity, as will be discussed herein.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 10F is an exemplary insert having a profile to form a seal when no component is required for pass through.

FIG. 12G is a side, partially cross-sectional, partially cut-away view of a coupling 104" having an unencumbered full bore 106, suitable to support production operations utilizing a rod lift, rocking horse or the like.

FIG. 24D is a side, partially exploded, partially cut-away, partially cross-sectional view of the invention of FIG. 24B, showing the components of the adapter in exploded view as well as mounted to the bowl cap, with compression fitting engaging a capillary tube 10 or the like for sealed pass-through.

FIG. 25E is a side, partially cut-away, partially cross-sectional view of the invention of FIG. 2DC, showing a pass-through adapter 132' mounted to the tubing head adapter, with a conduit connector 147 mounted to said pass-through adapter 132', and underlying comprising inserts and seals within the centralized passage formed in the tubing head adapter 162 as discussed herein to facilitate the sealed pass-through of a multi-conductor cable such as an ESP power cable 4 or the like.

DETAILED DISCUSSION OF THE INVENTION

Figure 1:
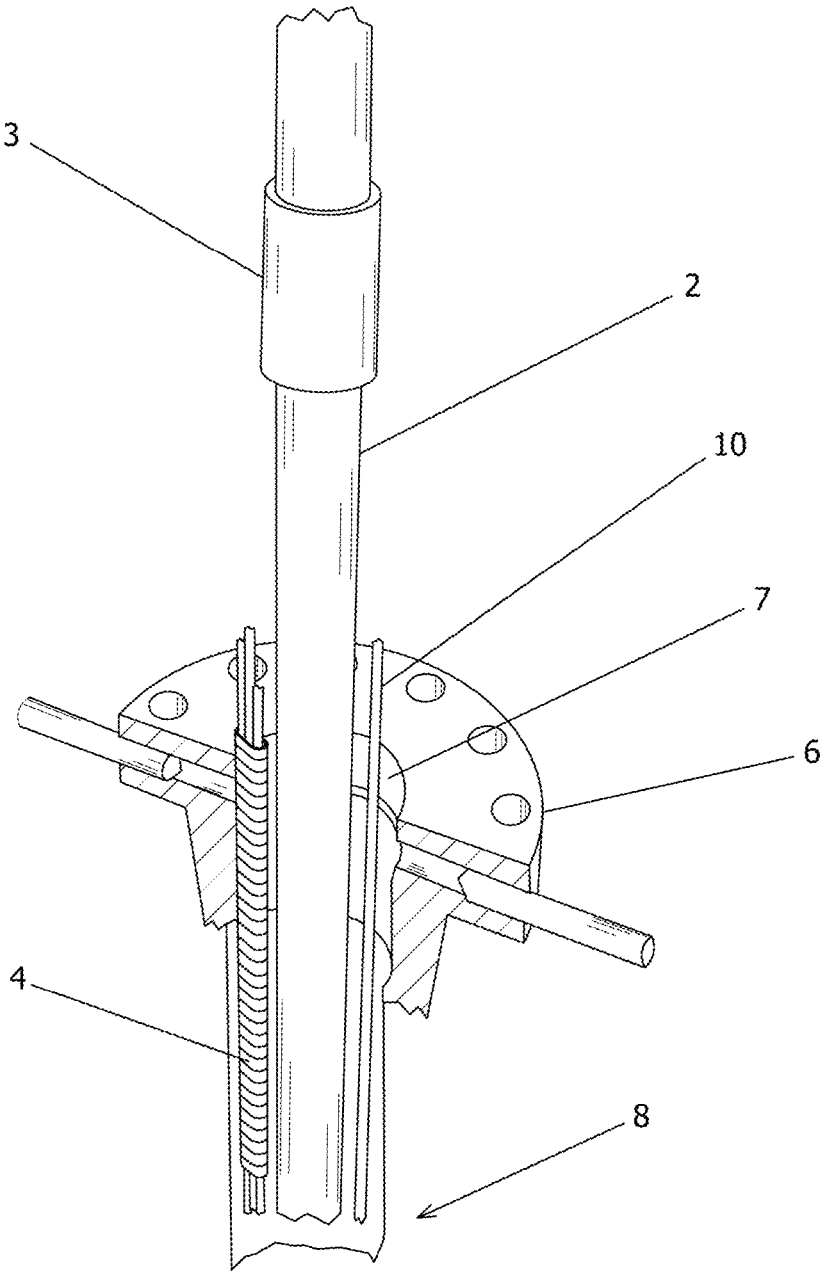
FIG. 1 is a perspective view of a wellhead illustrating a string of tubing emanating from a tubing head, with three conductor jacketed ESP power cable and capillary tube shown.
Figure 2:
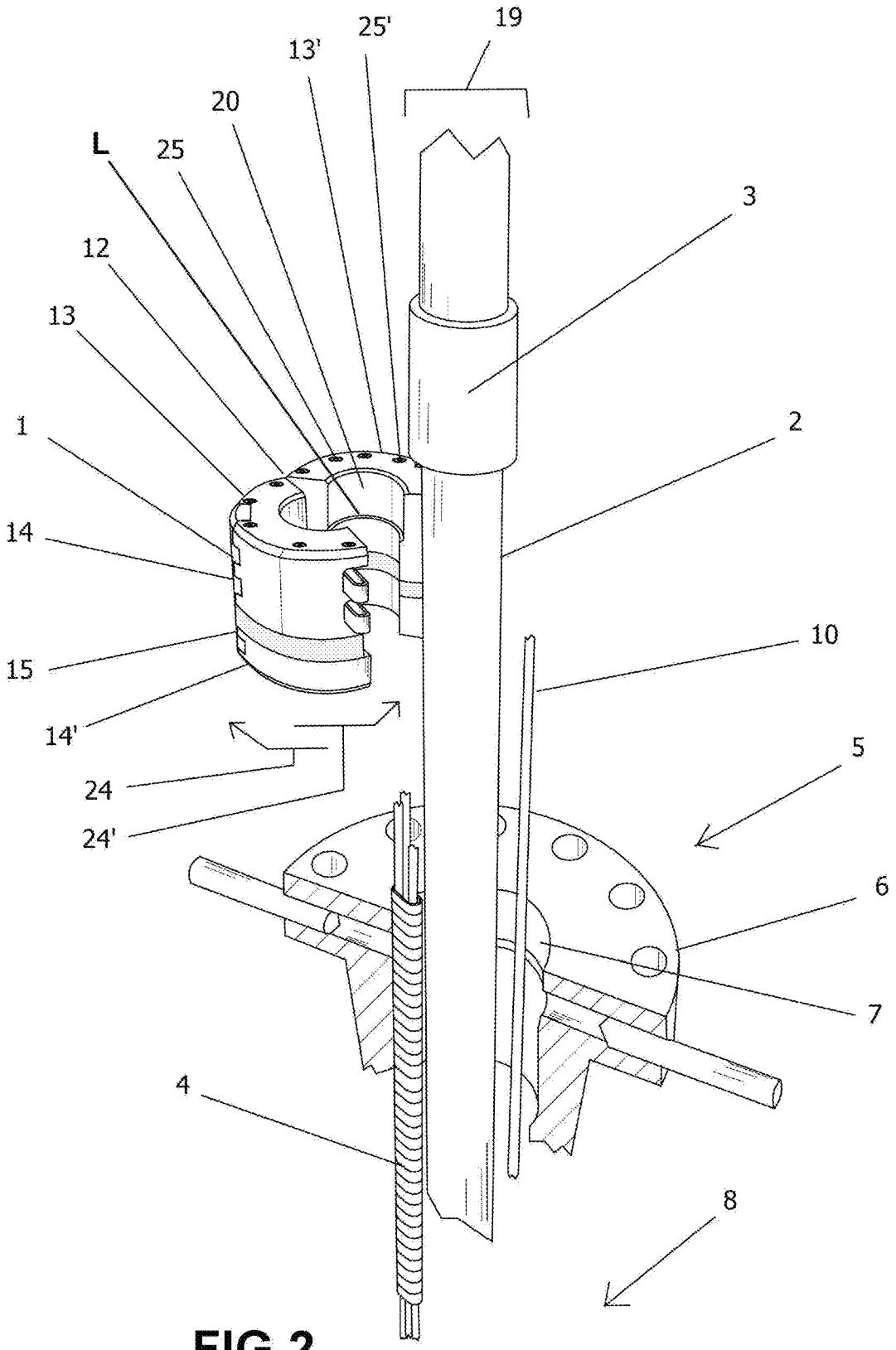
FIG. 2 is perspective view of the wellhead of FIG. 1, further illustrating the wrap-around hanger of the preferred embodiment of the present invention situated to engage the tubing below the coupling, as utilized for a temporary installation (no pressure/back pressure valve (BPV)).

Referring to FIG. 1, the present invention provides a system to pack-off and seal the wellbore 5 having tubing 2 emanating therefrom and the like (connected via collar 3) via improvements in the hanger system, while providing a sealed pass-through of power cables 4, lines (including the capillary line 10) and/or various other conduits, tubes, wires and the like, utilizing the hanger to seal the area of the tubing head 6 at the bowl 7. The present invention is particularly useful in conjunction with sealing the well bore when utilizing downhole an electric submersible pump (ESP) 8, but may also be utilized with many other downhole applications requiring lines, cables, conduits and other components for monitoring, controlling and other operations involving downhole equipment, implements, tools, controls, sensors and the like.

Temporary Modular Side Door Hanger System for Sealing a Pass Through in a Wellhead Continuing with FIGS. 2-9, the first embodiment of the present invention comprises a system to provide on a temporary or short-term basis a pass-through seal of a wellhead having components comprising a split, wrap-around hanger 1 formed of first 13 and second 13' hanger sections hinged 12 on one side to pivot from open 24 to closed 24' positions forming hanger 1, the opening of same allowing the positioning of said sections about tubing 2 to envelope same. Each hanger component 13, 13' comprises an upper 14 and lower 14' opposing hanger bodies formed of steel or the like (the lower 14' hanger body may alternatively be referred to as the base plate), and with a main seal 15 of synthetic rubber or other elastomeric compound or the like situated therebetween. Bolts 25, 25' threadingly engage upper 14 and lower 14' hanger bodies, passing through seal 15 (via bolt passages formed therethrough, joining same).

The first 13 and second 13' hanger components forming hanger 1, forms a receiver which is formed to encircle tubing 2, and is latched via hinge buckles 17, 17' and locked in place via bolts 18, 18', The closed hanger 1 forms a passage or receiver 21 having an ID 20 of suitable size to slidably receive or otherwise engage the outer diameter 19 of tubing 2, for example, via load bearing shoulder L associated with the upper 14 or lower 14' hanger bodies (in FIG. 2 the load bearing shoulder L is shown formed in the upper 14 hanger body) to form a support for collar 3 (or coupling or the like, as will be further discussed herein). As an alternative to the load bearing shoulder L, the ID 20 of the receiver may narrow to facilitate engagement with and support of collar 3, coupling or the like.

The hanger of the present invention has situated on opposing its outer surface on opposing sides first 26 and second 26' sets of side doors (See FIGS. 3 and 4 respectively) formed therein to engage grip and selectively hold the line, conduit, cable and/or wire (the figures illustrate the sealing of an ESP power conduit via first 26 door), as well as a capillary line via second 26', to the hanger 1.

Continuing with the Figures, each door 26, 26' is split to form upper 27, 28 and lower 27', 28' door sections, respectively, divided by the main seal 15, which main seal is situated between the upper and lower doors and is not covered about its inner or outer periphery so as not to encumber its operation.

The first 26 and second 26' hinge doors are formed to pivot 23 on one end, and latch closed via bolts 29, 29', respectively, each of which engage and retain the upper and lower doors via in-line bolt passages. The first 26 and second 26' doors when closed cover component slots 30, 31, formed in the hanger 1, respectively, each slot configured to receive and formed to allow the pass-through of a component such as a conduit, line, tube, cable, or the like. In the present case, door 26 is formed to cover and engage (as will be discussed herein) an ESP power cable 4 situated in slot 30 thereunder (when closed), while door 26' covers and engages capillary line 10 situated in slot 31.

Continuing with FIGS. 3-6, the side doors 27, 27' and 28, 28' respectively have a gripping profile 22, 22' on the inner side of the doors 27, 28 respectively, the profile formed to engage the outer surface of the component threaded therethrough.

The respective component slot areas 30, 31, likewise have gripping profile inserts 34, 34' mounted to the body of the hanger opposing door gripping profiles 22, 22', which gripping profiles, when the respective upper door sections 27, 28 are closed 37, 37' about their respective component situated therebetween (in the illustrated example, the ESP power cable 11 and control line 10, respectively), the respective component is gripped thereby.

Where inserts 34, 34' are used to provide the gripping profile, the inserts may be changed, along with the respective door sections, as required to change the gripping profiles to fit various components as required. For example, as shown, the insert 34 having the desired profile P is placed into the respective insert receiver slot 97 and fastened to the hanger body (lower hanger body shown in FIGS. 4A and 5) via threaded fastener 96 engaging threaded aperture 96' formed in the hanger body. Likewise, inserts 35, 35' may be provided to change the gripping profile P' of the respective upper and lower side doors 27, 27' to effectively grip and accommodate the component passing therethrough, the insert forming the gripping profile 22 mounted to the side door 27'.

Figure 5:
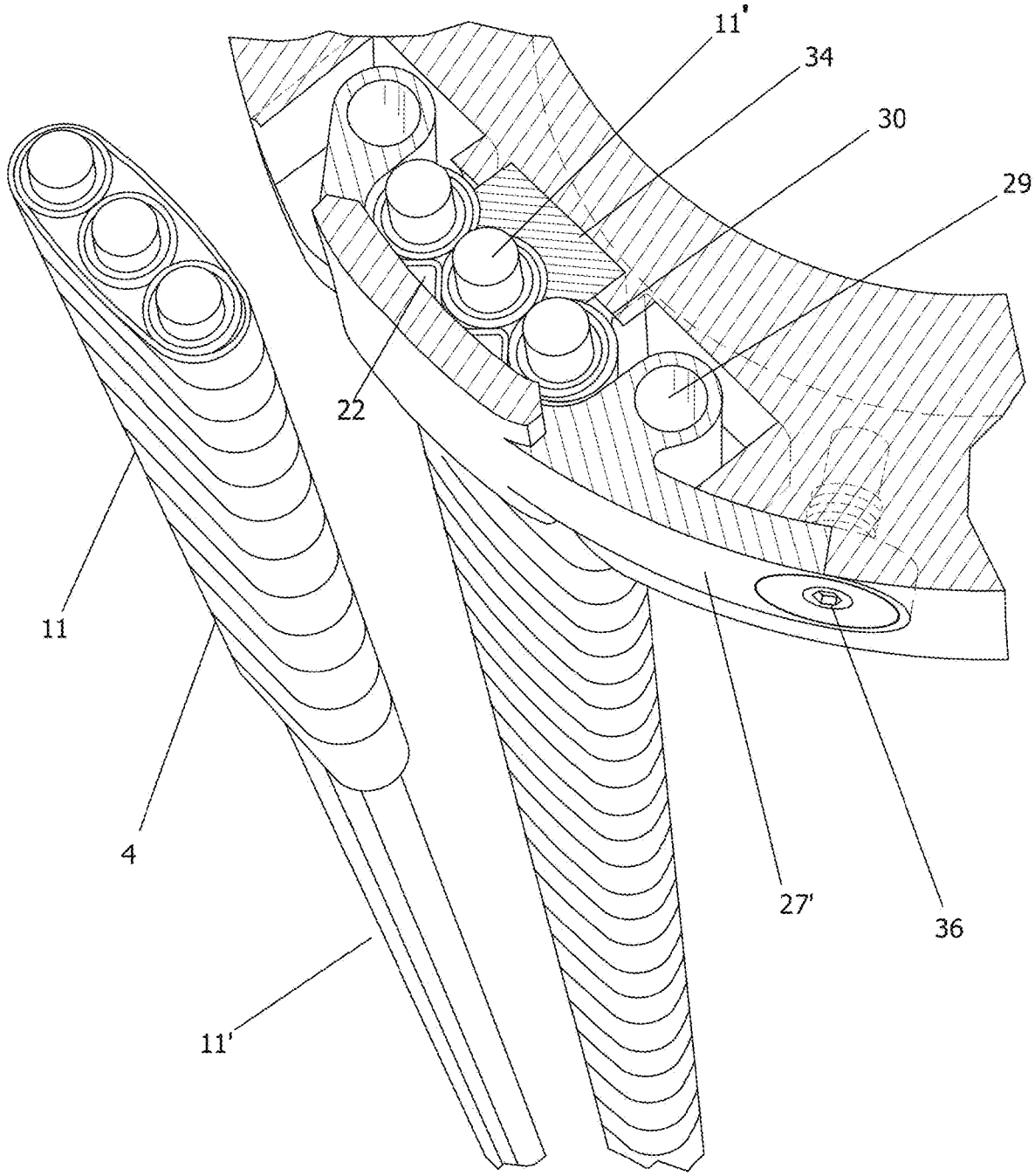
FIG. 5 is a perspective view, partially cut-away view of the ESP power cable threaded through the first upper door of FIG. 4A.
Figure 6:
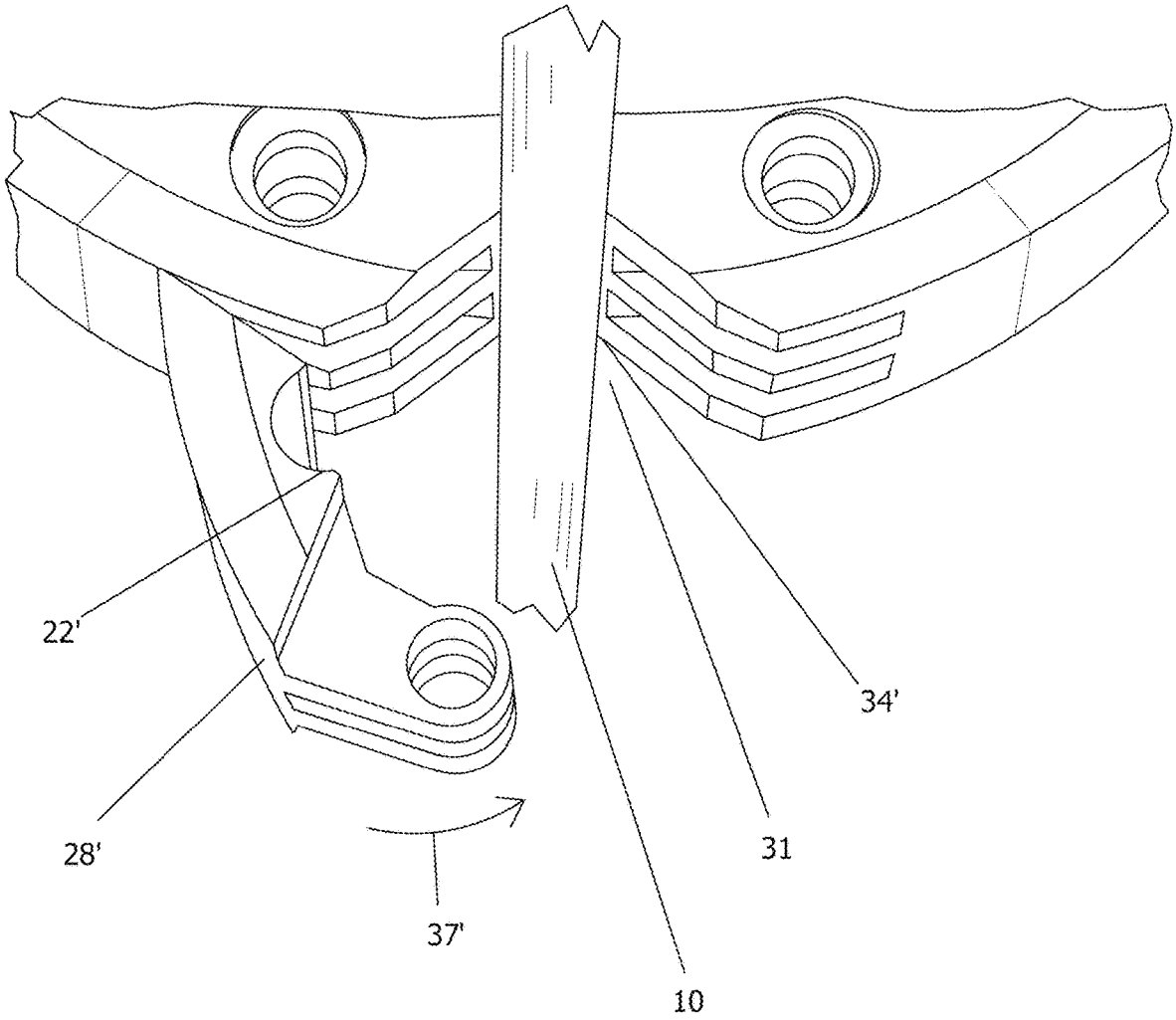
FIG. 6 is a perspective, partial close-up view of the capillary conduit of the second upper side door of FIG. 4 with a capillary in position, further illustrating the inner profile grip as well as the door profile grip formed to engage the opposing side of the capillary tube, so that when the upper door is closed the capillary tube is gripped and retained.

The gripping profiles 22, 22' and 34, 34' are positioned to engage and respectively grip opposing sides of the component threaded therethrough. Latch bolt 36 is provided to threadingly close and retain the door 27 in position, while the hinged or pivotal action in closing the respective door section 27, 27' can be used with fulcrum effect to facilitate the application of pressure to the outer surface of the component thereunder by the gripping surface, to provide a secure grip thereto, as shown in FIG. 5. No pressure seal need be associated with the side doors in the preferred embodiment of the present invention, as it is the main seal which provides the sealing action. Alternatively, a plate fastened to the hanger body via threaded fasteners or the like can be utilized in place of a door, the plate having the insert mounted thereto just as with a side door.

Figure 3:
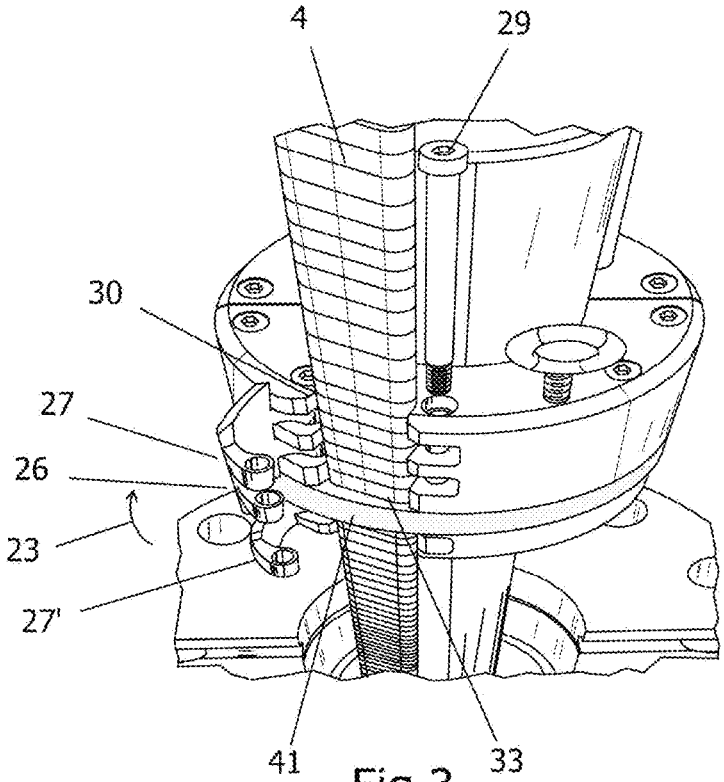
FIG. 3 is a perspective view of the invention of FIG. 2, illustrating the wrap-around hanger situated about the tubing, with first side doors opened and ESP power cable threaded through the main seal.
Figure 4:
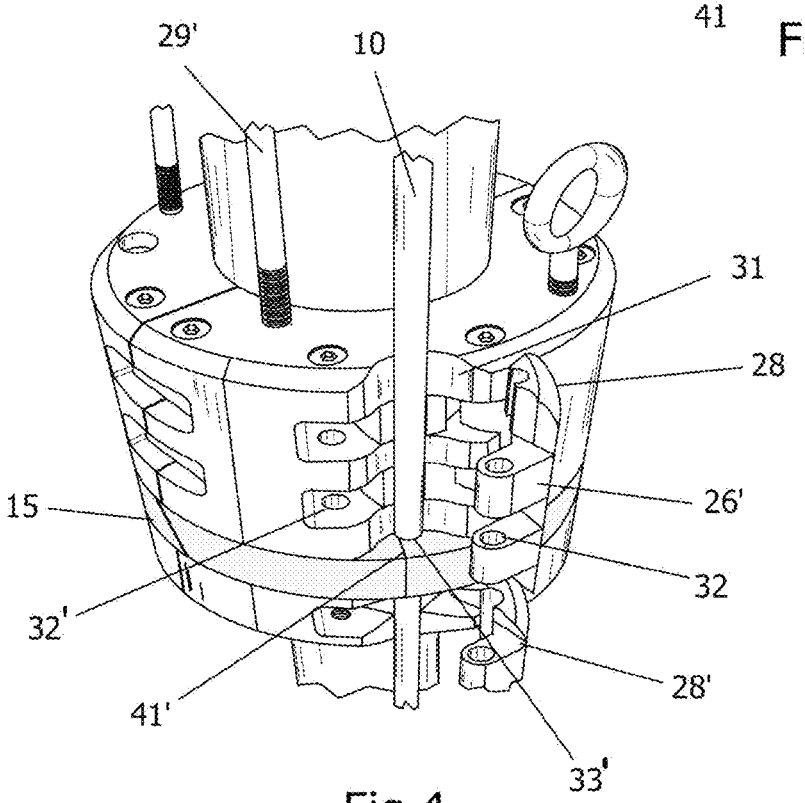
FIG. 4 is a perspective view of the invention of FIG. 3, illustrating the wrap-around hanger situated about the tubing, with second side doors opened and capillary tubing threaded through the main seal.
Figure 4A:
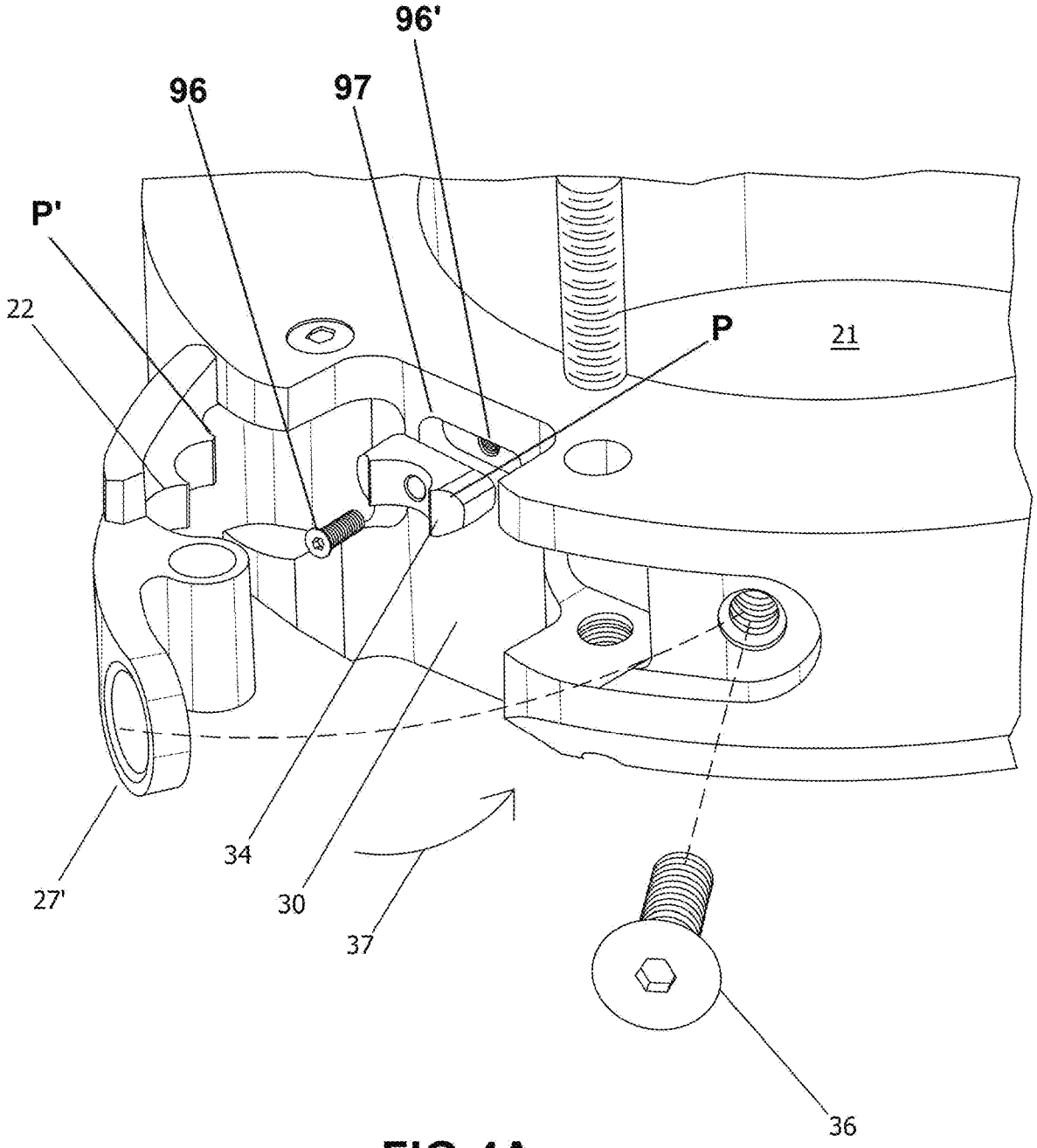
FIG. 4A is a perspective, partial, close-up of the invention of FIG. 3, illustrating the first door in open position to receive the ESP power cable, and further illustrating in exploded form the inner profile grip which is threadingly engaged to the hanger in the ESP power cable receiving area, as well as the door profile grip formed to engage the opposing side of the ESP power cable, so that when the upper door is closed the ESP power cable (or other component) situated therein is gripped and retained. Also shown is a threaded Allen bolt for fastening the upper door in closed, gripping position.
Figure 10:
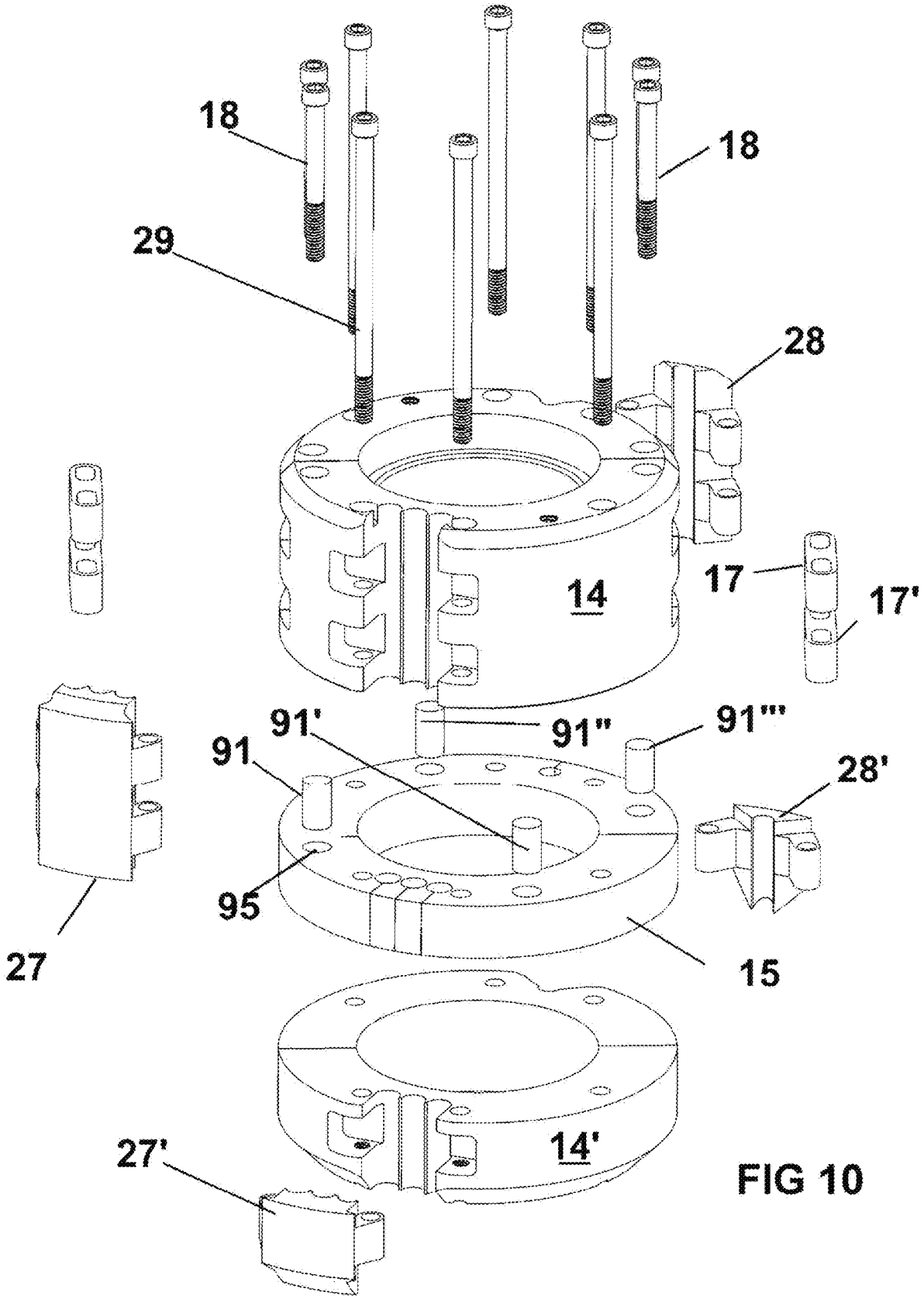
FIG. 10 is a perspective, exploded view of the wrap around hanger of the present invention but with fixed profiles shown as opposed to changeable profile inserts, illustrating the various components forming same.
Figure 10A:
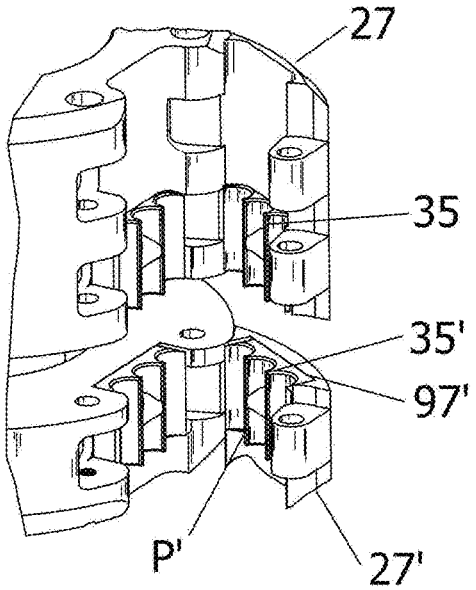
FIG. 10A is a perspective, partial, close-up view of an alternative embodiment to the invention of FIGS. 3, 4A and 5, illustrating the wrap-around hanger and first side door having profile inserts mounted therein, the inserts selected from a group of inserts having various profiles to engage and grip any component(s) passing therethrough.
Figure 10C:
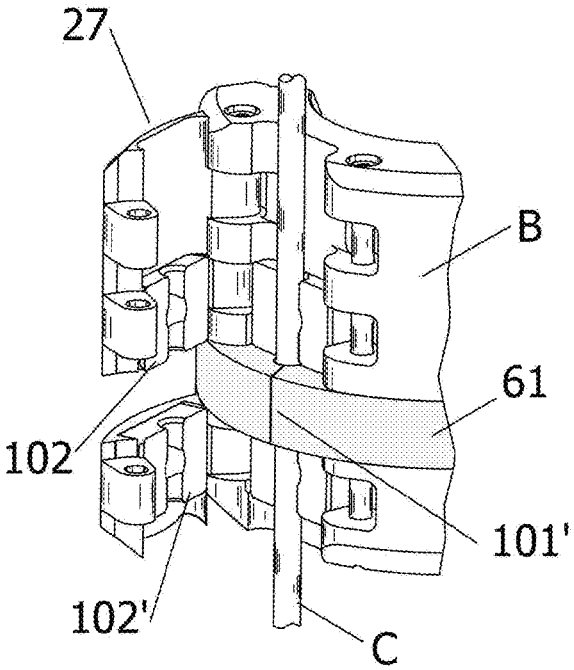
FIG. 10C is a perspective, partial, close up view of the invention of FIG. 10A, illustrating inserts installed for a single component running therethrough, further illustrating the component passages for receiving the component formed through the main seal with installation slit in side.
Figure 10B:
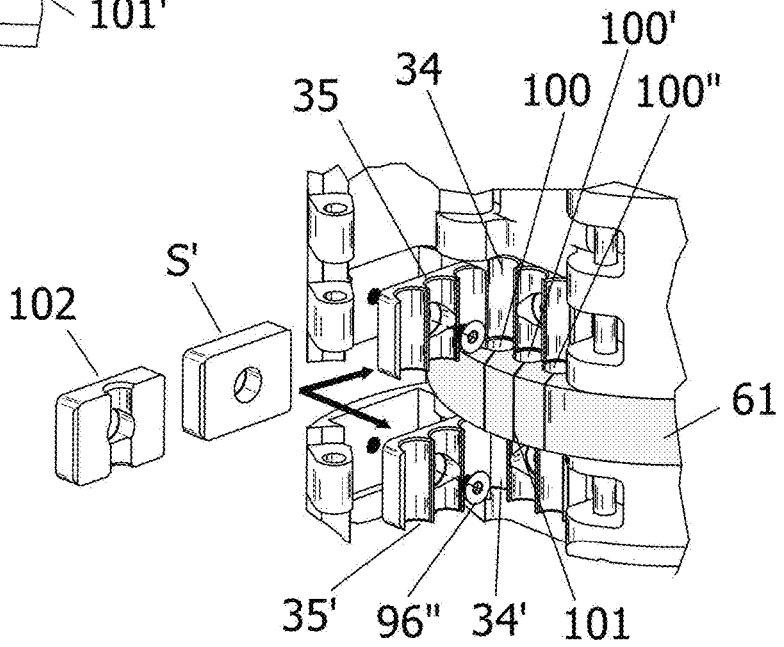
FIG. 10B is a perspective, partial, close-up view of the invention of FIG. 10A, illustrating the door with inserts in exploded view, as well as alternative profile slots which could be mounted thereto, further illustrating the component passages for receiving the component formed through the main seal with installation slit in side.
Figure 10D:
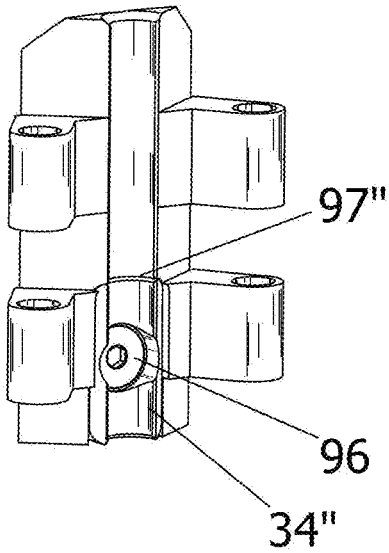
FIG. 10D is a perspective, partial, close-up view of an alternative embodiment of the invention shown in FIG. 4, illustrating the section of the wrap-around hanger associated with the second side door above the main seal having a profile insert mounted therein, the insert selected from a group of inserts having various profiles, so as to engage and grip any component(s) passing therethrough.
Figure 10E:
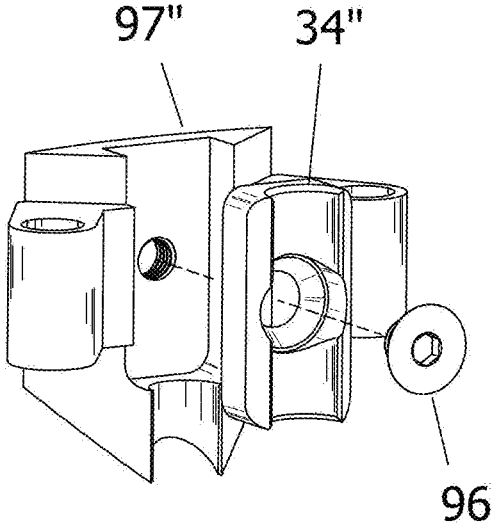
FIG. 10E is a perspective, partial, exploded, close-up view of the invention of FIG. 10D, showing the insert receiver area formed in the hanger body, an exemplary insert, and threaded connection therefore.
Figure 10F:
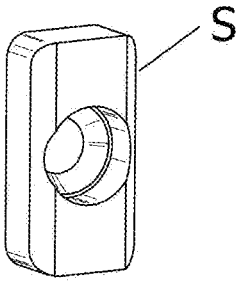
Figure 10G:
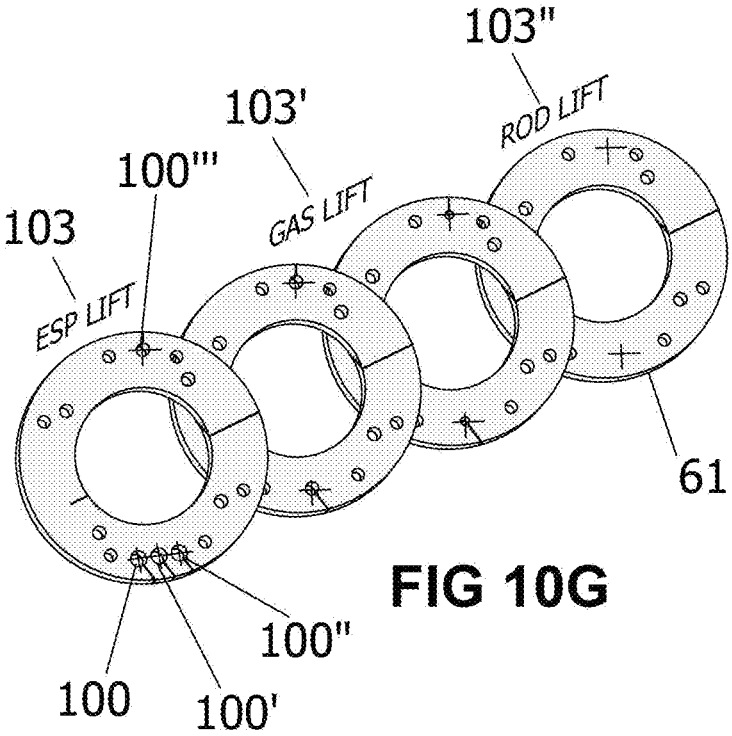
FIG. 10G is a top view of alternative main seal profiles having component passages formed through the seals for various well production profiles, each component passage formed to accommodate the sealed passage of the desired component(s) therethrough.

Continuing with FIGS. 3, 4, and 10G, the main seal 15 has formed therethrough, in axial alignment with the component slots 30, 31, passages 33, 33' formed to allow the passage of the respective component through the seal, in this case, the power cable 4 and capillary line 10, respectively. Further, the main seal may have slits 41, 41' formed through the outer diameter to the passage 33, 33' respectively, to facilitate the insertion/removal of the component through the slit to the passage, so that the components may be threaded therethrough as needed without having to run the end of the component through the passage. The passages 33, 33' would be formed to allow the profile of the respective component to be threaded through, with nominal clearance thereabout to facilitate sealing of the seal 15 about the threaded component when pressure is applied to the seal, as will be discussed infra.

Continuing FIG. 4-7, in the case of ESP power cable 4 and possibly other components having a protective jacket, the protective jacket 11 of the cable can be removed to expose the insulated wires 11' for the portion which is threaded through seal 15 (via slit 41) to passage 33, to ensure a pressure-tight, sealed pass-through in use.

Figure 7:
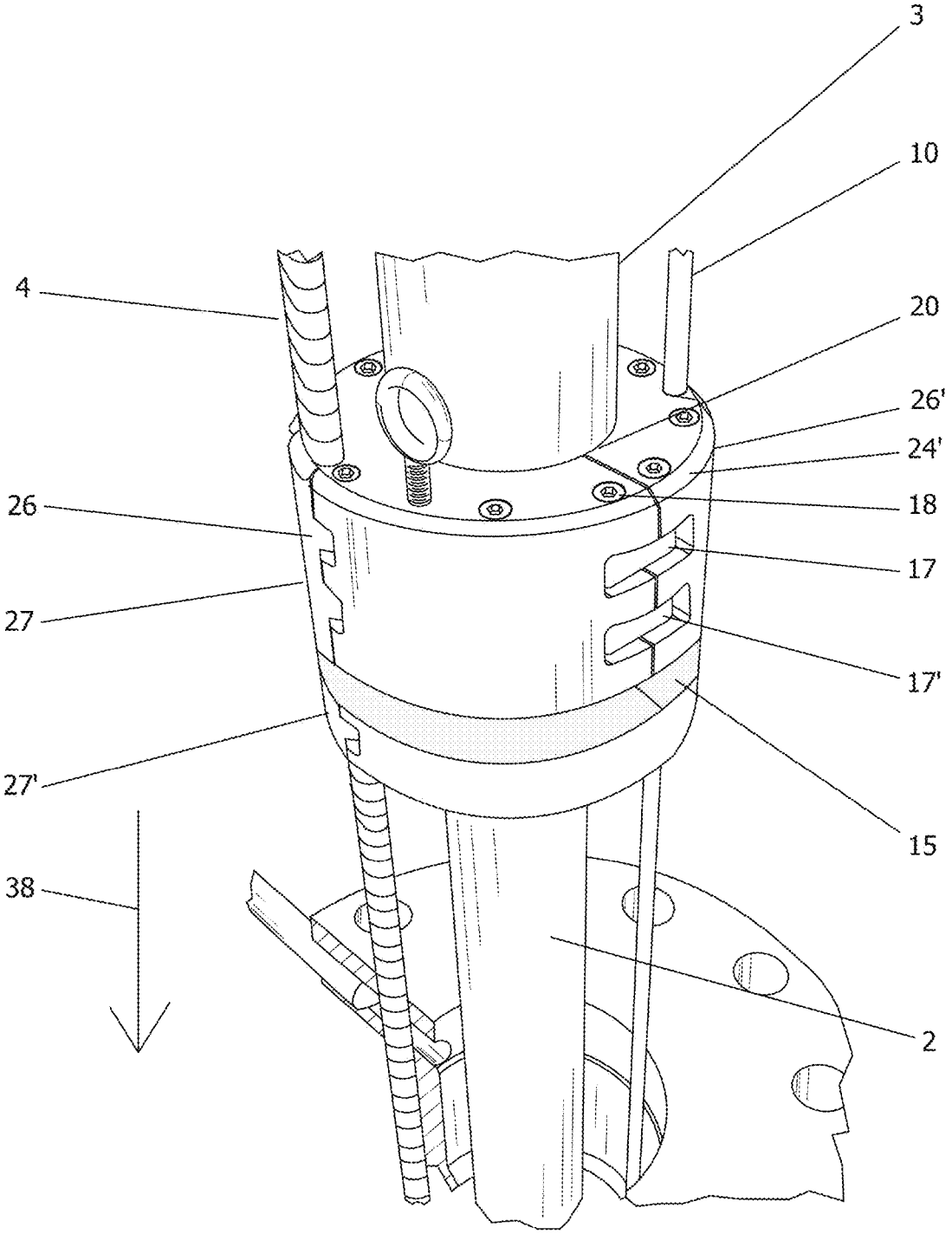
FIG. 7 is a perspective view of the invention of FIG. 6, illustrating the wrap-around hanger secured about the tubing string with the ESP power cable and capillary tube secured by their respective first and second doors.
Figure 8:
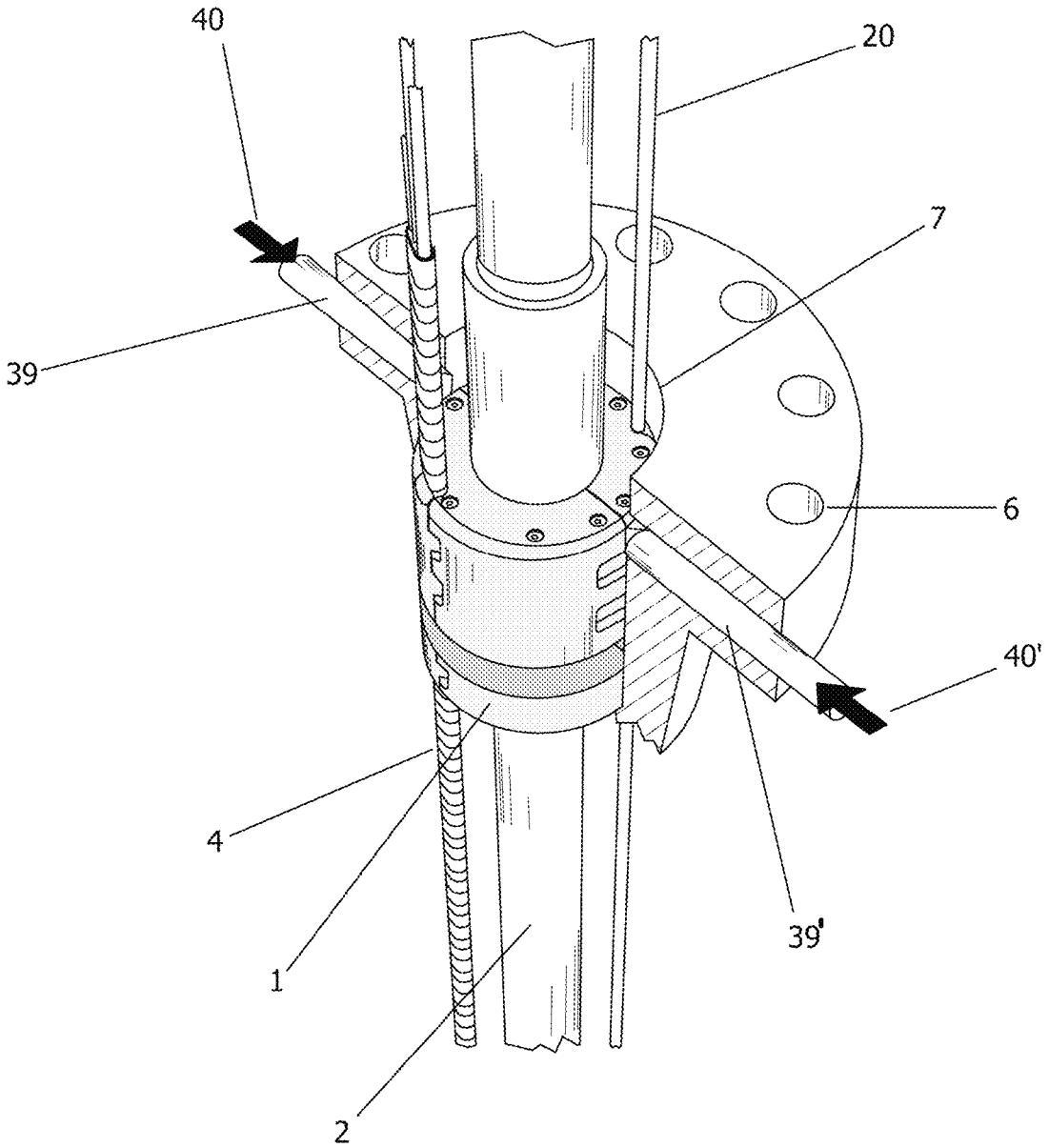
FIG. 8 is a perspective view of the invention of FIG. 7, illustrating the wrap around hanger with ESP power cable and capillary tube situated about the tubing below the collar, and lowered into the tubing head bowl.

Continuing with FIGS. 4-7, with the wrap-around hanger 1 situated about the tube 2 below the collar 3, and the upper 27, 28 and lower 27', 28' of first 26 and second 26's doors closed about and gripping the threaded components as discussed, in this case, ESP power cable 4 and capillary line 10 respectively (as shown in FIG. 7), the tubing string 2 is ready to be lowered so that the hanger 1 is situated in the bowl 7, as shown in FIG. 8, so that the weight of the tubing 2 string rests upon hanger 1, compressing the main seal 15 about the components (in this case, ESP power conduit 4 or cable and capillary line 10), as well as tubing (outer diameter) and bowl (inner diameter), sealing off the well.

As shown in FIG. 8, once the hanger 1 is set in the bowl 7, hold down pins 39, 39' are positioned 40, 40' from the tubing head 6 into opposing sides of the hanger 1 to lock the hanger 1 in the bowl 7, and thereby resist over pressure downhole urging the hanger/string out of the bowl.

Figure 9:
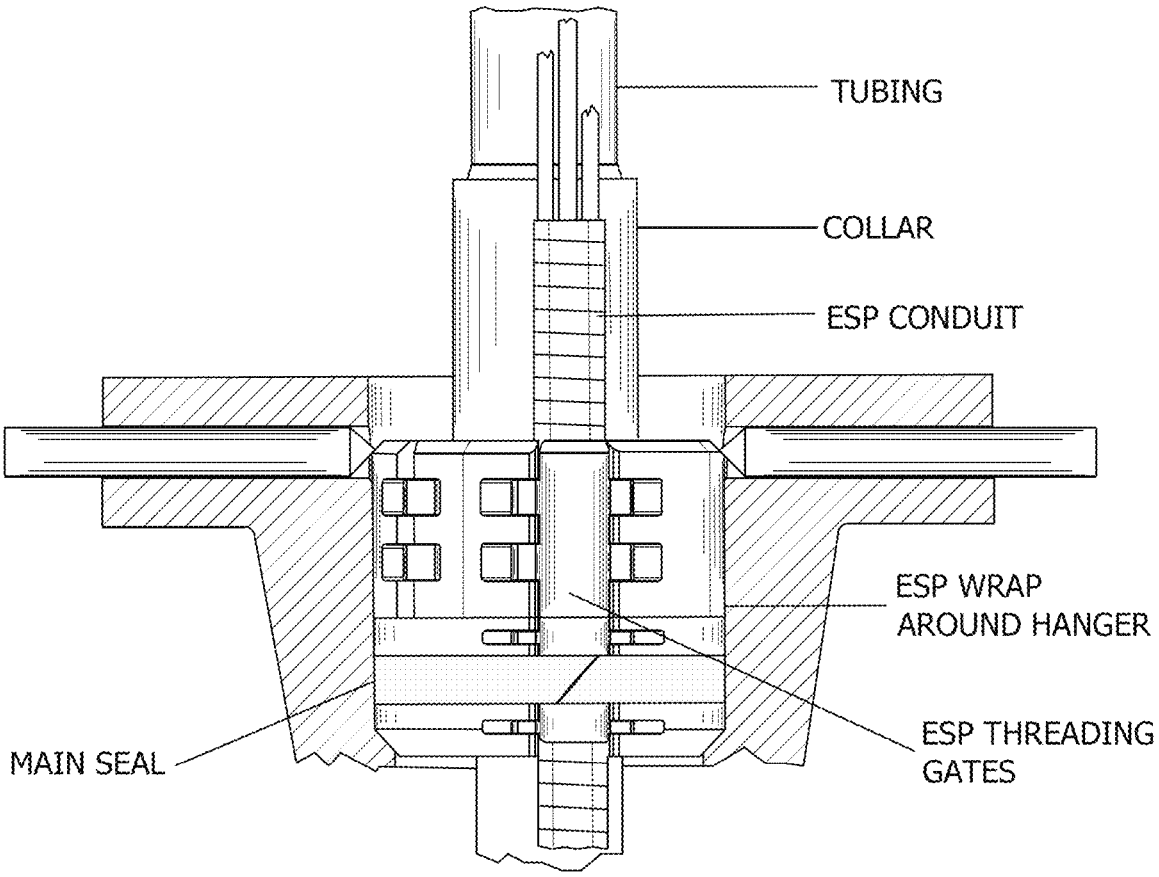
FIG. 9 is a side, partially cut-away, partially cross-sectional view of the wrap around hanger with the tubing hanging therefrom, and the hanger string compressing the main seal about the ESP conduit.

Continuing with FIG. 9, with the hanger installed about a tubing string with threaded components therein and positioned to rest in the bowl of the tubing head, the lower string weight compresses the main seal about the pipe, components (i.e., ESP power cable or other wire conduit, capillary tube or other components) as well as the bowl at the same time, sealing off the well bore below while sealing the threaded components.

The unique main seal of the present invention, being formed to receive lines, conduits, cables, wires and other components therethrough, coupled with the unique side doors formed in the hanger to engage and support a tubing string on a hanger, facilitates the utilization of the main seal to provide the pass-through of the components while effectively sealing the wellhead without the need for cutting and splicing the component(s) passing therethrough.

The temporary version of the present invention, disclosed above, is suitable for use with any conventional wellhead system on a short-term or temporary basis, such as to allow a well having an electric submersible pump (ESP) downhole to be secured overnight, without the need to remove the ESP or to cut the ESP power conduit or capillary line to seal the well.

Longer-Term Modular Side Door Hanger System for Sealing a Pass-Through in a Wellhead The second embodiment of the invention provides a permanent or long-term pass-through hanger system for sealing a well having components such as ESP power cables, capillary lines, or like emanating therefrom.

Referring to FIGS. 10A-22 of the figures, the pass-through hanger system of the second embodiment of the invention 50 utilizes a similar hanger configuration and sealing action (via the side doors or plates with gripping inserts and main seal) as the first embodiment (for short term or temporary use), with some differences, as will be detailed below.

Like the first embodiment of the invention, which was designed for short-term use, the second embodiment, intended for long-term or permanent use, utilizes a split or wrap-around hanger 57 which operates in a similar manner to the short-term embodiment, including the configuration of the main seal 61 of the hanger 57 to allow the pass-through of the components such as ESP power cable, control line, capillary line, as well as other lines, conduits, cables, or other components depending upon the operation, and utilizing the weight of the tubing string resting on the upper hanger body 14 so that the weight of same rests upon the seal to compress 64 the seal urging same against the bowl, sealing the components threaded through the seal, the compression of the seal expanding same to seal the bowl and collar, sealing the well.

Continuing with the figures, the first 62 and second 62' opposing doors respectively of hanger 57 can include the same operational elements and options, and operate in the same fashion as those disclosed in the first embodiment.

However, the first and second embodiments of the hanger of the present invention do have some important differences. One difference relates to the utilization of the hanger 57, as the second embodiment the hanger 57 A is formed to engage to a coupling 51 such as a completion coupling, production coupling, or other type as discussed herein (as opposed to the collar of a tube as in the first embodiment), the inner diameter 58 of hanger 57 of the second embodiment having a profile to engage and lock onto the coupling 51, in this case, the profile comprising a ridge 59 or raised area formed in the ID of the hanger which is formed to engage a slot 60 formed in the coupling 51, to engage and lock the hanger 57 to the coupling 51 when the hanger is closed, and forming a load shoulder L' to support the weight of the drill string when placed in the bowl. The coupling is mounted to the threaded end of the tubing 52 via handling pup 53 or the like.

For deep hole operations where the weight of the tubing string on the upper hanger body will over-compress the main seal, an alternative wrap-around hanger is provided. Referring to FIGS. 12A-12D, the alternative wrap-around hanger 57A is provided for use in those instances the weight of the string rests upon the lower hanger body 14A' (via encircling engagement with the coupling 51), the load resting upon a load shoulder L" or ridge formed by lower hanger body 14A', so that the load of the tubing string 52 rests on said lower hanger body (when seated in the bowl) and not the main seal 61, so that said main seal is not over-compressed by the weight of the string. This concept may also be applied to a tubing hanger engaging the coupling of the pipe as in the first embodiment of the hanger.

In such an application, continuing with FIG. 10A instead of utilizing the load of the tubing string to compress the main seal, downward pressure 99 is applied to the upper hanger body 14A as it rests in the bowl utilizing lock pins associated with the tubing head, or other means to apply pressure, so that downward pressure 99 is applied upon the upper hanger body 14A to compress seal 15A, expanding same outward 99', so as to engage and seal the hanger, any components threaded through the seal 61, and the bowl or production casing. The hanger 57A may be used to engage a pipe collar, nipple, or completion coupling, or other component, linkage, etc mounted to the tubing string, depending on the application.

Where the upper hanger body bears the weight of the string, or other application where over-compression of the main seal is an issue, compression limiters 91-91''' (FIG. 10) may be provided in passages 95 in the main seal 15 to limit the amount of compression in the main seal to maximize the sealing action against the coupling (the coupling configuration can vary depending on the embodiment, for example, production, completion, etc), components threaded through the seal (eg ESP power cable and control or capillary line), and bowl.

Continuing with FIGS. 10A-10F the gripping profiles associated with the hanger body B and side doors are changeable via the use of inserts for mounting to the side doors and hanger body to provide the desired configuration for the component to be situated through and gripped thereby as is the main seal, which can be changed to provide various passages to receive the component(s) passing therethrough and gripped by said inserts, as will be further discussed herein.

FIGS. 10A-10B illustrate the hanger body with upper 27 and lower 27' side doors having ESP inserts 35, 35' having the desired profile P' mounted therein, the inserts selected from a group of inserts having various profiles formed to engage and grip the various component(s) passing therethrough, each insert 35, 35' preferably engaging the inner side wall of the door mounted thereto via insert receiver slot 97' formed therein (having dimensions formed to receive the insert), the inserts 35, 35' having profiles selected to work in unison with the respective inserts mounted to the hanger body 34, 34' (which are likewise changeable with other configuration seals and secured via threaded fasteners 96") so that when the doors are secured with the components situated therein, the opposing profiles engage and grip the components passing therethrough, supporting the components in place (preferably without damaging same) as long as the respective side doors are secured.

Main seal 61 is provided with the appropriate component seal passages 100, 100', 100" formed therethrough and aligned with the installed insert profiles to facilitate the passage of the components therethrough, which components may be threaded to said seal passages via slits 101, each formed from the outer periphery of the seal to the respective seal passage for receiving the respective component.

The inserts need not be limited to gripping profiles, as inserts may be formed of an elastomeric material such as rubber and including a seal profile S' having no channel or groove for receiving a component, where no component (i.e., wire, conduit, tube, etc) passes through (also no seal passages would be formed in main seal) in those cases where no component would pass through side doors 27, 27', so that when the door is closed, the two seals contact forming a seal.

For example, other profiles may be provided other than for supporting an ESP (three conduit) profile, such as shown in FIG. 10. For example, as shown in FIG. 10B, an insert 102 having a gripping profile for a single conduit component, further discussed herein, may be provided, to allow adaptability for the sealed pass-through feature of the present hanger to accommodate various components with each of the pass through areas formed by the doors. In addition, the doors may be changed to support various inserts as well as other gripping or sealing profiles.

FIG. 10C illustrates an alternative to the gripping profile installed in FIG. 10B, illustrating inserts 102, 102' having a gripping profile installed into the door and hanger body for a single conduit component such as a single wire or control line, as opposed to the insert with gripping profile for the three conductor ESP line, for example, as shown in FIG. 10A, the component in FIG. 10C shown situated in the profile of the inserts mounted to the hanger body, and through the main seal. Also shown is single wire, line or conduit C passing through the component passage formed in seal 61, installable via slit 101 from the outer periphery of seal to the component passage, so that the component is aligned with inserts 102, 102'

FIGS. 10D and 10E illustrate the hanger body area associated illustrating the upper control line door section having an insert receiver slot 97" with threaded aperture formed to receive insert 34" mounted therein, the insert selected from a group of inserts having various profiles (the insert shown having a profile for a single component such as a conduit, line, wire etc as opposed to multiple components, so as to engage and grip any component(s) passing therethrough, and secured via threaded fastener 96'.

FIG. 10F is an exemplary seal insert S for mounting to the side door and respective opposing area on the hanger body, so that when said side door is closed, a seal is formed when no component is provided for pass through, such as, for example, in a completion operation such as setting a rocking horse when no components are required to pass through the hanger doors, as will be further discussed herein.

Continuing with FIGS. 10A-10G and 12A-12F, the operational capabilities of the present invention may be reconfigured by simply changing the hanger inserts (in the hanger body and side doors) and main seal to accommodate the component's passing through the system (or lack thereof), as well as the coupling configuration to support the desired operation.

For example, in the case of an ESP lift, the main seal could have and ESP lift configuration 103 comprising three component seal passages 100, 100', 100" for three power wires associated with one set of side doors (with respective inserts having appropriate gripping profiles, such as shown in FIGS. 10A-10*b*), and a fourth component seal passage 100'" associated with the capillary, control line or the like for ESP control or monitoring.

A gas lift configuration 103' for the main seal might comprise, for example, a passage provided on opposing sides of the seal for one component passing through each set of doors and seal, for example, for single line to pass through as well as possibly a gauge wire port, for example, the system being allowing for multiple combinations by simply changing out the inserts to the appropriate gripping profile and main seals to accommodate same.

A rod lift configuration 103" for the for the system might require no components passing through the hanger, in which case the main seal would have no component passages formed therethrough, and the inserts in the doors would comprise a seal configuration (such as those discussed earlier and shown in FIGS. 10B, 10C, and 10F), in which case the hanger would act simply as a hanger with no pass-through, sealing the well at the bowl via main seal 61 when pressure is applied to expand same to cause the seal to contact the bowl and any components threaded therethrough. With the rod lift profile, no pass-through components may be required through the side doors, so the side doors can be sealed off with the proper inserts, and the main seal without component passages, configuring the hanger for straight production without any applications going through it, the hanger acting as a conventional hanger without passthrough (by virtue of the sealed off side door ports via seal inserts and main seal without conduit passages).

Likewise, the present invention employs a selection 104, 104' or 104" of various configured couplings, each having a configuration optimized to fulfill a needs associated with the various production phases and operations. For example, coupling 104' having a thread and seal arrangement 105' for receiving a back pressure 105 or check valve would be utilized in production operation where a back pressure valve (BPV) in the coupling is desired, including ESP and gas lift, with the hanger door inserts and main seals changed accordingly to accommodate the desired production operation.

Other operations, such as production utilizing a rod lift or rocking horse, would require a coupling 104" to having the full bore 106 unencumbered, so back pressure valve or threads for same would be absent to allow the rod connections unencumbered passage through. As no wires or capillary lines or the like would be necessary in such an operation, the side doors of the hanger could have seal inserts provided therein a main seal 61 having no component passages 103" passing through to be suitable for production would be provided.

The present system is designed to allow flexibility in its application, and thereby reconfigure hanger in any style of artificial lift hanger system just by changing the inserts to provide the required bore for the desired operation.

The present system thereby allows reconfiguration of the hanger system to facilitate sealed component pass-through as required (with various pass-through options) without the need for cutting and splicing utilizing the unique side door configuration of the present invention, and by simply by changing the inserts and seal, the system is reconfigurable to allow different component pass-through accommodating different well operations over the life of the well whether it be drilling, completion, production, or P&A, dispensing with the present day requirement that the customer have to purchase new surface equipment every time they change well production profiles or procedures.

Other Applications of Modular Side Door Pass-Through System

While present invention's unique side door pass-through system and method provides effective options and flexibility of use with tubing hangers and the like as discussed in the preceding disclosure, the sealable pass-through aspects of the system are readily useable in other applications to support the changing operational phases of a well, including use in downhole production equipment and the like.

For example, the pass-through system incorporating the side doors with main seal can be applied downhole packers, bridge plugs, or any other downhole apparatus requiring sealed (as well as partially sealed, selectively sealed, and unsealed) pass-through capability.

Further, the teachings of the pass-through method and apparatus of the present invention are not only useful with traditional components such as control cables, control lines, wire gauge ports, capillaries, ESP power cables, logging equipment control and monitoring lines, etc, but also conductors and cable supporting smart technologies in exploration, production, completion, as the present system provides a sealed pass-through which does not require splicing in an electromagnetically neutral and therefore interreference free system, whether the pass-through component be wire, fiber optic, cable, conduit, etc.

The present application can be utilized with packers, bridge plugs, as well as other apparatus requiring a pass-through situation in a well (downhole as well as at the surface), and can provide multiple sealed pass-through passages without splicing or breaking the line connection for the penetration as it passes through the side doors in similar fashion to the above described embodiments. A packer, for example can be used to selectively provide a seal between the production tubing and casing or liner for various reasons including: 1) isolate productions zones; 2) contain formation pressure; 3) provide a pressure-tight seal to force reservoir fluids into the tubing and out of the anulus between the tubing and casing, and 4) other functions.

Continuing with FIGS. 10H-10K, an exemplary downhole pass-through apparatus D is shown in the form of a packer 110 comprising a body having upper 118 and lower 118' sections, each said section having one or more pass-through areas A enclosed by panel or door, (in the present example of FIG. 10H, upper 115 and lower 116 panels, respectively) with a packing element 111 (having a component pass-through passage) situated therebetween, the apparatus D providing a sealed, pass-through capability (without need for splicing as in the prior art) which is reconfigurable to provide sealed pass-through for various components (for example, including but not limited to, cables, gauge tubing, control wires, capillaries, etc) as required.

The packing element 111 or expandable seal of the present example is configured to selectively expand to seal the clearance 113 between the tubing 112 (about which the packer is mounted) and surrounding casing 112' or other enclosure, as well as provide a seal for any component passing therethrough.

Figure 10H:
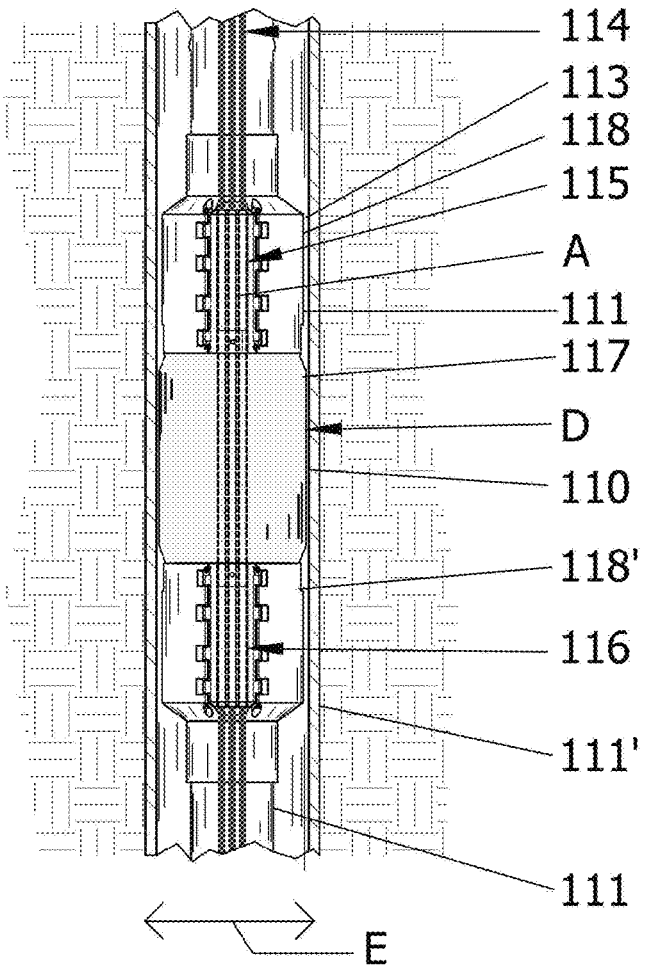
FIG. 10H is a side, partially cut-away view of a packer having pass-through capability utilizing the teachings of the present invention, the apparatus shown having upper and lower hinged access panels enclosing opposing gripping inserts gripping a three line cable 114 (the component), which might be used to power an ESP, the cable passing through a passage in a packing element, the packing element sealing off a tubing string (and the component passing through) from a casing.
Figure 10I:
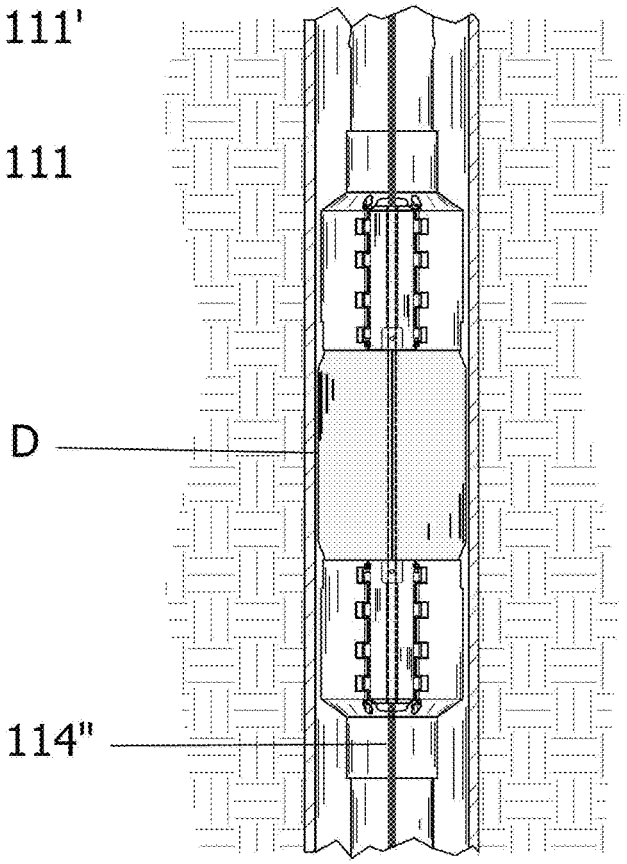
FIG. 10I is a side, partially-cut away view of the down hole pass-through apparatus D of FIG. 10H, illustrating the hinged access panels or side doors having gripping inserts mounted therein (as well as packing element component pass-through passage) configured for a single control line 114" (the component) passing therethrough.
Figure 10J:
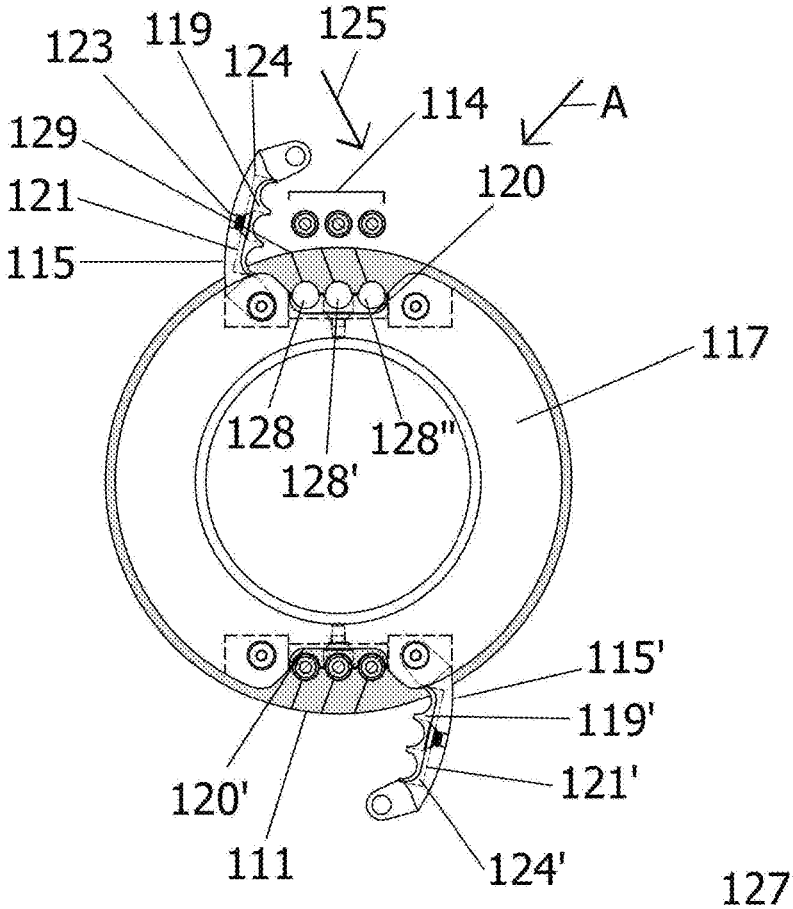
FIG. 10J is a top, cutaway, partially cross-sectional view of the invention of FIG. 10H, illustrating the opposing hinged access panels or doors open with gripping inserts mounted to the panels and body of the unit configured to grip the components passing therethrough, as well as the passages formed through the packing element for passage of the components therethrough, and slits formed in the packing elements leading to said passages for mounting the components therethrough.
Figure 10K:
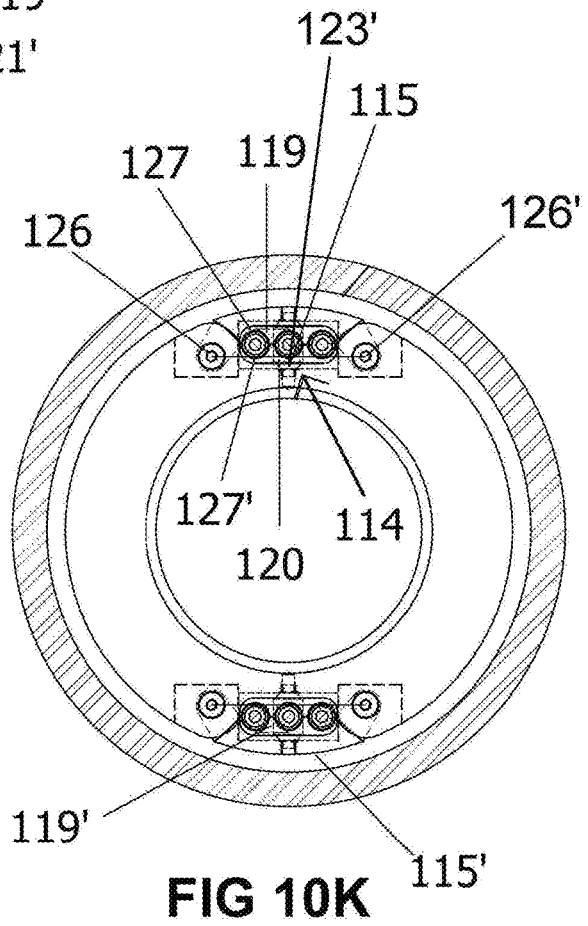
FIG. 10K is a top, cutaway, partially cross-sectional view of the invention of FIG. 10J, with the hinged access panels or doors closed so that the gripping inserts engage and grip the components situated therein.
Figure 11:
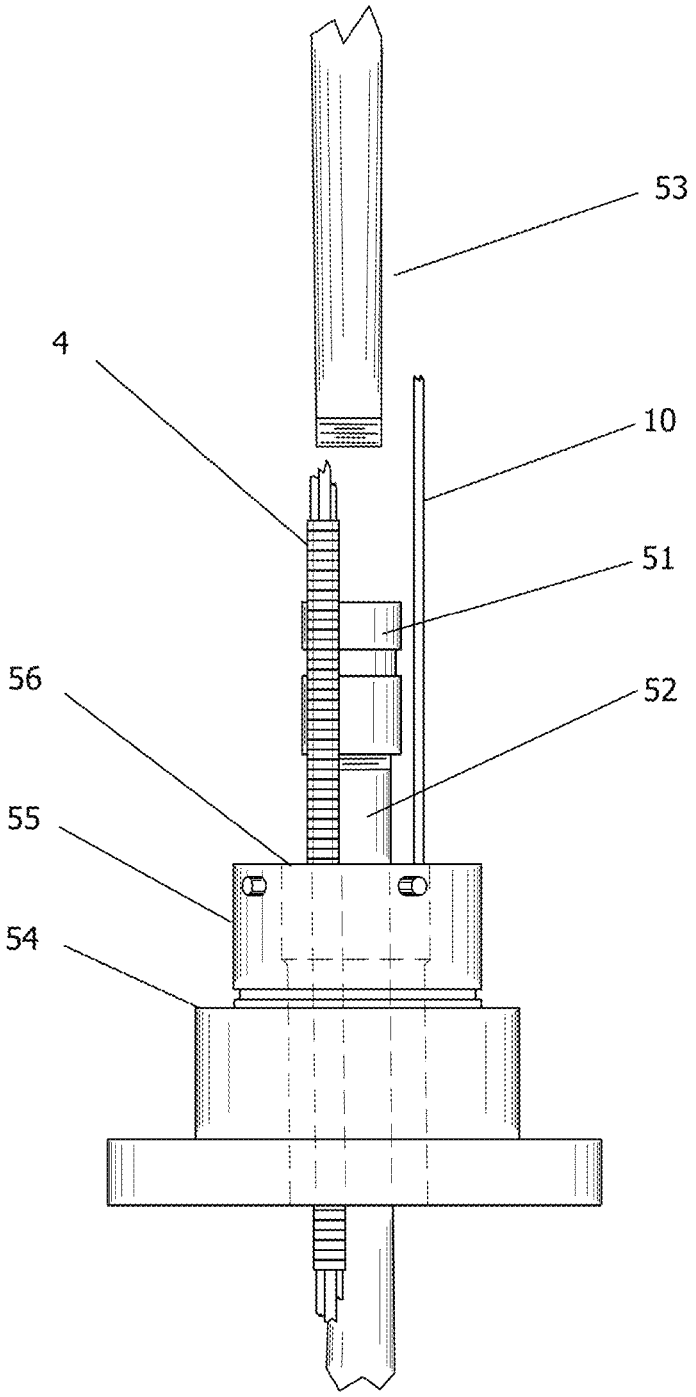
FIG. 11 is a perspective view of a wellhead illustrating a string of tubing emanating from a modular tubing head having a coupling engaged thereto with a three-conductor jacketed ESP power cable and capillary tube shown.
Figure 12:
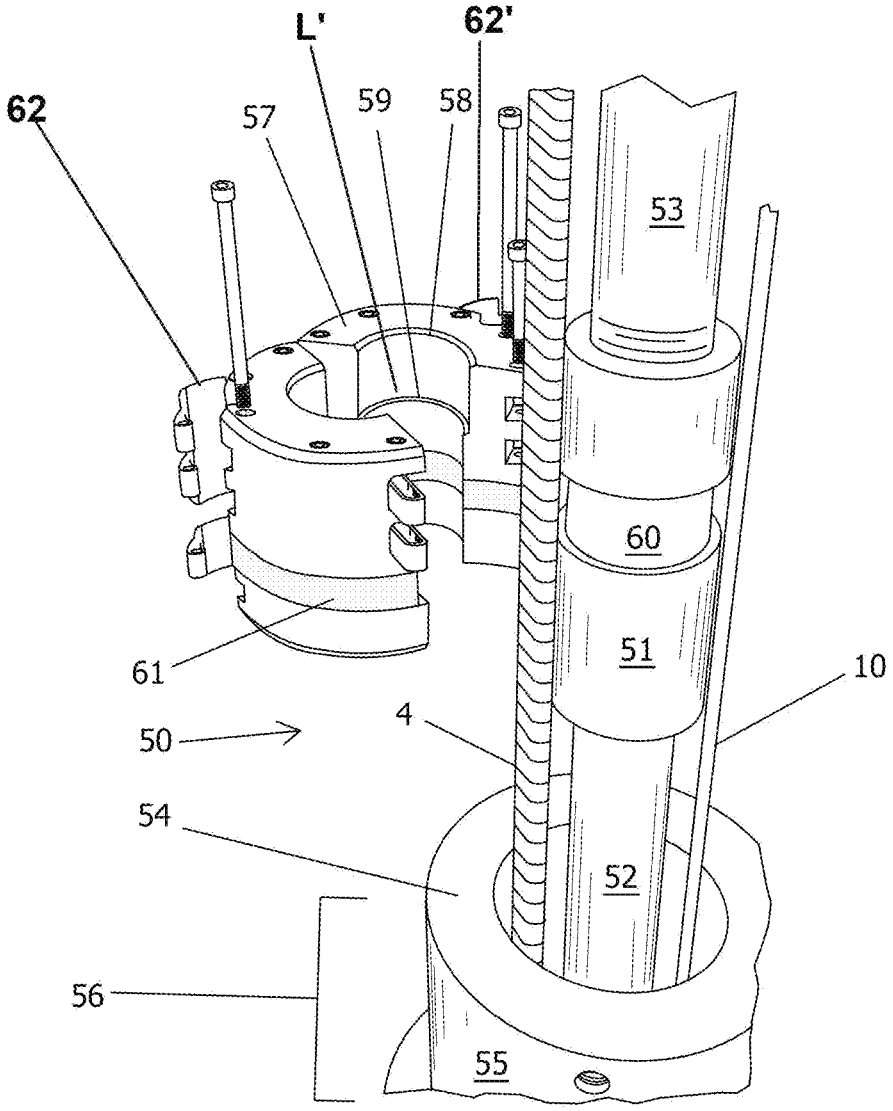
FIG. 12 is perspective view of the wellhead of FIG. 11, further illustrating the wrap-around hanger of the preferred embodiment of the present invention for use with a permanent or long term pass-through wellhead seal, engaging a coupling engaging the tubing, the coupling in the present embodiment configured to engage the coupling medially.
Figure 12A:
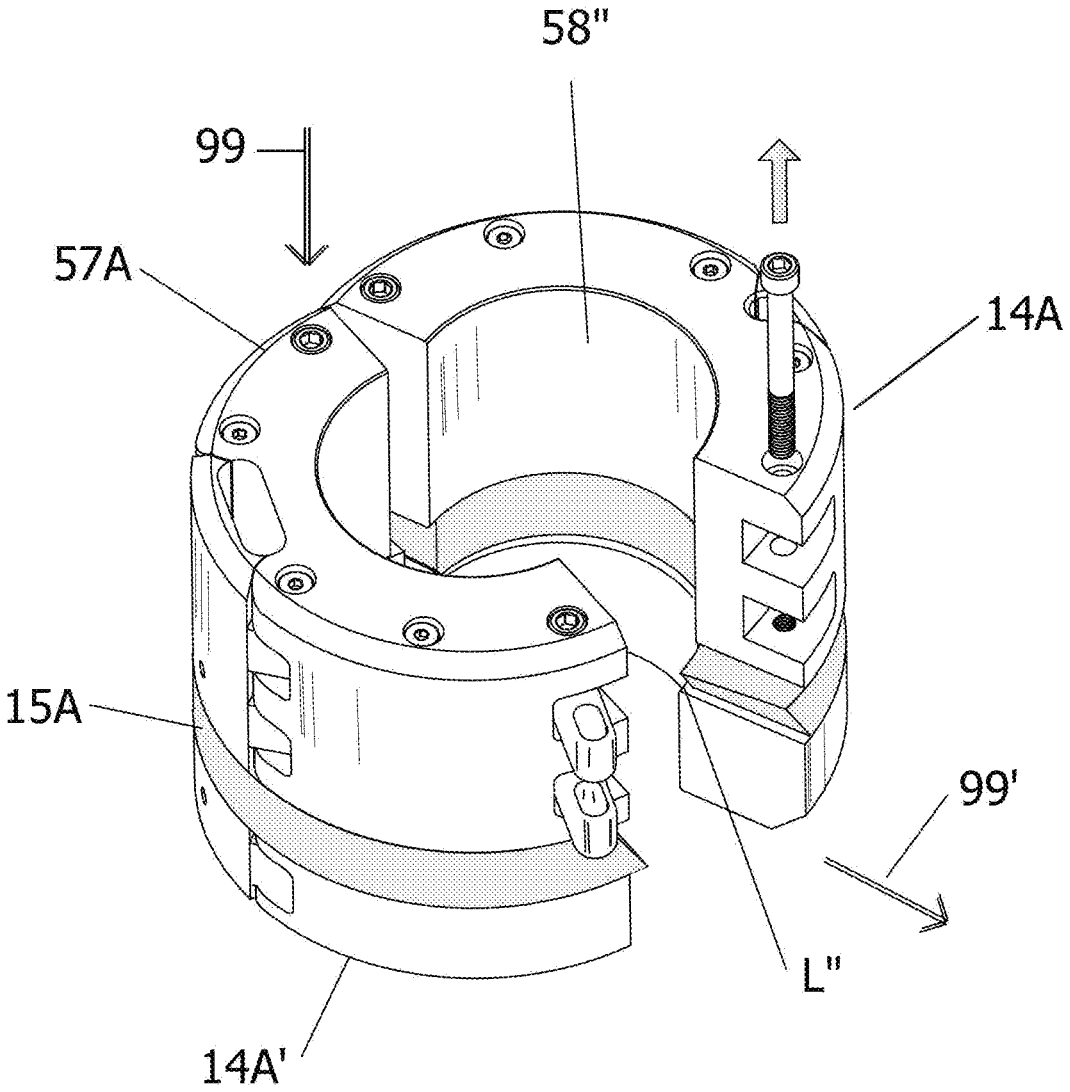
FIG. 12A is a side, perspective view of an alternative wrap-around hanger 57A when compared to the hanger 57 of FIG. 12, the alternative hanger 57A providing load support via the lower hanger body 14'A, so that the main seal is not over-compressed by the weight of the string.
Figure 12B:
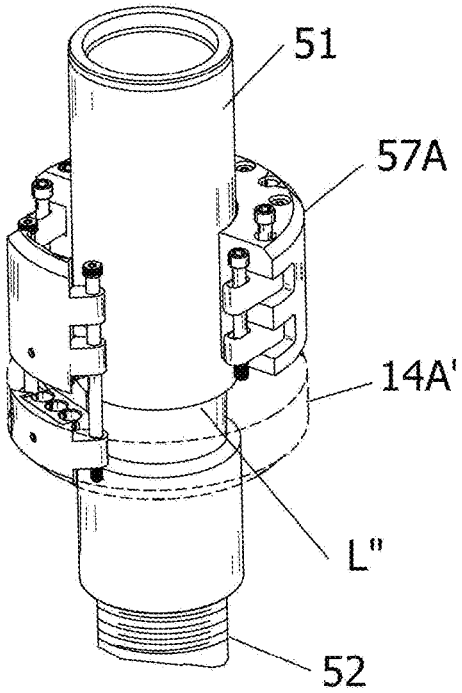
FIG. 12B is a side, partial, partially exploded, perspective view of the wrap-around hanger 57A of FIG. 12A, engaging coupling 51 engaging tubing 52.
Figure 12C:
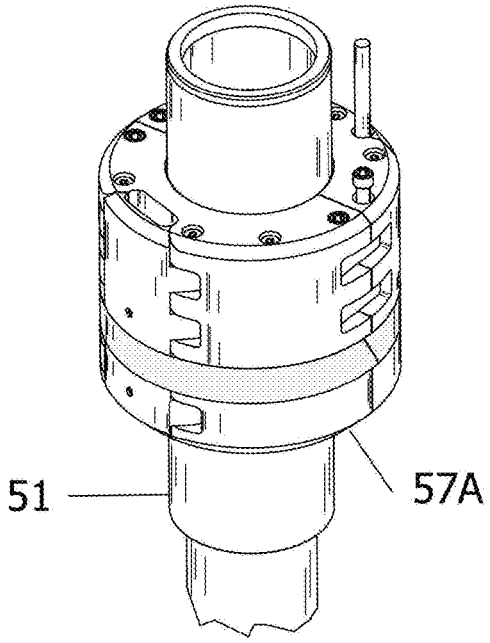
FIG. 12C is a side, perspective view of the wrap-around hanger 57A of FIG. 12B engaging coupling 51.
Figure 12D:
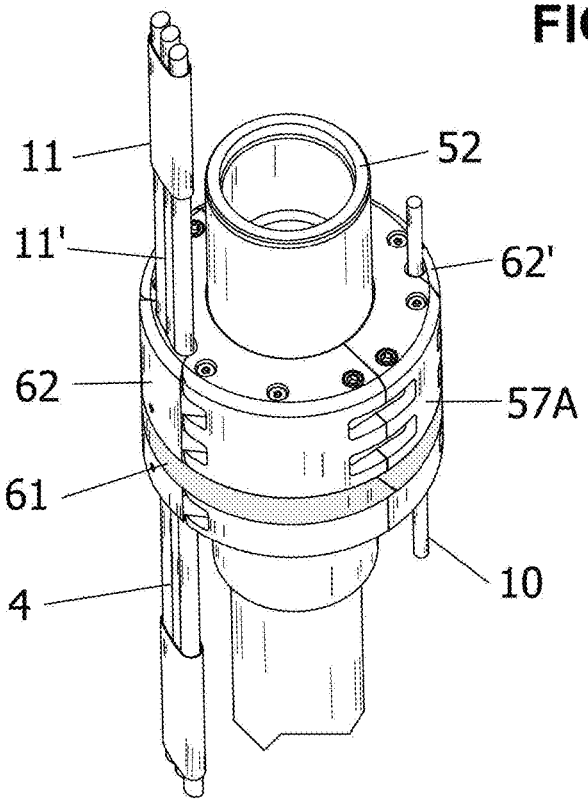
FIG. 12D is a side, perspective view of the wrap-around hanger of FIG. 12C engaging coupling 52, the figure showing components comprising three insulated wire 11' conductors of ESP cable 4 or the like gripped by and passing through hanger 57A (with the jacket 11 of the ESP cable removed in the pass-through area) at the first side doors 62, and a control line 10 gripped by and passing through second side doors 62', the components sealed via main seal 61, upon compression thereof.
Figure 12E:
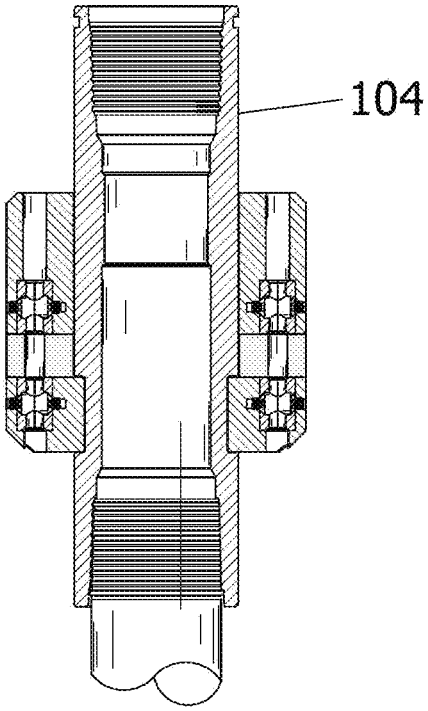
FIG. 12E is a side, partially cross-sectional, partially cut-away view of a coupling 104 having mounted thereabout a wrap-around hanger, said coupling engaging a length of tubing.
Figure 12F:
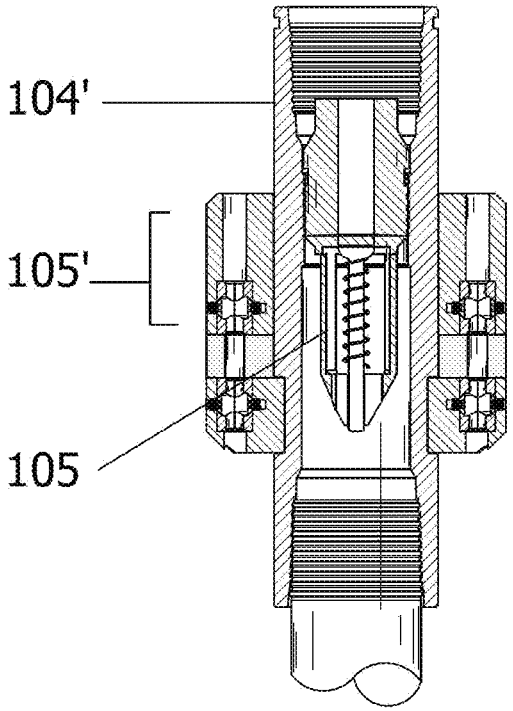
FIG. 12F is a side, partially cross-sectional, partially cut-away view of a coupling 104' having situated therein a back pressure valve 105 (BPV) for use in a production operation, for example, a ESP or gas lift, as further discussed herein.
Figure 12G:
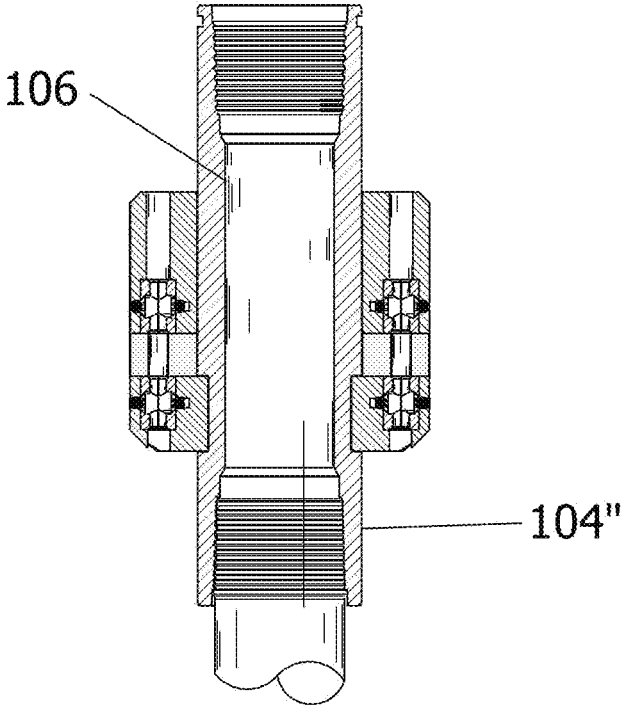
Figure 13:
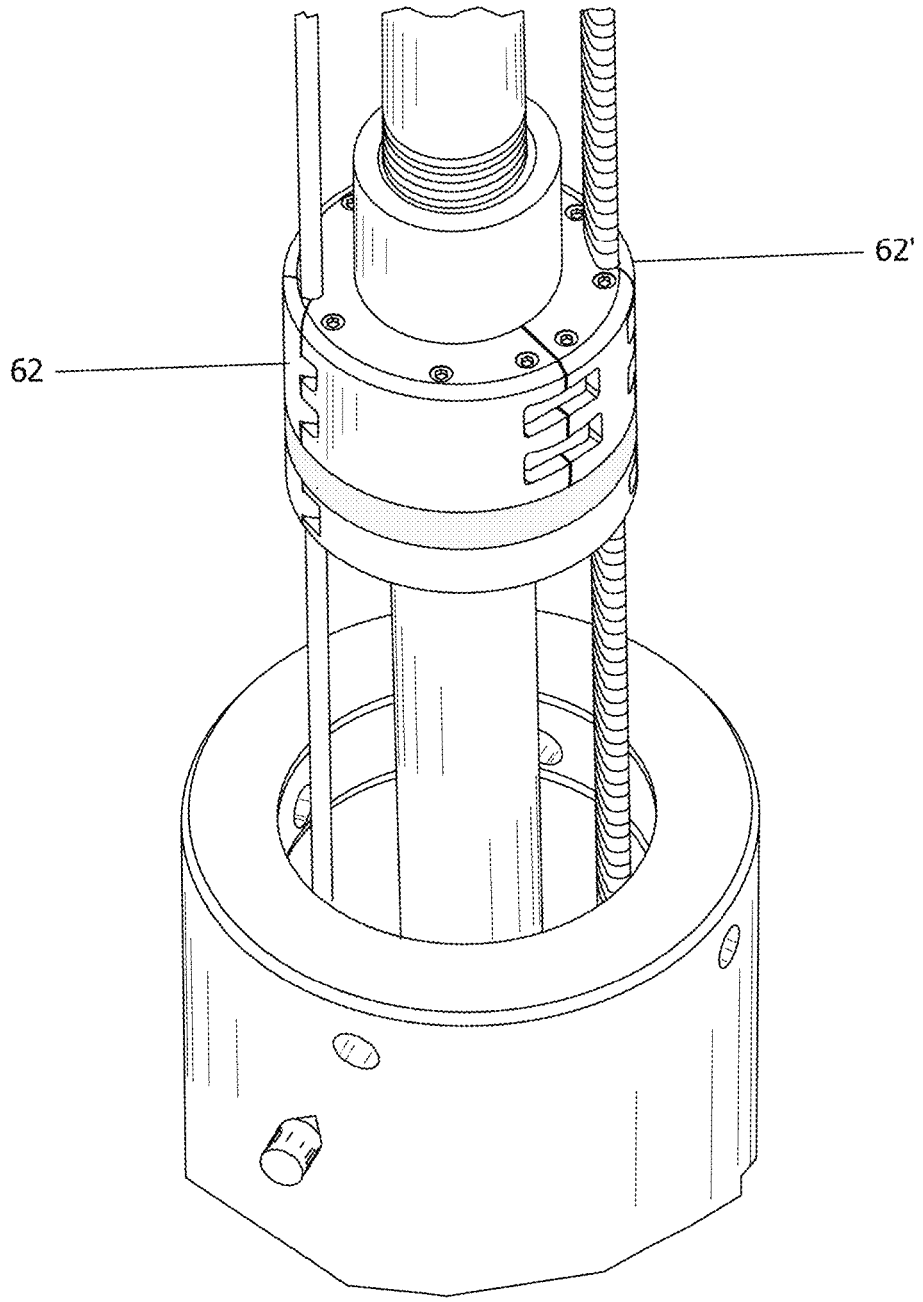
FIG. 13 is a perspective view of the invention of FIG. 12, illustrating the wrap-around hanger situated about the coupling with the ESP power cable and capillary tube secured by the first and second upper and lower doors, respectively, of hanger.
Figure 14:
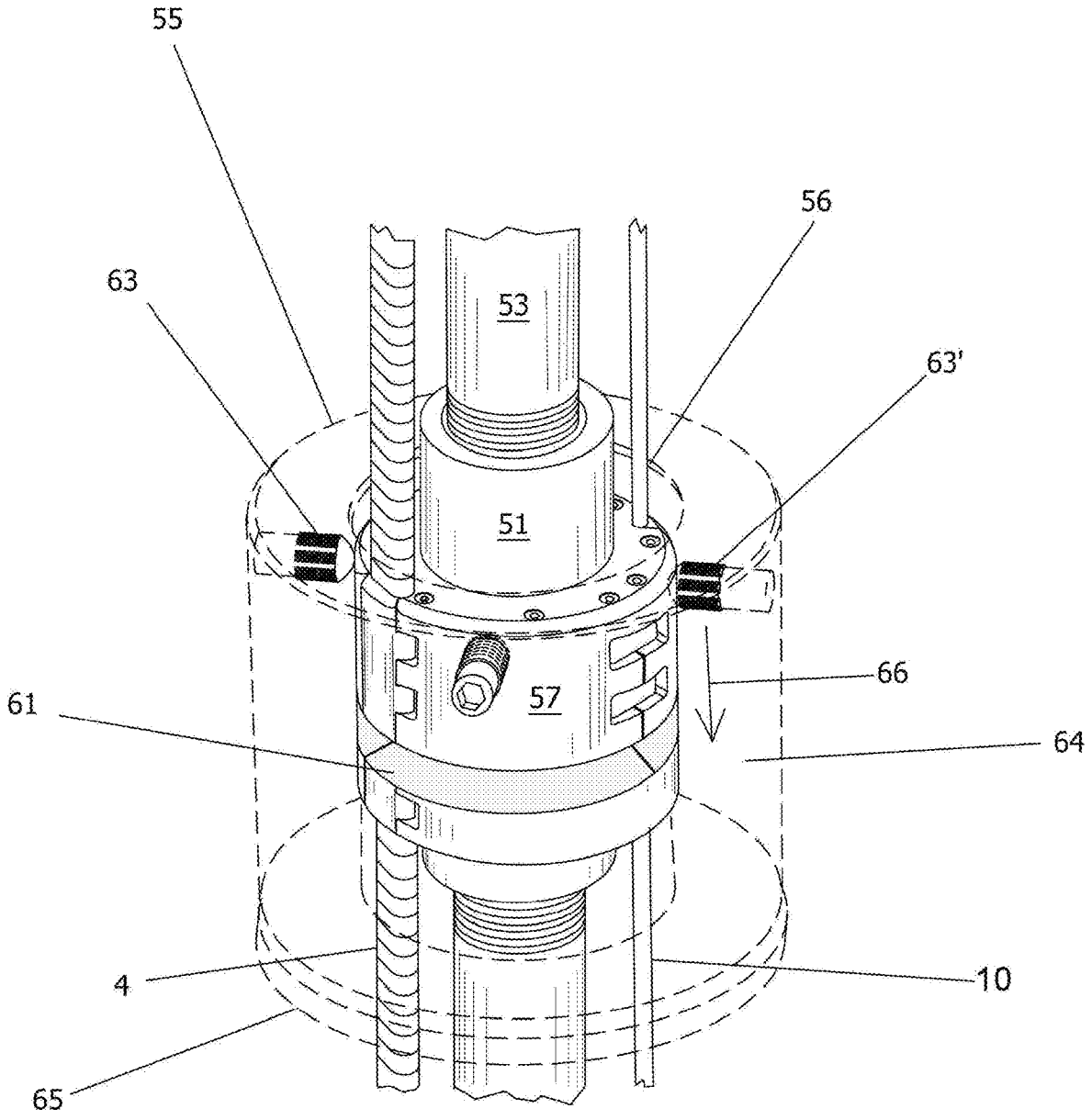
FIG. 14 is a perspective view of the invention of FIG. 13, illustrating the wrap around hanger with ESP power cable and capillary tube situated about the tubing about the coupling, lowered into the tubing head bowl and the weight of the tubing string resting on the hanger to compress the main seal and seal the components threaded therethrough (in this case, the ESP power cable and capillary line), and locking pins provided to lock the hanger in the bowl of the tubing head.
Figure 15:
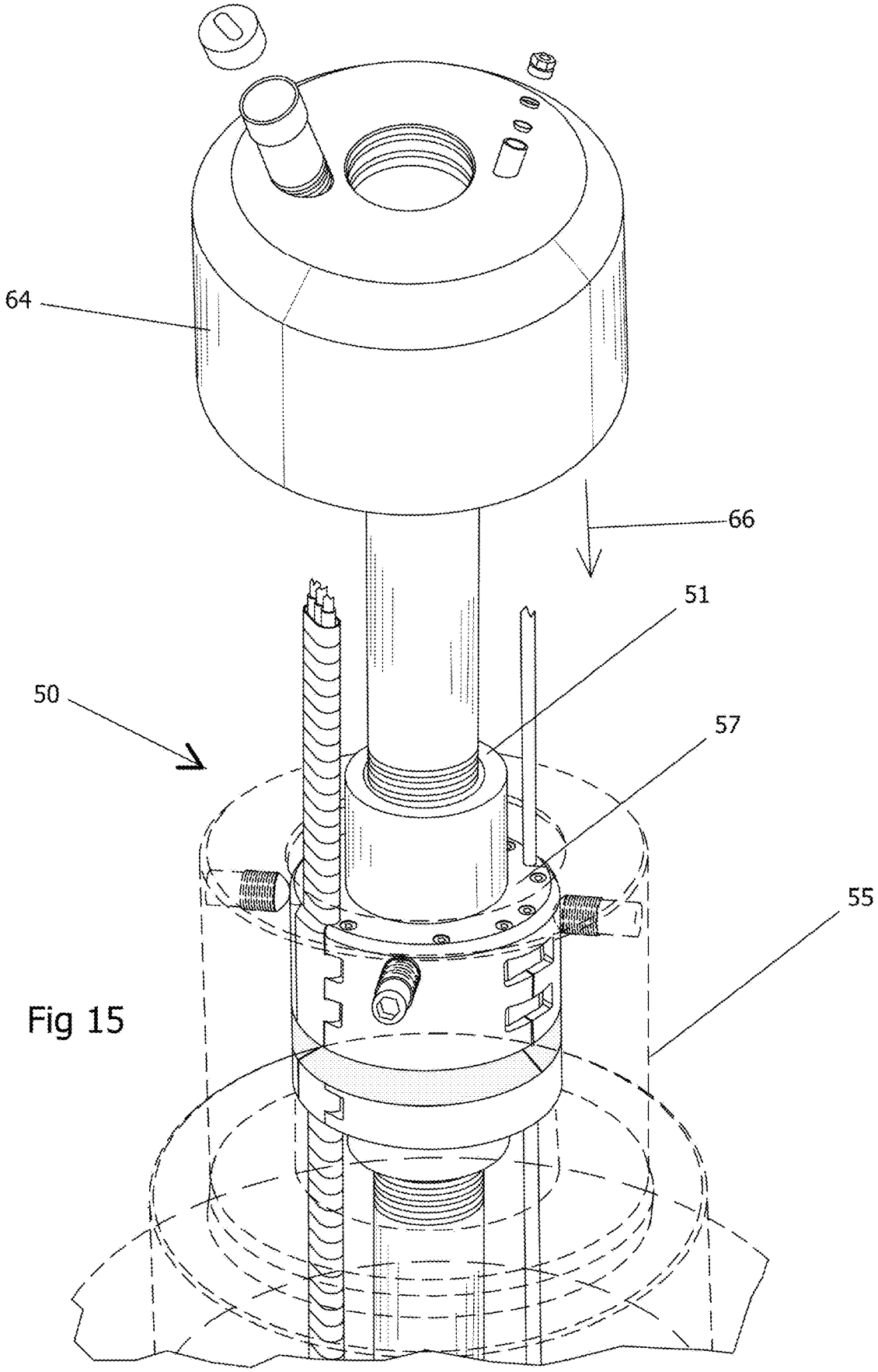
FIG. 15 is a perspective view of the invention of FIG. 14, illustrating the tubing head cap being slipped over the coupling, hanger and bowl area of the tubing head, with top ports and seals for the ESP power line and capillary line, shown respectively, (in exploded form).
Figure 16:
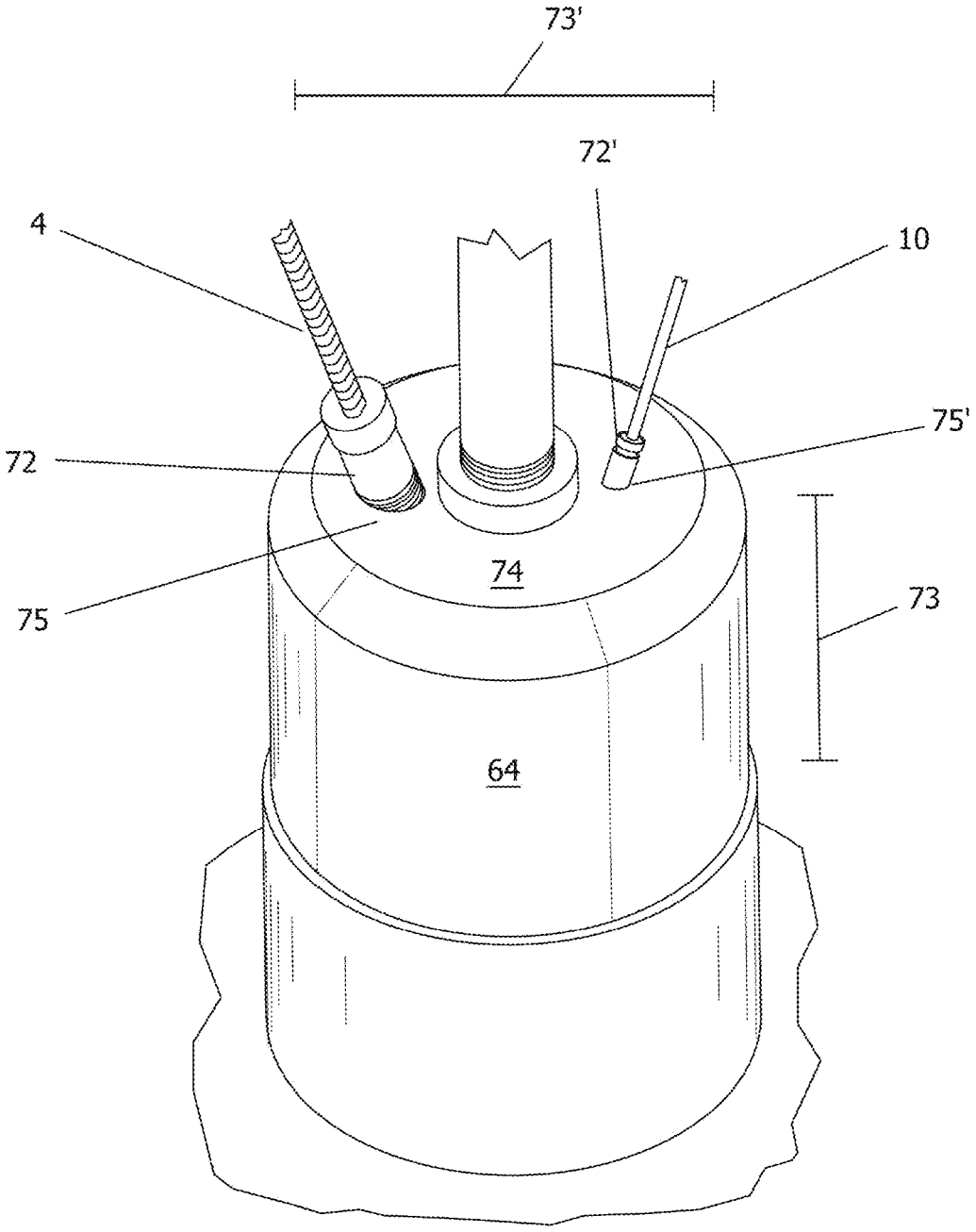
FIG. 16 is a side, perspective view of the invention of FIG. 15, with the cap clipped over neck of the tubing head (about the bowl) and secured thereto, and with ESP power line and capillary line slipped through respective ports and sealed via terminator-like compression fitting for the ESP line.
Figure 17:
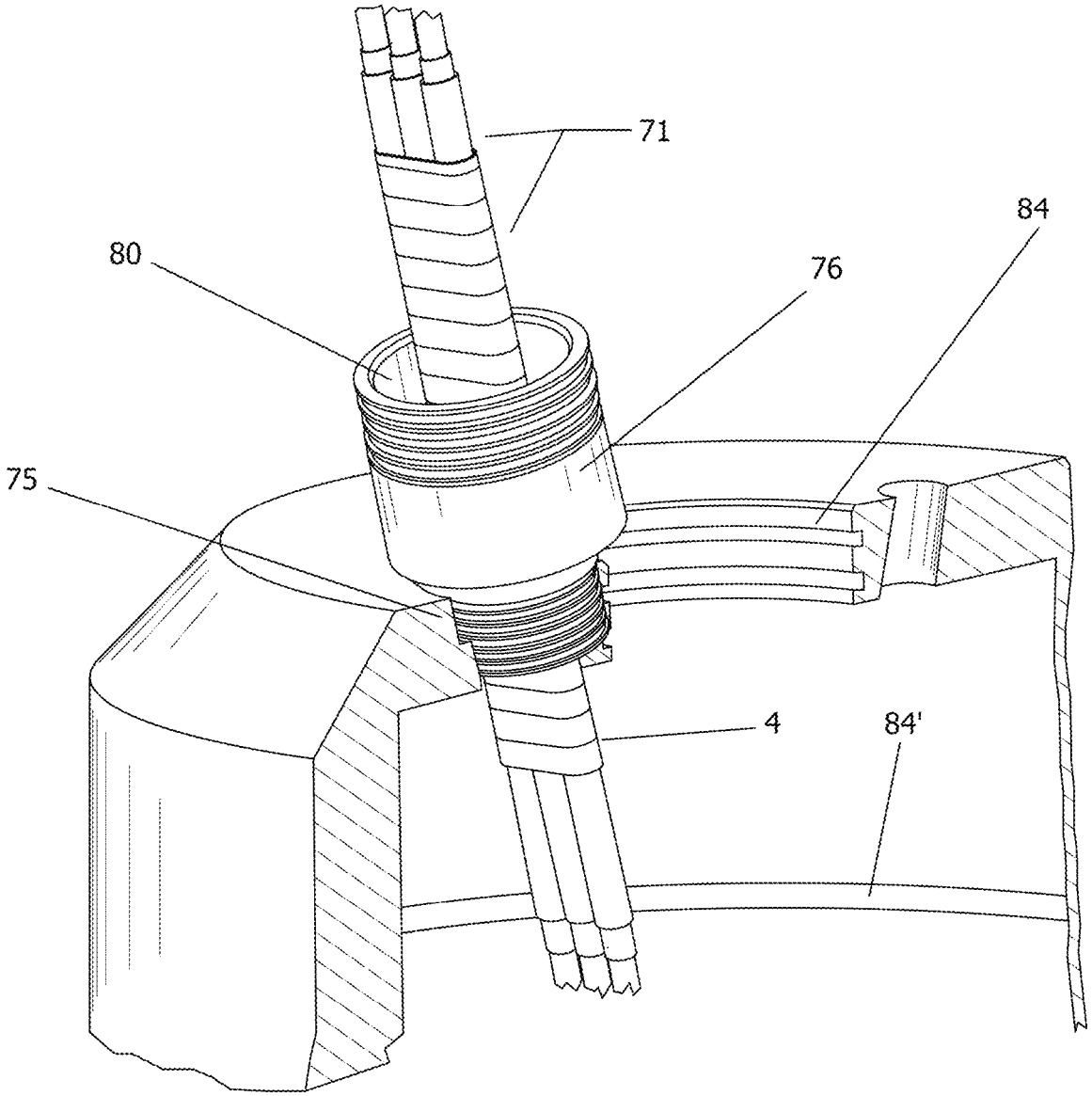
FIG. 17 is a side, perspective, partially cut-away, close-up view of the housing of the ESP power line seal housing engaged to the cap.
Figure 18:
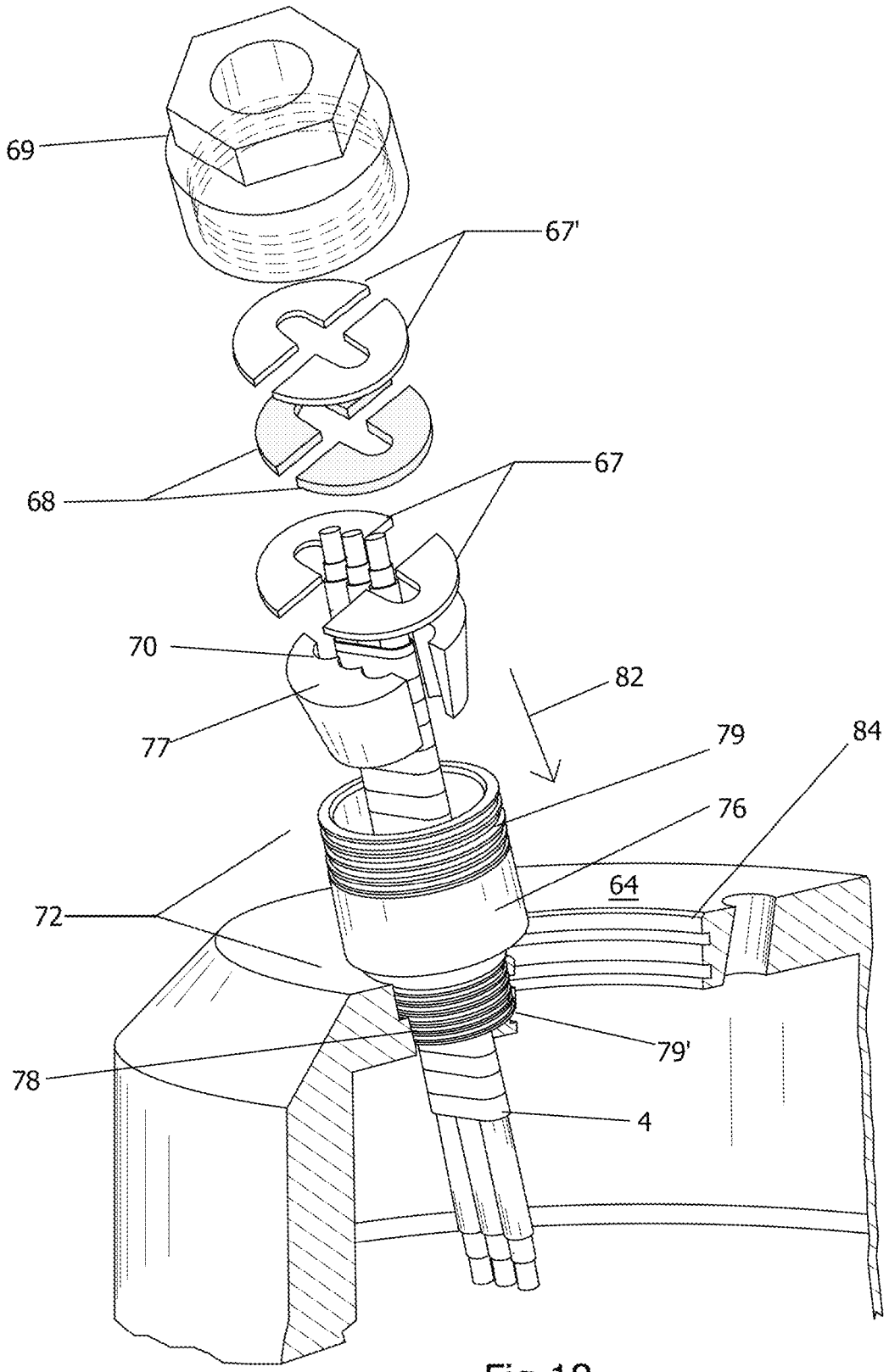
FIG. 18 is a side, perspective, partially cut-away, close-up, exploded view of the ESP line compression seal, illustrating the housing with wedge base, grippers engaging the wedge base, split washers, seals and cap.

Referring to Figures, in the exemplary embodiment of the present invention each of the upper 118 and lower 118' sections of apparatus body 117 include at least one pass-through area A. FIGS. 10J-10K shows two pass-through areas on opposing sides of apparatus body 117 comprising first 115, and second 115' hinged access panels shown having inserts 119, 119' mounted thereto, to selectively provide the desired gripping profile for the components to be engaged (FIGS. 10H and 10J-10K show a 3-wire gripping profile for a three conductor wire 114, which could be used, for example, to power/control an ESP or other lift system, or configured otherwise to accommodate another lift system or downhole application). FIG. 10I illustrates another gripping profile provided for a single (1) line/control cable, capillary, etc, passing therethrough.

Returning to FIGS. 10J-10K, the inserts are mounted to and supported by the inner wall 124, 124' of the access panels 115, 115', respectively (inserts 119, 119' in FIG. 10J-10K include the same elements and function similarly as disclosed herein). In addition, opposing inserts 120, 120' are mounted to the body, respectively. Again, the gripping configuration of the inserts are preferably diverse so that the desired configuration can be selected from a group of inserts having various profiles formed to engage and grip the desired component(s) passing therethrough when the panels are closed or and affixed to be body, for example, via threaded fasteners 126, 126' (while the term "panel" is used, alternatively doors or plates, covers, support, etc can be used for the same effect, depending on the arrangement, so the term "panel" is used for discussion purposes, but is not intended to be limiting).

Each panel mounted insert 119, 119' preferably engages the inner wall of the panel mounted thereto (115, 115' respectively), shown seated in insert receiver slot 121, 121' formed in the panel (having dimensions formed to receive the insert), the inserts 119, 119' mounted via threaded fasteners 123 having profiles selected to work in unison with the respective inserts mounted to the hanger body 120, 120' (which are likewise changeable with other configuration seals and secured via threaded fasteners 123') so that when the doors are closed 125 and secured (via fasteners 126, 126') with the components situated therein, the opposing profiles (i.e, 119, 120) engage and grip opposing sides 127, 127' of the components passing therethrough (in the case of FIGS. 10J, 10*k*, three conductor wire 114), supporting the components in place (preferably without damaging same) as long as the respective side doors are secured.

The packing element 111 or seal is provided with the appropriate component seal passages 128, 128', 128" formed therethrough and aligned with the installed insert profiles to facilitate the passage of the components therethrough, which components may be threaded to said seal passages via slits 129, each formed from the outer periphery of the seal to the respective seal passage for receiving the respective component.

The inserts need not be limited to gripping profiles, as inserts may be formed of an elastomeric material such as rubber and including a seal profile having no channel or groove for receiving a component (such as the type of seal profile S in FIG. 10F), where no component (i.e., wire, conduit, tube, etc) passes through (also no seal passages would be formed in main seal) in those cases where no component would pass through side doors, so that when the door is closed, the two seals contact forming a seal.

Continuing with FIGS. 10A-10G and 12A-12F, the operational capabilities of the present invention may be reconfigured by simply changing the hanger inserts (in the hanger body and side doors) and main seal to accommodate the component's passing through the system (or lack thereof), as well as the coupling configuration to support the desired operation.

For example, in the case of an ESP lift, the main seal could have and ESP lift configuration 103 comprising three component seal passages 100, 100', 100" for three power wires associated with one set of side doors (with respective inserts having appropriate gripping profiles, such as shown in FIGS. 10A-10*b*), and a fourth component seal passage 100'" associated with the capillary, control line or the like for ESP control or monitoring.

A gas lift configuration 103' for the main seal might comprise, for example, a passage provided on opposing sides of the seal for one component passing through each set of doors and seal, for example, for single line to pass through as well as possibly a gauge wire port, for example, the system being allowing for multiple combinations by simply changing out the inserts to the appropriate gripping profile and main seals to accommodate same.

A rod lift configuration 103" for the for the system might require no components passing through the hanger, in which case the main seal would have no component passages formed therethrough, and the inserts in the doors would comprise a seal configuration (such as those discussed earlier and shown in FIGS. 10B, 10C, and 10F), in which case the hanger would act simply as a hanger with no pass-through, sealing the well at the bowl via main seal 61 when pressure is applied to expand same to cause the seal to contact the bowl and any components threaded therethrough. With the rod lift profile, no pass-through components may be required through the side doors, so the side doors can be sealed off with the proper inserts, and the main seal without component passages, configuring the hanger for straight production without any applications going through it, the hanger acting as a conventional hanger without passthrough (by virtue of the sealed off side door ports via seal inserts and main seal without conduit passages).

While the system references side panels which may pivot from an open to a closed position, such a reference is likewise for exemplary purposes, and the present system may be implemented via other than the use of panels, for example, doors or plates affixed via threaded fasteners at opposing ends, or hinged access frames or supports, in any event having gripping inserts (or seal inserts, depending on the application) mounted to their inner side formed to engage opposing inserts mounted to the body of the unit having a grip profile chosen to engage and grip opposing sides of the component passing therethrough, coupled with an selectively expandable seal having a passage formed to receive said component therethrough.

Modular Tubing Head for Hanger System

Unlike the temporary (or shorter term) hanger system of the present invention, the long-term hanger system (the second embodiment) is configured to utilize a specially-configured, modular tubing head (which may incorporate an interchangeable flanged adapter). The modular tubing head 54 of the present invention has a neck 55 area formed to provide the bowl 56 to receive and support the hanger 57 and supported tubing, as well as threaded locking bolts 63, 63' to lock the hanger in the bowl, to prevent downhole pressure from urging the hanger with tubing from the wellhead, while effectively packing off and sealing the well bore.

In the second embodiment, the neck 55 of the modular tubing head 54 is formed to receive a bowl cap 64 to envelope and seal off the system, as will be further disclosed below. Further details on the modular tubing head 54 and locking bowl cap of the present invention are described in applicant's U.S. Pat. No. 8,485,262 B1 (the '262 patent) issued Jul. 16, 2013 listing present applicant/inventor John W Angers as inventor, the contents of which are incorporated herein by reference thereto.

Continuing with FIGS. 15-21, the bowl cap 64 of the present embodiment of the invention is provided to engage the neck 55 of the modular tubing head 54, sealing off the bowl 56, hanger 57, as well as much of the coupling 51. The bowl cap has similarities to that taught in the above '262 patent, the contents of which are incorporated herein by reference thereto. The cap has a height 73 and inner diameter 73' (ID) to slip over envelope the neck 55 of the modular tubing head 54, and engage the base of the neck via groove 65 (or threaded bolts 86, FIG. 22), locking same in place. Gaskets 84, 84' (FIG. 22) may be provided along the inner wall of the bowl to engage and provide a seal about the neck of the modular tubing head upon which the cap is mounted as well as where the coupling emanates from the top of the bowl. Further, a gasket 84 may be provided at the opening of the bowl cap 64 to engage the outer diameter of the coupling.

Continuing with FIGS. 15-20, unlike earlier versions of the bowl cap disclosed in the '262 patent, the bowl cap 64 of the present invention incorporates sealed, pass-through compression fittings 72, 72' in the top of the unit for components passing therethrough, in this case, the ESP Power line 4 and capillary line 10, which pass out of the top 74 of the bowl cap 64 via first 75 and second 75' apertures via first 72 and second 72' compression fittings, respectively.

The first 72 compression fitting, suitable for the ESP power line 4 or the like (jacketed or un-jacketed) comprises a housing 76 formed to threadingly engage (via threaded area 78) the top of the bowl cap, the housing providing a sealed passage out of the bowl cap for the passage of the component (in this case, the ESP line) therethrough. The housing 76 has first 79 and second 79' ends, and provides a terminator-like compression fitting which will compress and seal about the electric line.

A split insert 77 is placed about opposing sides of the ESP power line 4 and has a frustoconical form 83 (i.e., having an outer diameter varying from wide to narrow) to engage the inner walls of the housing, which taper from wide to narrow toward threaded area 78 from the first 79 end, providing a wedge-lock type compression seal. The opposing split portions of insert 77 are formed to engage the component, in this case, the ESP power line 4 along its width 71, the insert portion or gripper contacting the component, sandwiching same, the insert 77 having formed therein a contact profile 70 formed to match or be compressed to form the outer profile of the component on each side, to provide a seal therebetween, while the insert 77 side contacting the inner housing wall is formed to have a contact profile (in this case, a radial profile) to fully engage the inner housing 76 in sealing fashion, and/or be compressible to form said profile when engaging same in use.

In use, the threaded portion 78 of the housing 79 is threadingly engaged to the top 74 of bowl cap, the component (in this case the ESP power line 8) is passed through the housing 79, the appropriate split insert 77 is selected having the right profile or composition to seal the component, then opposing sides of the insert are situated in the housing to sandwich the component.

Figure 19:
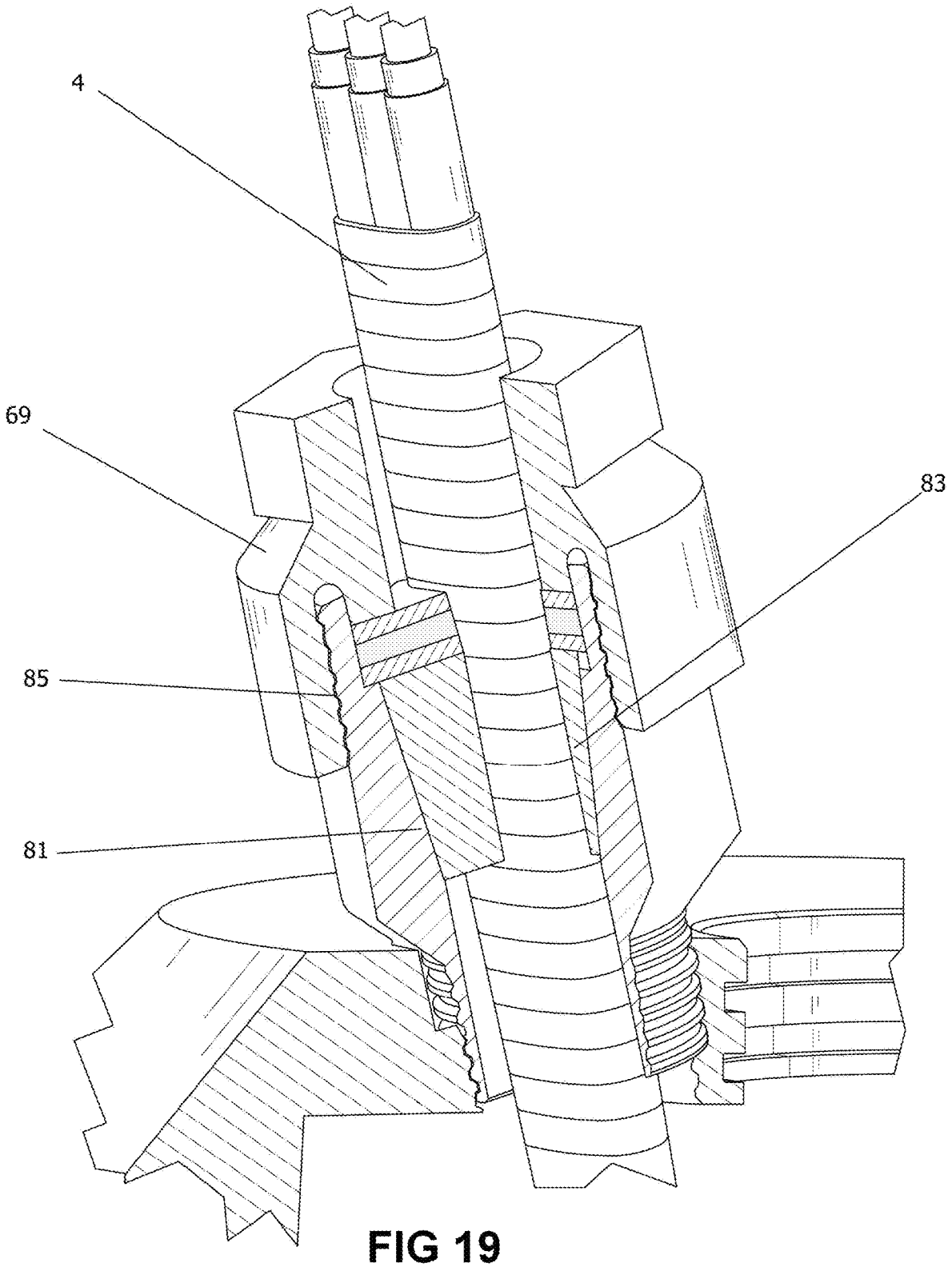
FIG. 19 is a partially cut-away, close-up, partially cross-sectional view of the ESP line compression seal of FIG. 18, illustrating the seal enveloping the ESP power line in sealed fashion.

Then rubber or elastomeric 68, and metal 67, 67' split spacers are stacked upon the inserts, alternating the type of spacers as shown (with preferably metal spacers engaging the cap 69 and insert 77), then threaded cap 69 is applied to threadingly engage (via threads 85) the housing, the threaded engagement applying pressure to the spacers and insert and urging same into 82 the housing 76, so that the frustoconical form 83 of the insert engages the taper 81 formed in the inner walls of housing, urging the insert in sealed engagement against the component (ESP power line 8) and inner walls of the housing, to provide a compression seal about same, (as shown in FIG. 19).

As shown, the spacers 67, 67', 68 have channels formed therein to receive the component, and can thus vary in size, shape and material depending in profile depending on the component utilized.

Other pass-through components are likewise sealed similarly, each component preferably passing through its own aperture formed in the top of the bowl cap 64, such as, in the present case, the capillary line 10 is sealed via a second compression fitting 72' associated with the second aperture 75' in the bowl cap 64, although a third party compression fitting may be used depending on the component involved and the sealing requirements. For example, for the capillary line, a third party (for example, SWEDGELOCK brand compression fitting) may be suitable.

Figure 20:
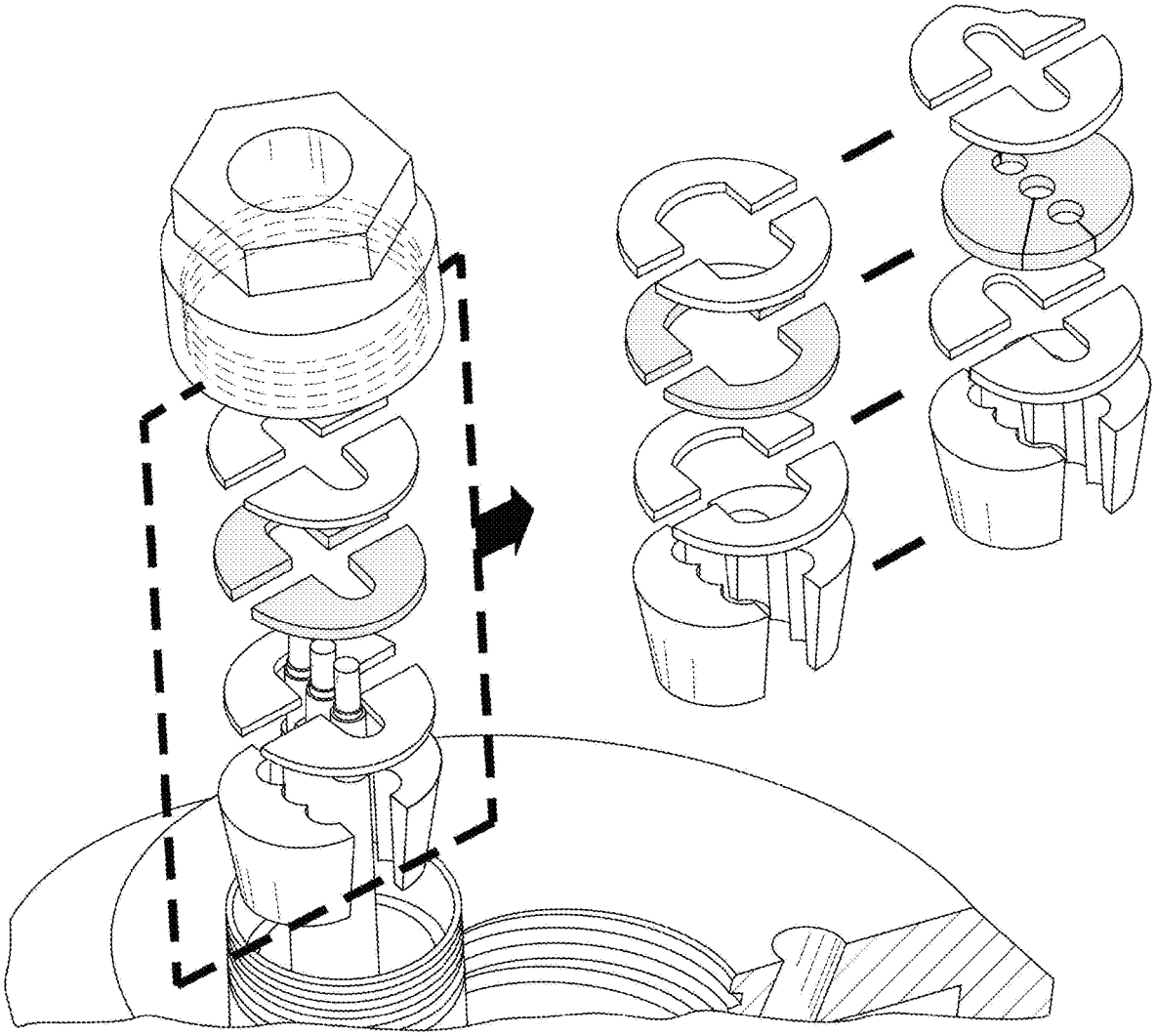
FIG. 20 is a side, perspective, partial, close-up view of the invention of FIG. 18, further illustrating alternative component pass-through configurations for the grippers, wedge lock-type seals and washers.
Figure 20A:
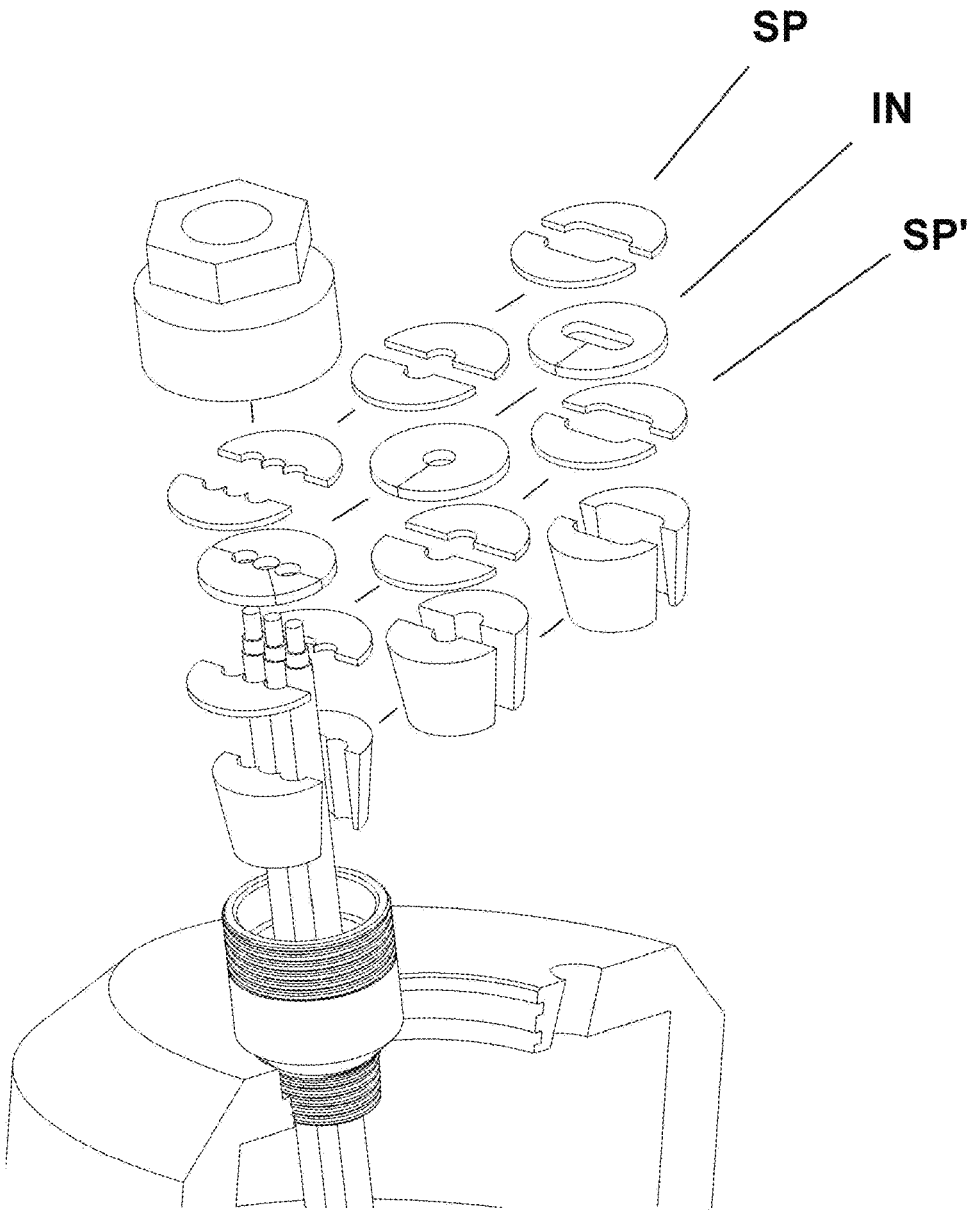
FIG. 20A is a side, perspective line drawing of the invention of FIG. 20, illustrating still other configuration grippers/seals and washers.
Figure 21:
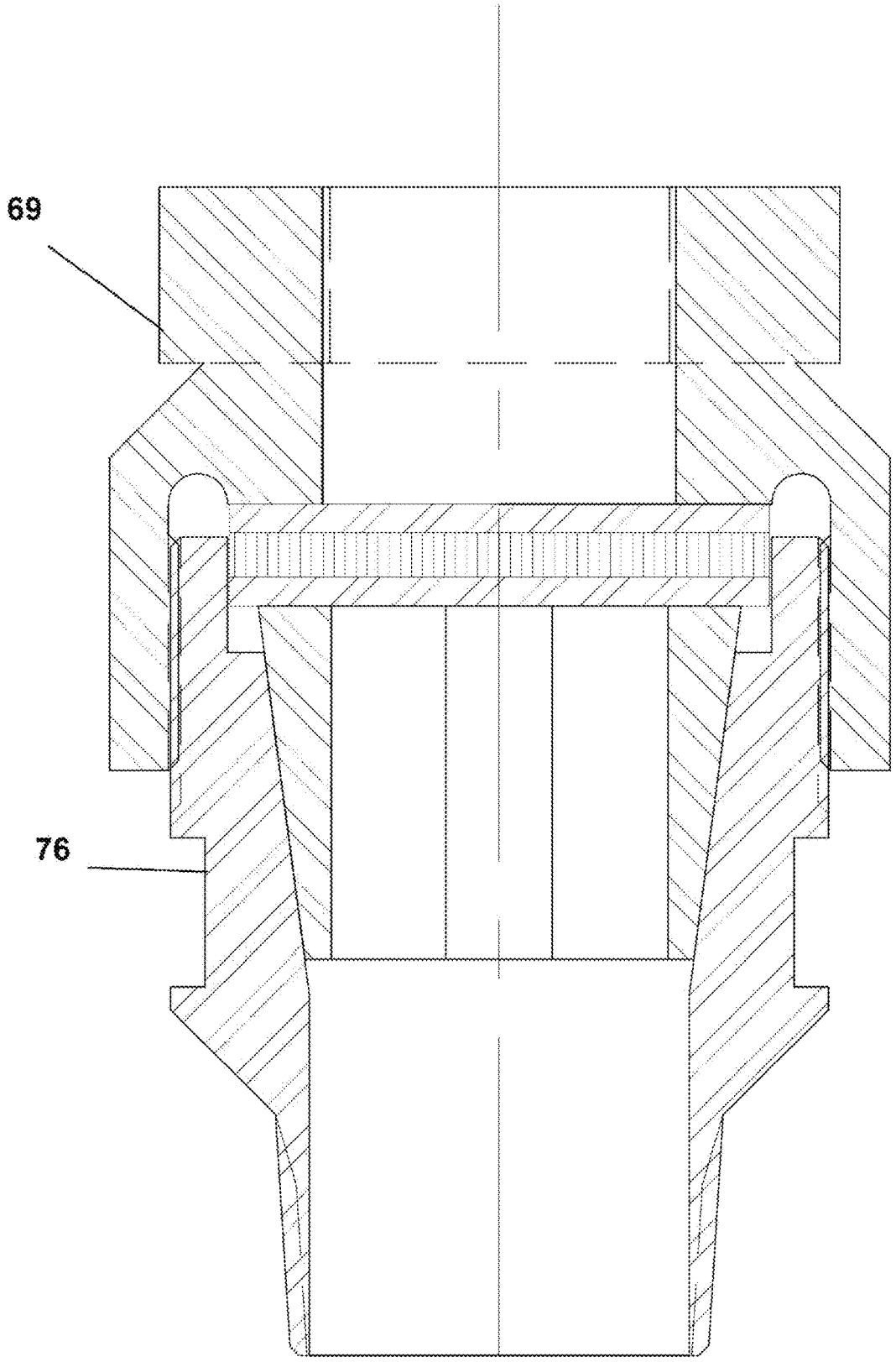
FIG. 21 is a side, cross-sectional view of the device of FIG. 20, illustrating the wedge base, cap, and overall configuration of the compression seal housing.
Figure 22:
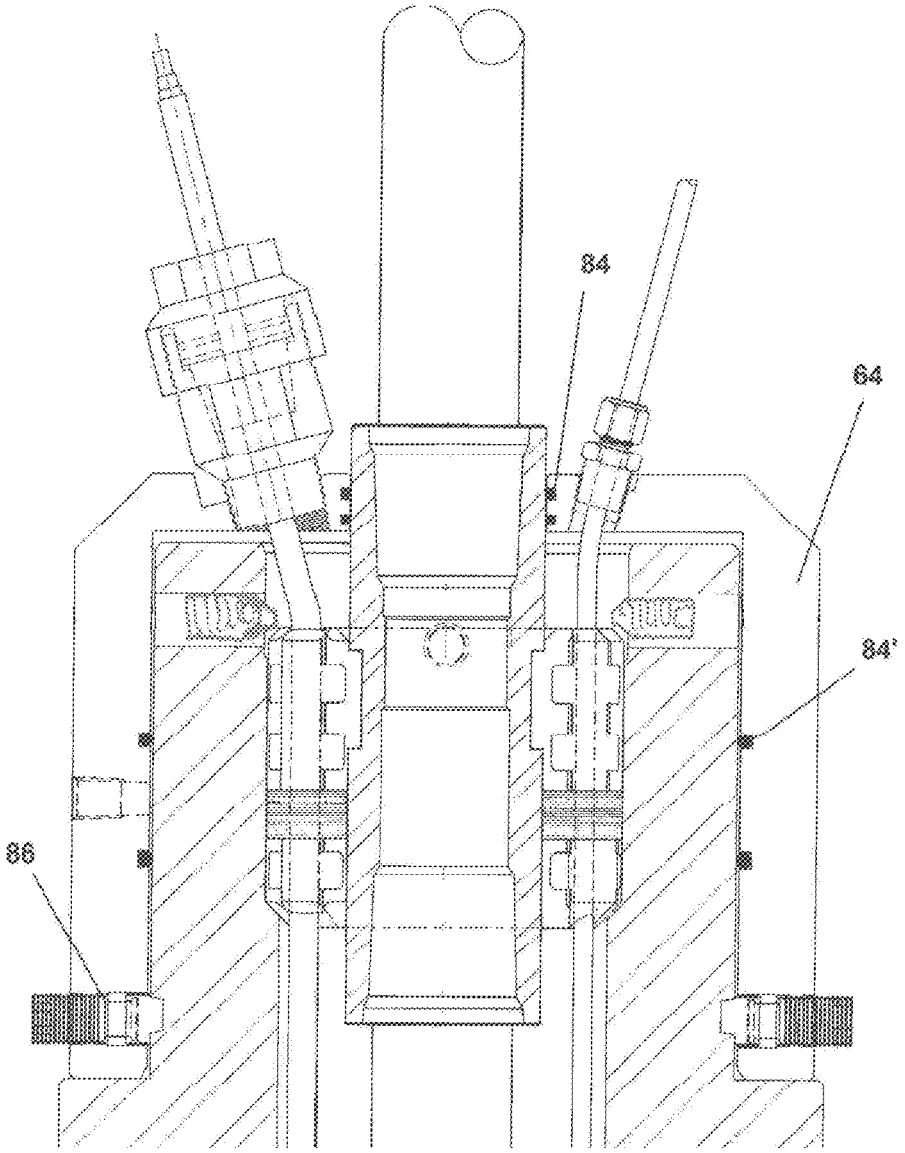
FIG. 22 is a side, partially cross-sectional view of the invention of FIG. 16, illustrating the hanger in the bowl with the weight of the string thereupon to expand the main seal to engage the bowl, coupling, ESP power line and capillary line components, sealing off the well, and the cap with compression seals thereon.
Figure 22A:
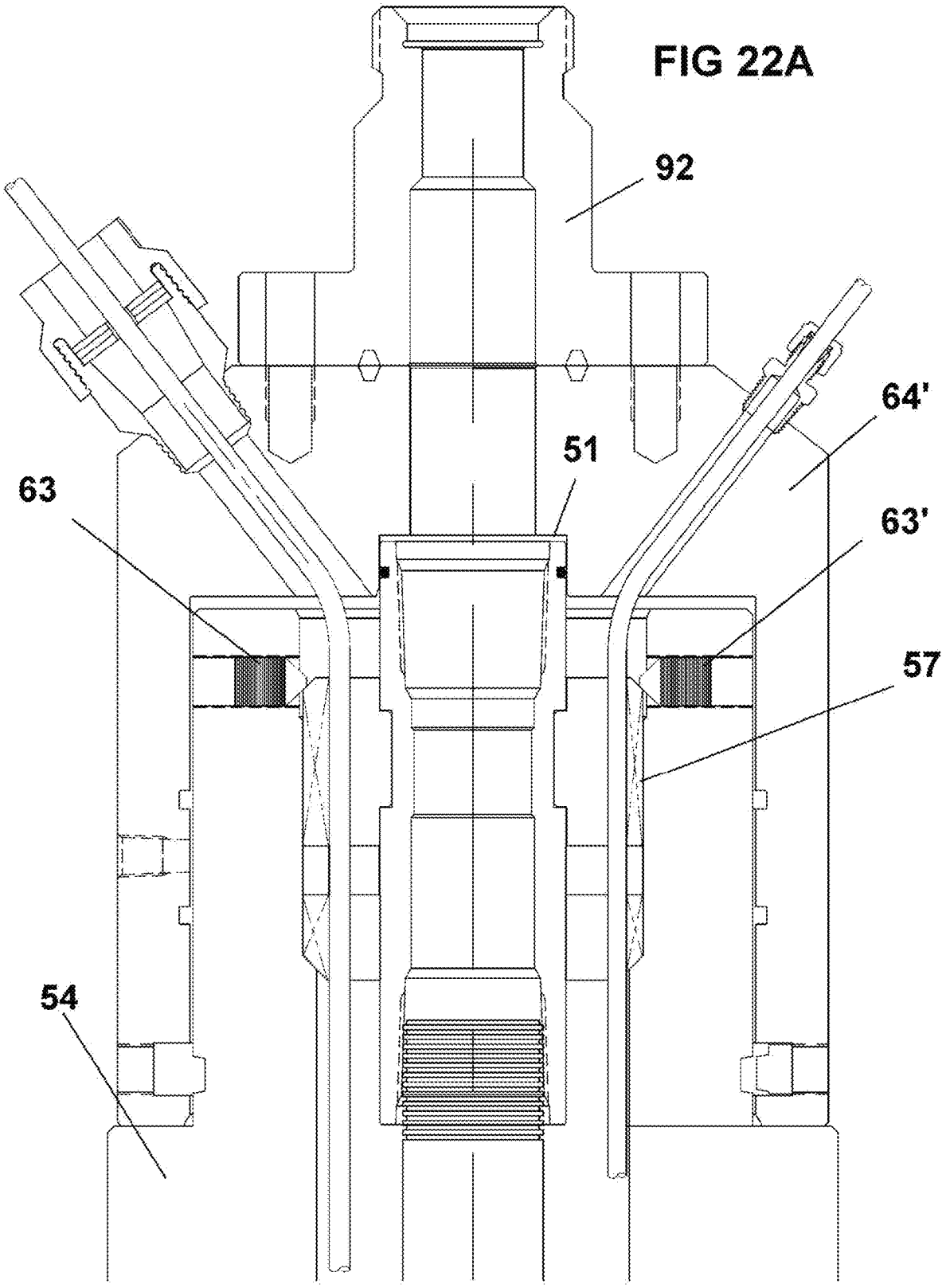
FIG. 22A is a side, partially cross-sectional, partially cut-away view of the invention of FIG. 22 mounted to a modular wellhead 54, illustrating an alternative cap 64' having a flanged mount to engage component 92.
Figure 22B:
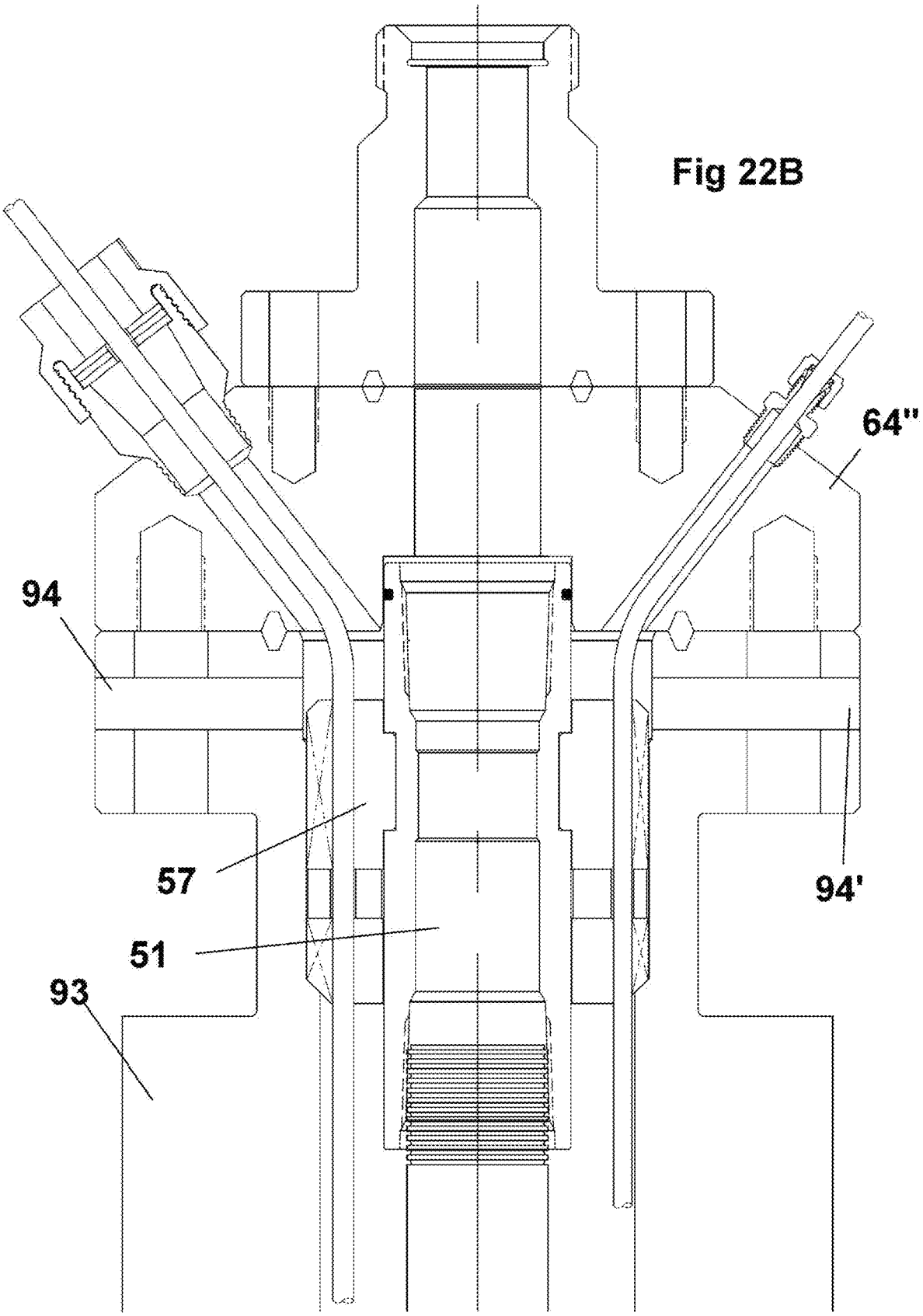
FIG. 22B is a side, partially cross-sectional, partially cut-away view of the invention of FIG. 22 mounted to the flange of a conventional tubing spool, illustrating a tubing adapter cap 64" having a top flange mount, and first 94 and second 94' locking pin passage to lock the hanger 57 in the bowl, about coupling 51.
Figure 23A:
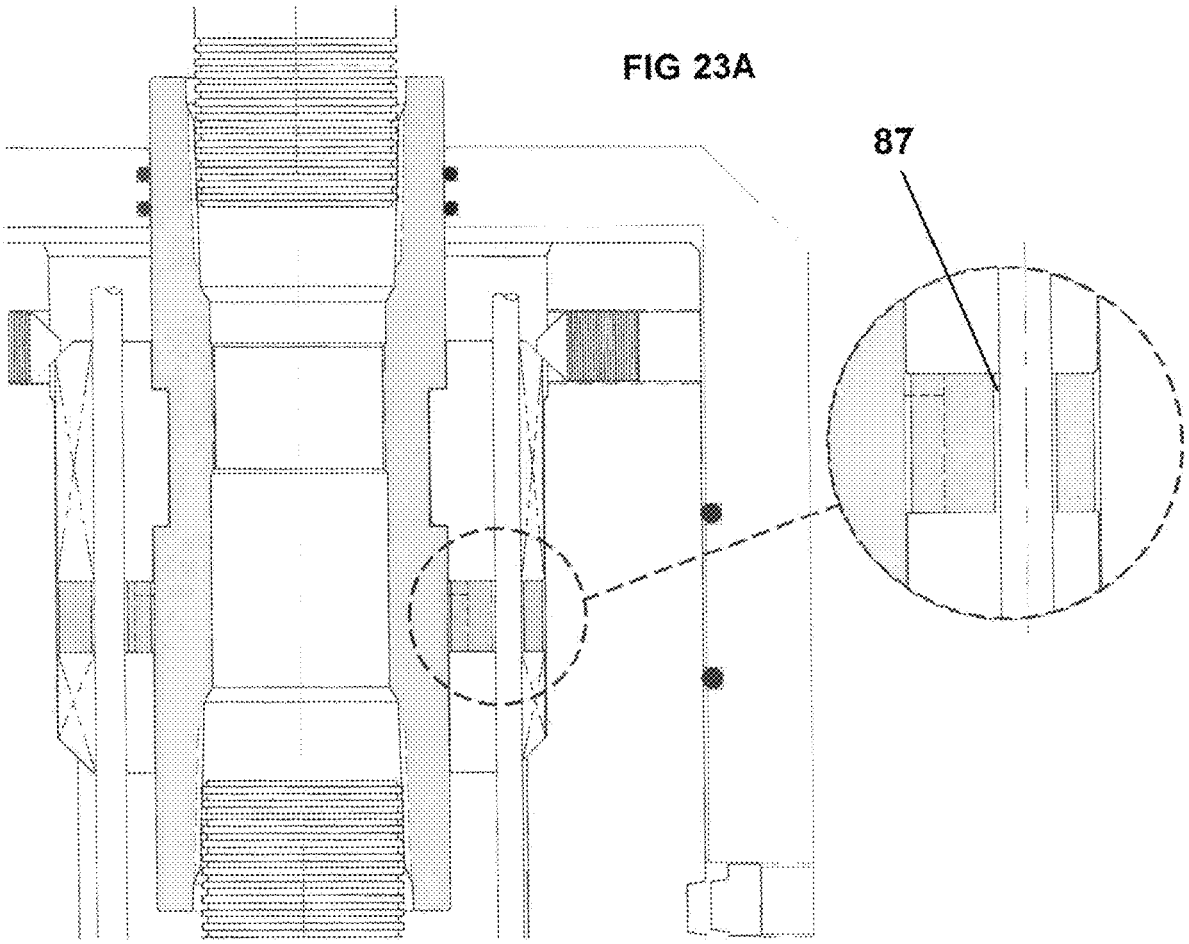
FIG. 23A is a side, partially cut-away view of the invention of FIG. 14, illustrating the hanger in the bowl but without the weight of the coupling, and the main seal 61 in an un-compressed state, and the tolerance or space 87 between the main seal and the components threaded therethrough, the coupling, and the bowl.
Figure 23B:
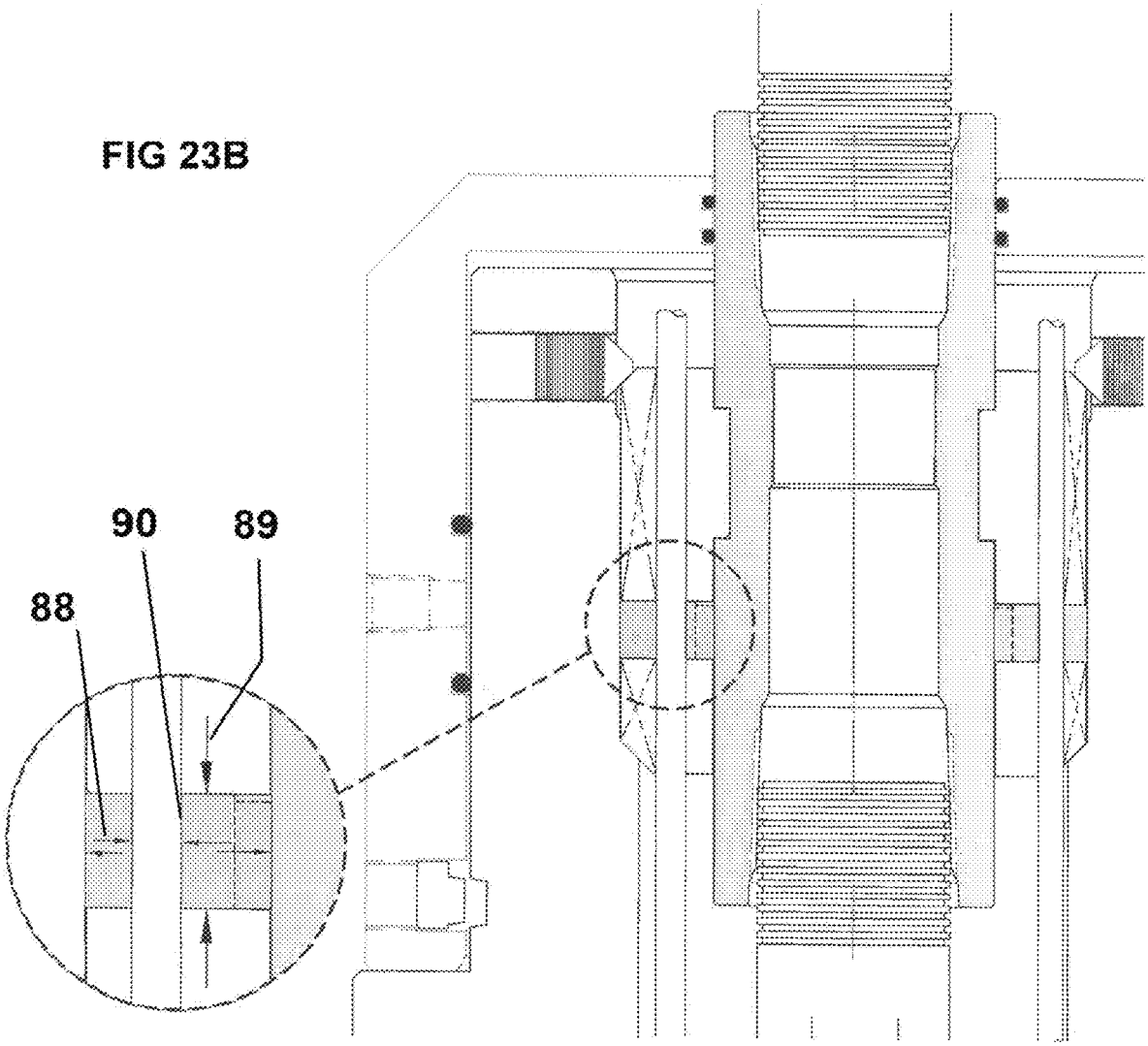
FIG. 23B is a side, partially cut-away view of the invention of FIG. 23A, but with the weight of the tubing string supported by the bowl via the hanger and coupling, illustrating the seal 61 compressed 88 by the weight 89 of the string to engage 90 and seal the components, coupling and bowl, sealing the well.

FIGS. 20 and 20A illustrate alternative insert IN and spacer SP, SP' profiles which could be suitable for use depending on the profile of the component involved.

Figure 24A:
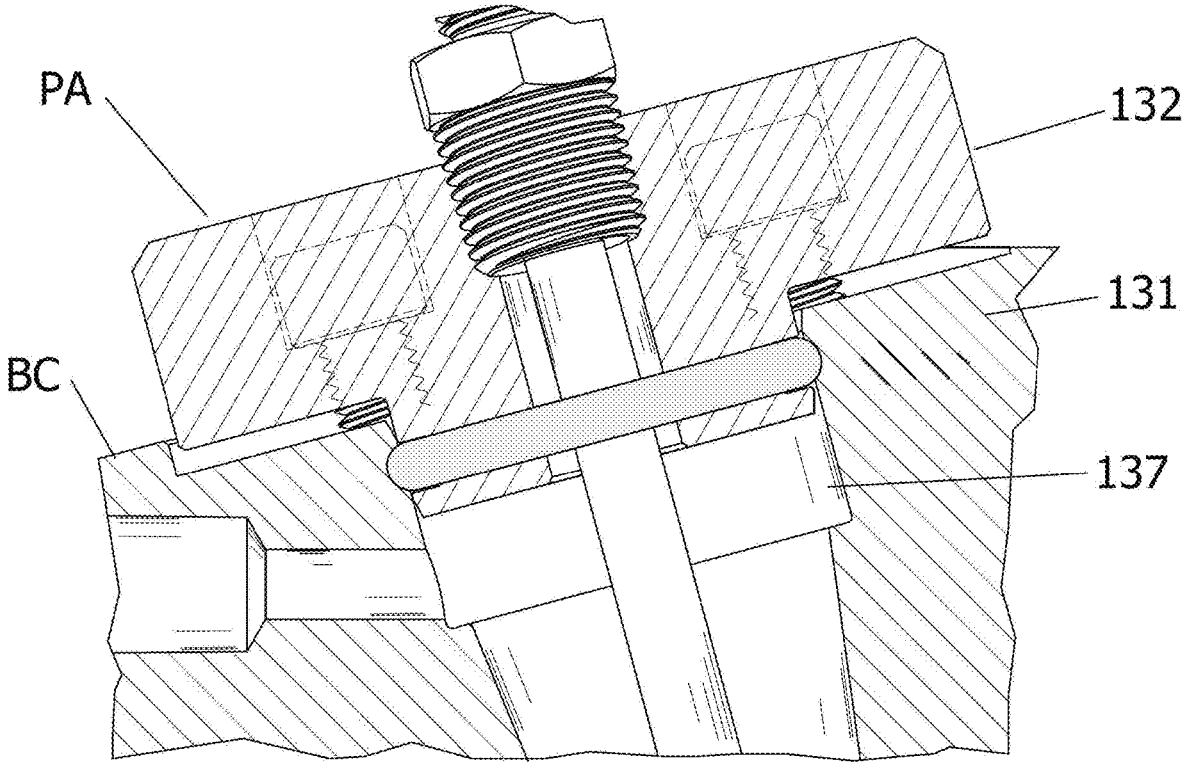
FIG. 24A is a partial, partially cut-away, partially cross-sectional view of an alternative embodiment to the bowl-cap of FIGS. 15-18 and 22, teaching a bowl cap with sealed pass-through adapter mounted thereupon, which adapter can vary in configuration to accommodate various compression fittings and the like for pass-through of a component therethrough.
Figure 24B:
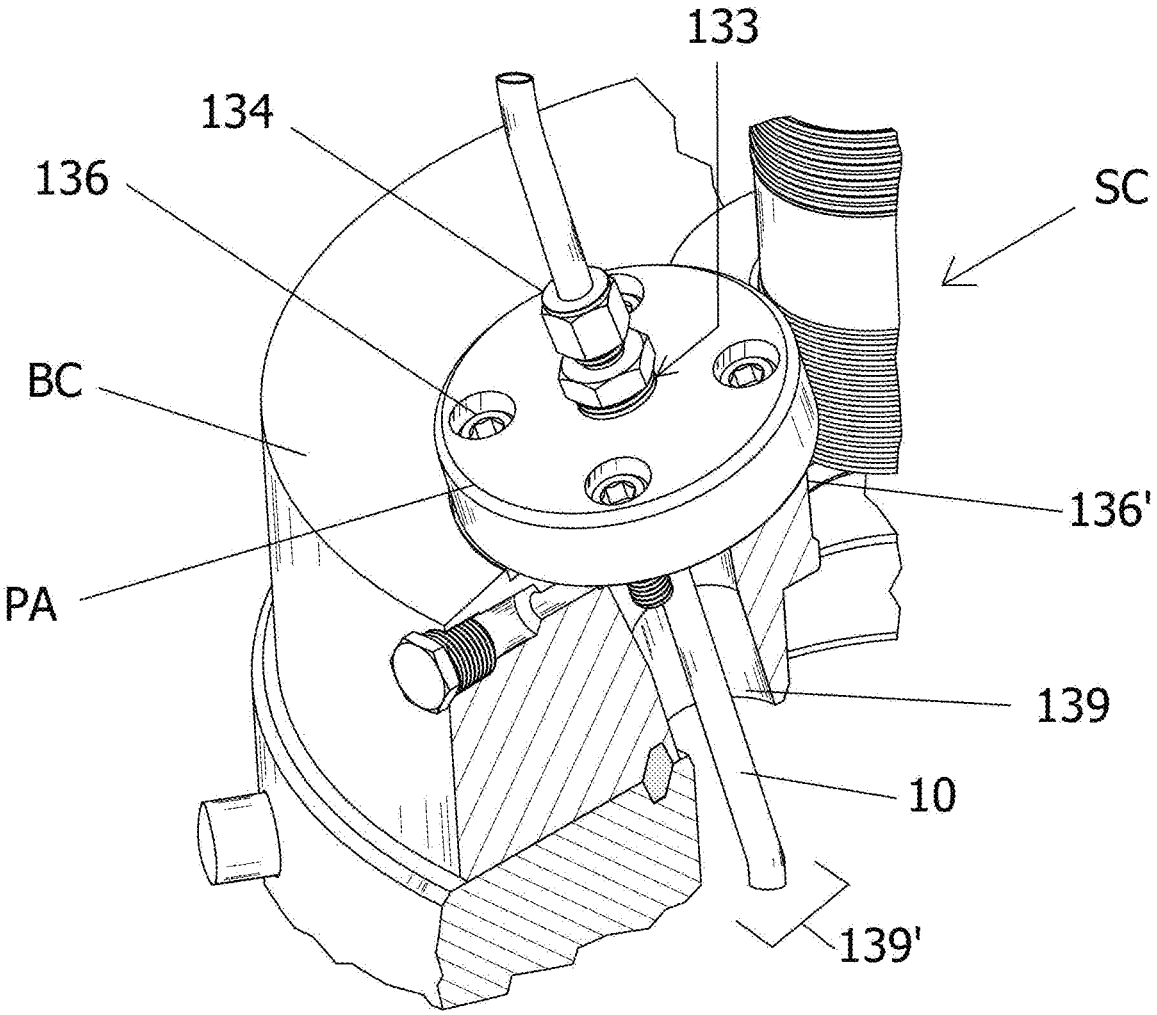
FIG. 24B is a perspective, partial, partially cross-sectional, partially cut-away view of the invention of FIG. 24A, with a compression fitting mounted to the pass-through adapter, the compression fitting engaging and providing sealed pass-through for a capillary line 10.
Figure 24C:
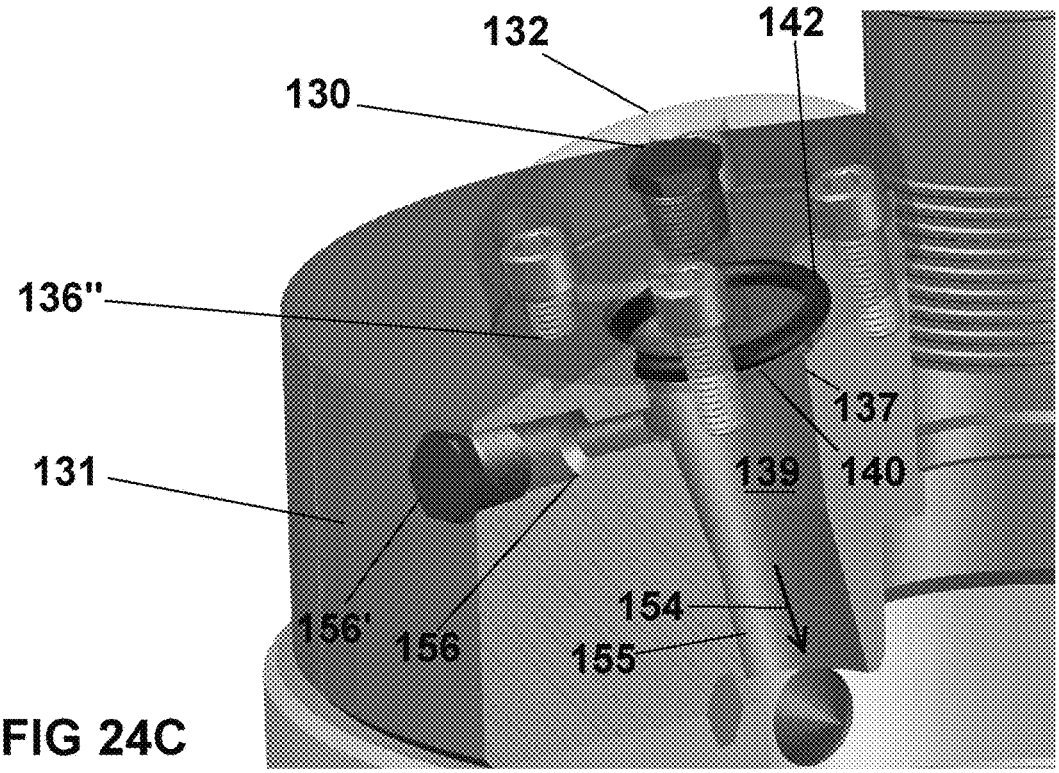
FIG. 24C is a perspective, partially cross-sectional, partially cut-away view of the present invention of FIG. 24A showing the pass-through in phantom, with a plug mounted thereon to seal the system with no pass-through shown.
Figure 24D:
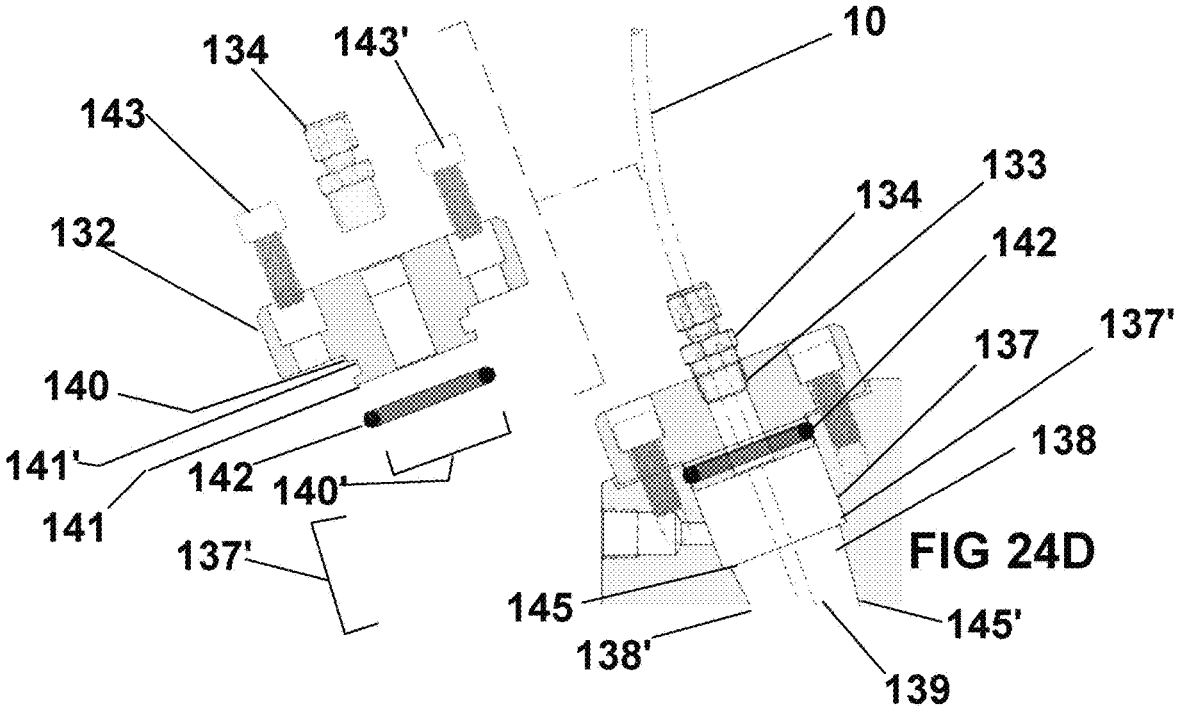

FIGS. 24A-24E illustrate an alternative embodiment of the bowl cap pass-through system of the present invention. Instead of having the compression fitting(s) mounted directly to the wellhead surface component enclosing the wellhead (i.e, a bowl cap for pass-through via threaded passages formed in the top of the bowl cap) as contemplated in the above discussed embodiment of FIGS. 15-24, the alternative embodiment bowl cap BC of FIGS. 24A-24E utilizes a pass-through adapter PA mounted to the bowl cap 131, which adapter PA2 is formed to receive or form part of a compression fitting (for example compression fitting 134 in FIG. 24B, but can vary depending on the configuration) for the desired component (as shown in FIGS. 24A, 24B, and 24D, capillary line 10), which component sealingly passes therethrough, providing sealed pass-through for said component through the wellhead. The component passing through the adapter would then typically pass through an underlying hanger of the present invention in the bowl as discussed in the earlier disclosure of the invention supra, then into the annulus and down the well. The bowl cap with adapter thereby forms a surface component SC functioning as a wellhead cover in the form of a bowl cap with adapter having sealed pass through capability.

The adapter PA, although varying in pass-through capability (via different configuration connectors/passages therethrough, depending on the component and associated compression fitting or the like) preferably has the same or relatively similar overall footprint with the same fastener passage layout 136 aligned with threaded fastener passages 136', 136" formed on the bowl BC for receiving bolts 143, 143'. Further, the surface component (in this case, a bowl cap) can be configured to have two or more mounting areas to receive pass-through adapters, allowing a user to easily provide a customized pass-through of the bowl cap to provide sealed pass-through of multiple diverse components into the bowl cap and ultimately to and down the annulus as required.

Referring to FIGS. 24A-24D, the bowl cap BC of the present invention is formed to receive and sealingly engage one or more pass-through adapters PA, which again, can vary in configuration to facilitate engagement with various compression fitting configurations to facilitate the sealed pass-through of various components therethrough. The component, whether it be a cable, line, tube, etc could then run to the pass-through hanger of the present invention, where said component passes through the side doors and seal of the hanger, so as to provide sealed and secure pass-through from outside the wellhead to the annulus of the well which is readily reconfigurable to support changes in the production and operation of the well over is operating life.

Continuing with the figures, bowl cap BC is shown having mounted thereto a first embodiment pass-through adapter 132 having a single, centralized threaded bore 133, with passage 133' therethrough, the threaded bore 133 formed to receive a compression fitting 134 or the like for engaging and providing sealed pass through of capillary line 10 or the like. Alternatively, a plug 130 can be used to seal the bore when the capillary line 10 is removed or the pass through feature of this adapter 132 is not required.

Threaded bore 133 is formed in bowl cap BC so as to provide threaded engagement as well as to provide passage leading to socket 137, said socket 137 shown having a uniform ID and providing passage leading to compression receiver 139 having an ID 139' decreasing from wider to narrower, from the end 145 nearest threaded bore 133, to the other end 145'. The compression receiver 139 in addition to facilitating compression of insert(s)/wedges to provide a seal (as will be further discussed infra), it also provides passage 155 through 154 the top 135' of the bowl cap, allowing access to the underlying bowl or well, depending on the configuration.

In the bowl cap of the present embodiment of FIG. 24D, the socket 137 has a depth 137' and ID 137" underlying the adapter 132. The socket 137 not only receives the component therethrough, it is also used to facilitate a seal via pass through adapter 132, which has a sleeve 140 emanating from the underside or second side 135" of adapter 132, the sleeve having an end 141 having o-ring support 141', allowing o-ring 142 to seal the clearance between the OD 140' of sleeve 140 and ID 137" of socket 137, which, in conjunction with the compression fitting 134 or plug 130 mounted thereto, seals the bowl cap, while allowing the sealed pass-through of the component therethrough.

FIG. 24B illustrates compression fitting 134 mounted to the first embodiment of the pass-through adapter 132, the compression fitting 134 engaging and providing sealed pass-through for a capillary line 10.

FIG. 24C shows the first embodiment of the pass-through adapter 132 in phantom, with a plug 134 mounted thereon to seal the system with sealed, no pass-through shown. A side port 156 (with plug 156' shown) is provided for providing an alternative passage.

FIG. 24D shows the components of the first embodiment of the pass through adapter 132 in exploded view as well as mounted to the bowl cap, with compression fitting 134 engaging a capillary tube 10 or the like for sealed pass-through.

Figure 24E:
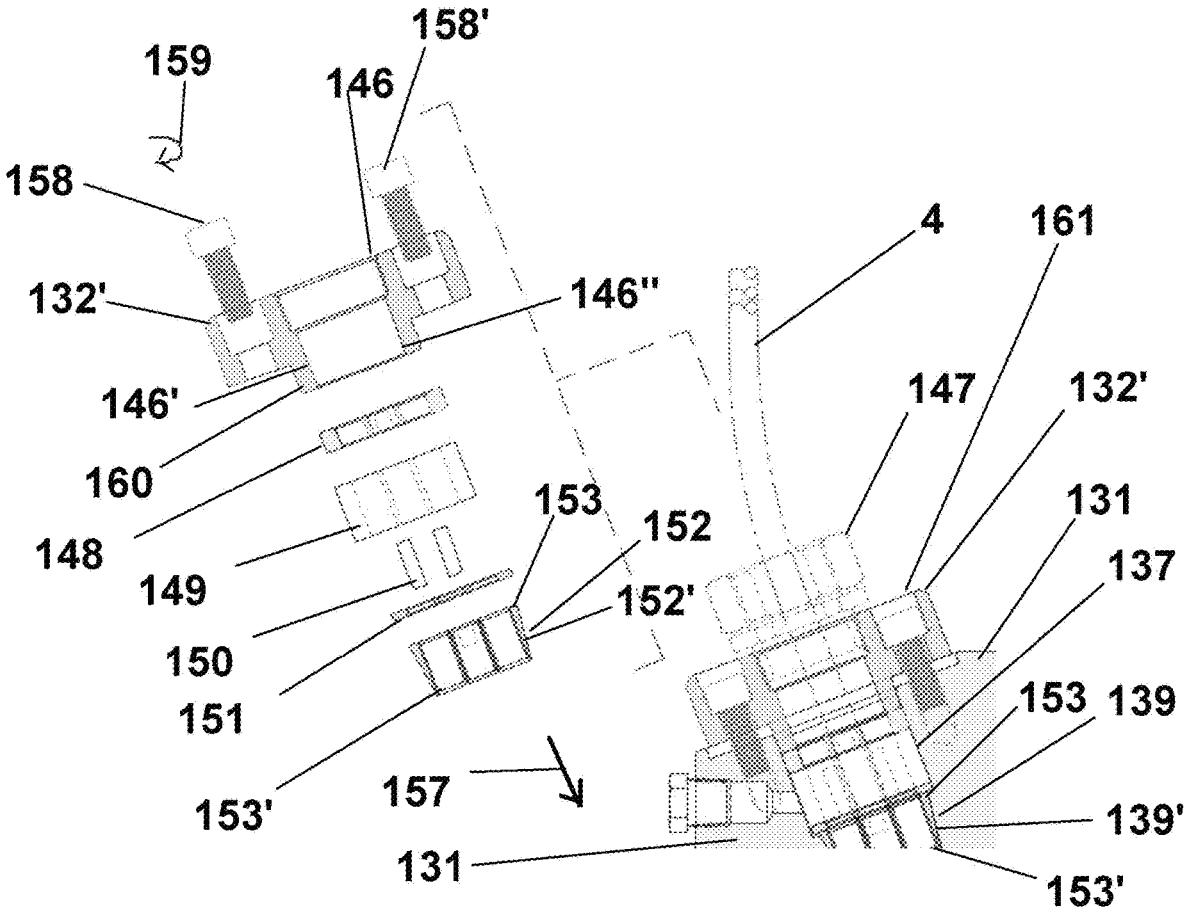
FIG. 24E is a side, partially exploded, partially cut-away, partially cross-sectional view of the invention of FIG. 24A, showing the components of the adapter in exploded view as well as mounted to the bowl cap, with compression fitting, inserts and seals engaging a multi-conductor cable such as an ESP power cable 4 or the like, providing sealed pass-through of same.

FIG. 24E is a side, partially exploded, partially cut-away, partially cross-sectional view of the alternative embodiment of the bowl cap 131 of FIG. 24A, further illustrating a second embodiment of the pass through adapter 132', this one having a different configured central passage for providing sealed pass-through to a component comprising multiple cables (a three conductor ESP power cable 4 is illustrated), the pass through adapter 132', also shown in exploded view, is mounted 161 to the bowl cap 131 as discussed in the previous embodiment, but with components provided to facilitate a compression seal via compression socket 139', as well as inserts and seals to provide a sealed pass-through of same.

As shown, the three conductor power cable 4 passes through conduit connector 147 (i.e., 1.5" threadingly engaging centralized threaded bore 146, providing passage 146' to bowl cap, the passage having an ID (for example, 1.5").

The cable then passes into socket 137 formed in bowl cap 131 where it engages upper conduit compression flange 148, then seal element 149, and compression limiters 150, and lower split backup plate 151. Next is split wedge 152 having an OD 152', the split wedge formed to engage power cable 4 in the compression receiver, and compression is applied by tightening 159 fasteners 158, 158' which provides force 157 via sleeve 160 of pass through adapter 132 applying pressure via socket 137 to stacked elements 148-151, respectively, to urge split wedge 152 into compression receiver 139, providing compression against power cable 4 (or any other component passing through), providing sealed pass-through of same through the bowl cap. The power cable 4 having sealingly passed through bowl cap 131, can then be threaded through the pass-through hanger(s) as previously discussed, which include reconfigurable inserts associated with the side doors, body, and mail seal of the unit to accommodate the component passing therethrough.

Other surface components besides the bowl cap discussed above may incorporate the teachings of the present invention to seal the annulus of the well while providing sealed pass-through of desired components. Referring to FIGS. 25A-25F, a tubing head adapter 162 can likewise be formed to receive a sealed pass-through adapter mounted thereupon, which adapter can vary in configuration to accommodate various compression fittings and the like for sealed pass-through of various component(s) therethrough. As shown, a split flange 163, 163' is provided shown for mounting the present tubing head adapter 162 to a wellhead, sealing off same, while allowing the tubing head adapter to swivel axially upon the wellhead as required for alignment.

Figure 25A:
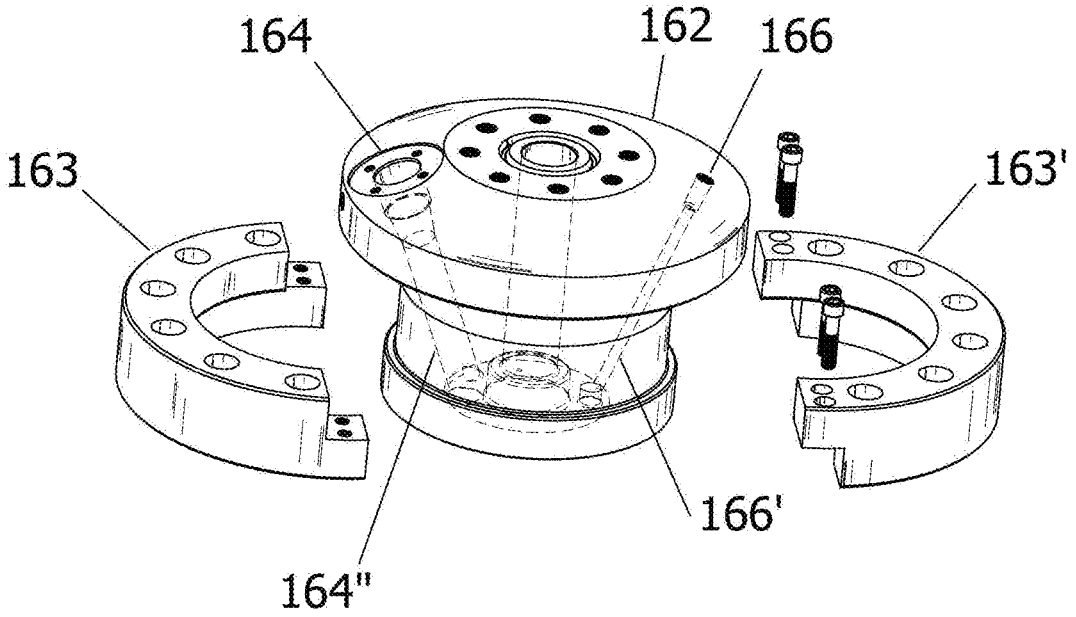
FIG. 25A is a side, perspective, partially cut-away, partially phantom view of an alternative surface component to the bowl-cap of FIGS. 15-18, 22, and 24A-E, comprising a tubing head adapter 162 formed to receive a sealed pass-through adapter mounted thereupon, which adapter can vary in configuration to accommodate various compression fittings and the like for sealed pass-through of various component(s) therethrough. A split, swivel flange 163 is also shown for mounting the present tubing head adapter 162 to a wellhead, sealing off same.
Figure 25B:
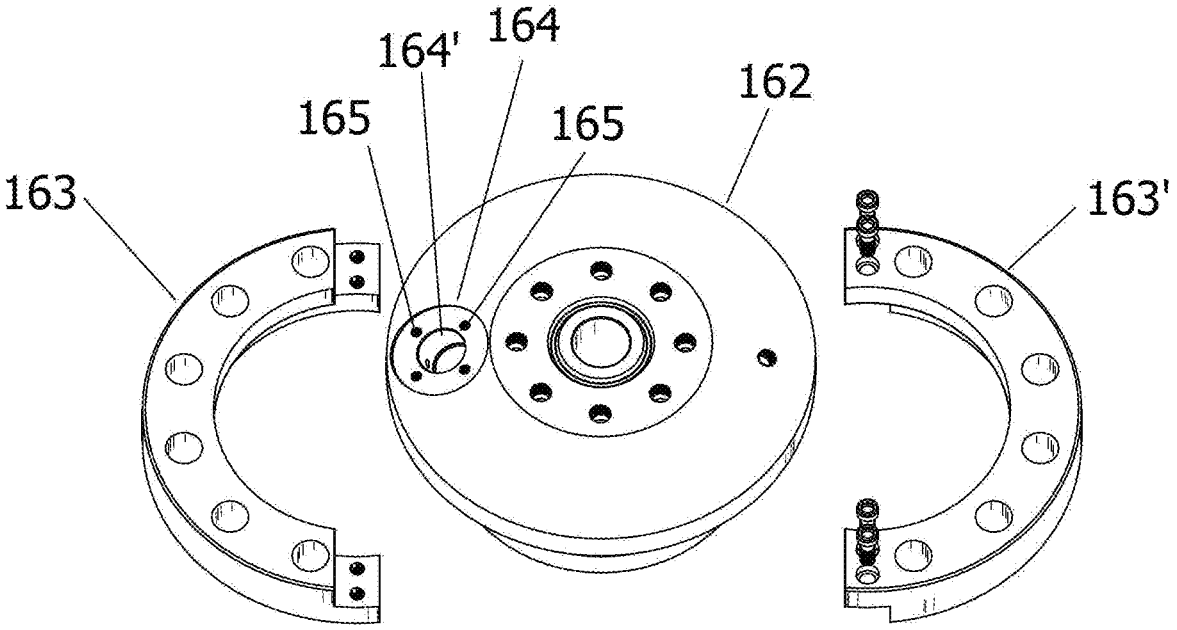
FIG. 25B is a perspective, top view of the invention of FIG. 25A, illustrating the adapter mounting area 164 formed on the tubing head adapter 162 with split, swivel flange 163, 163' for mounting the unit to the wellhead flange (not shown).
Figure 25C:
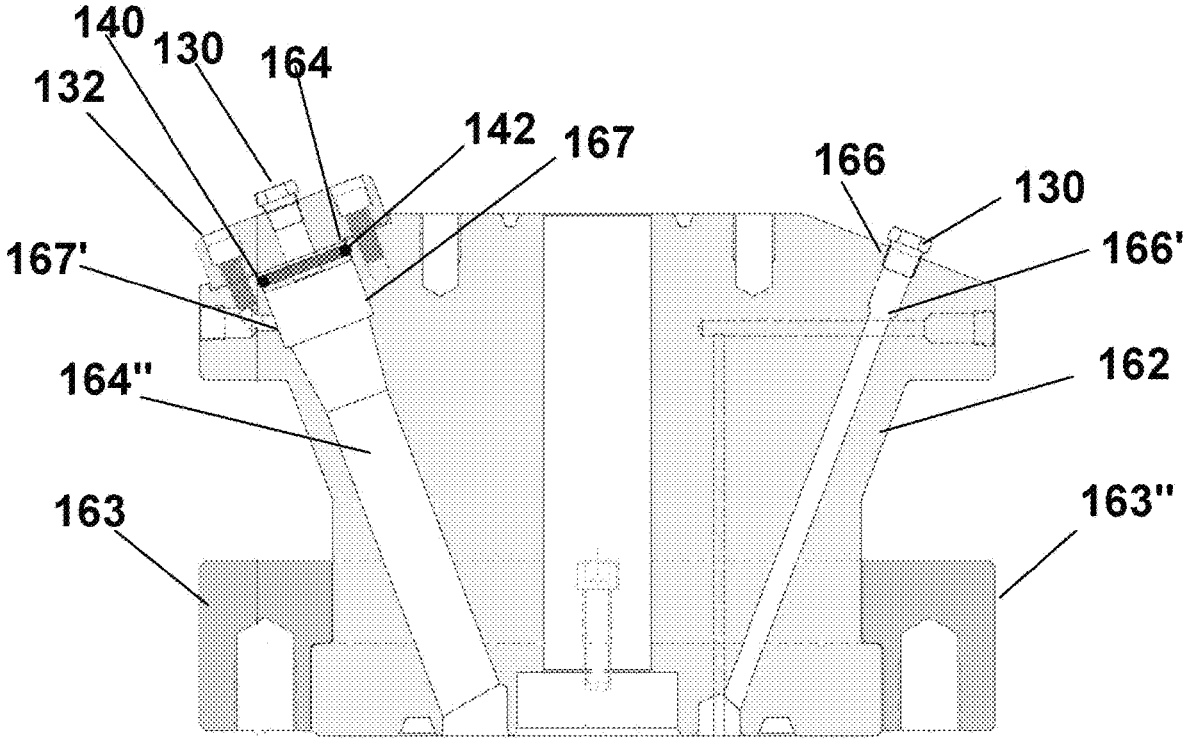
FIG. 25C is a side, partially cut-away, partially cross-sectional view of the invention of FIG. 25B showing the pass-through adapter 132 (having plug 130 situated therein, to seal the system with no pass-through shown. Also shown is the centralized passage underlying the pass-through adapter with collar and O-ring seal, as will be more fully discussed herein.

Referring to FIGS. 25A-C an adapter mounting area 164 is formed on tubing head adapter 162 with centralized port 164' leading to passage 164" through the tubing head adapter, the passage leading to the annulus of the well. Further provided at adapter mounting area 164 are threaded apertures 165, 165" for fastening the pass-through adapter 132 thereto (FIG. 25C showing the pass-through adapter 132 having plug 130 situated therein, to seal the system with no pass-through).

Figure 25D:
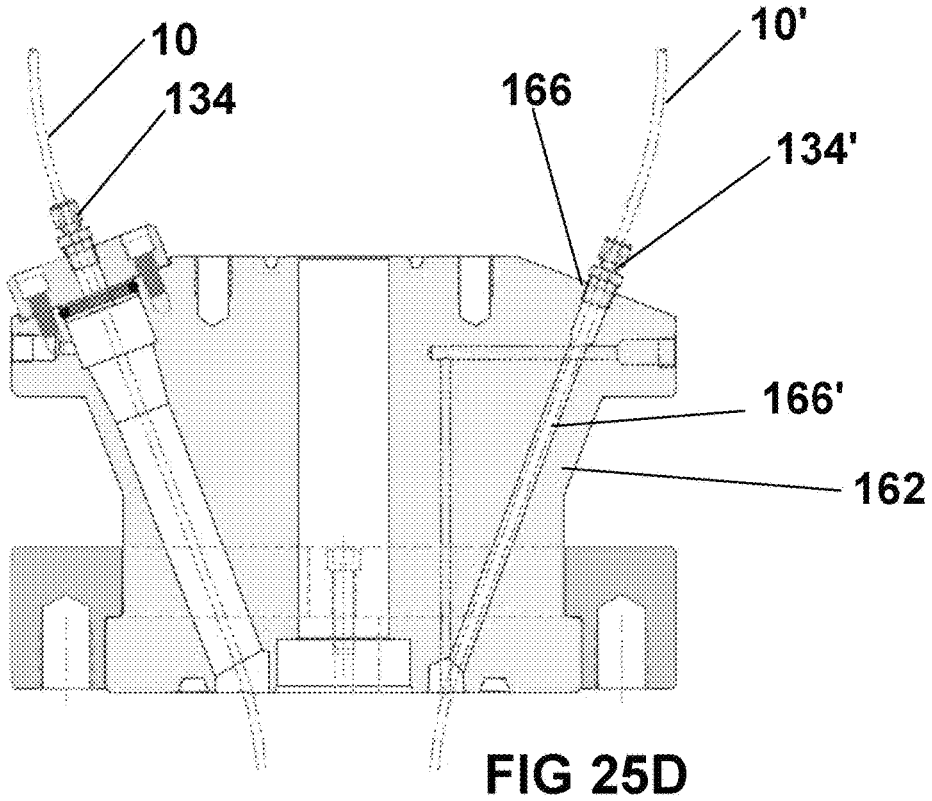
FIG. 25D is a side, partially cut-away, partially cross-sectional view of the invention of FIG. 25C, showing a compression fitting 134, 134' mounted thereto, said compression fittings providing sealed pass-through of capillary tube 10, 10' or the like for sealed pass-through, respectively.
Figure 25E:
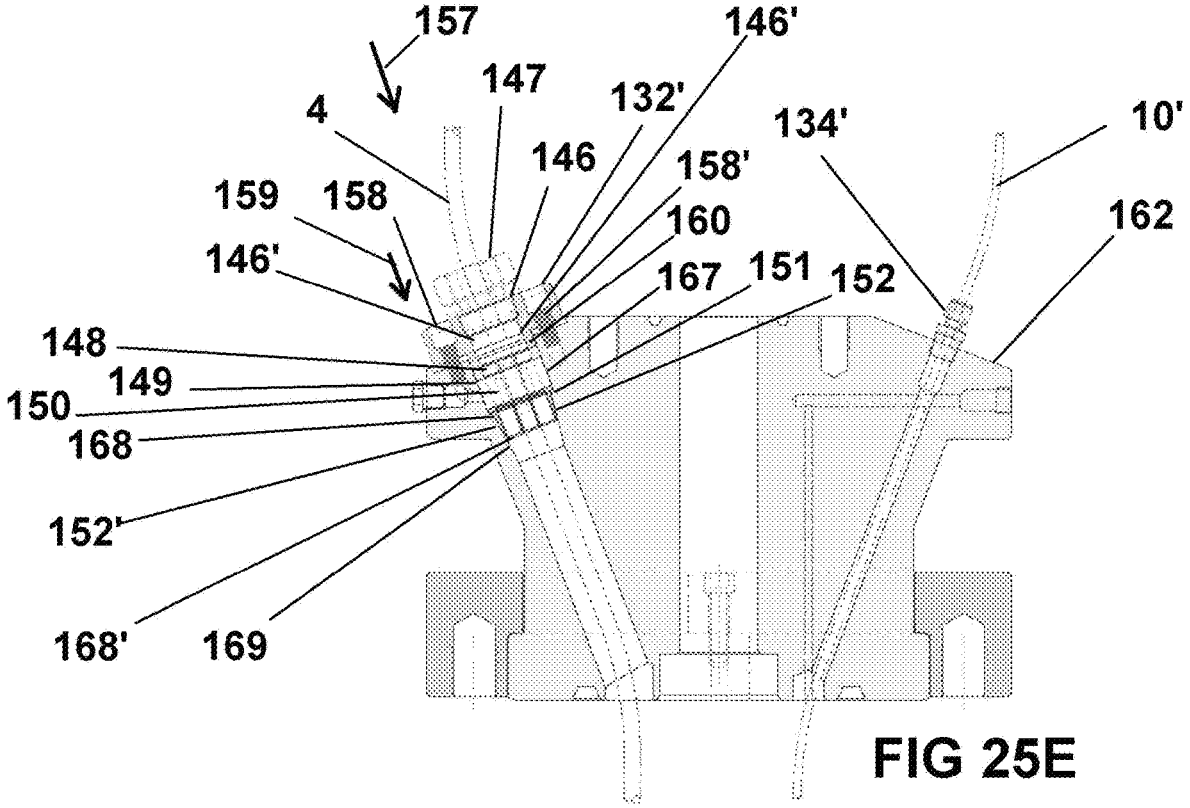
Figure 25F:
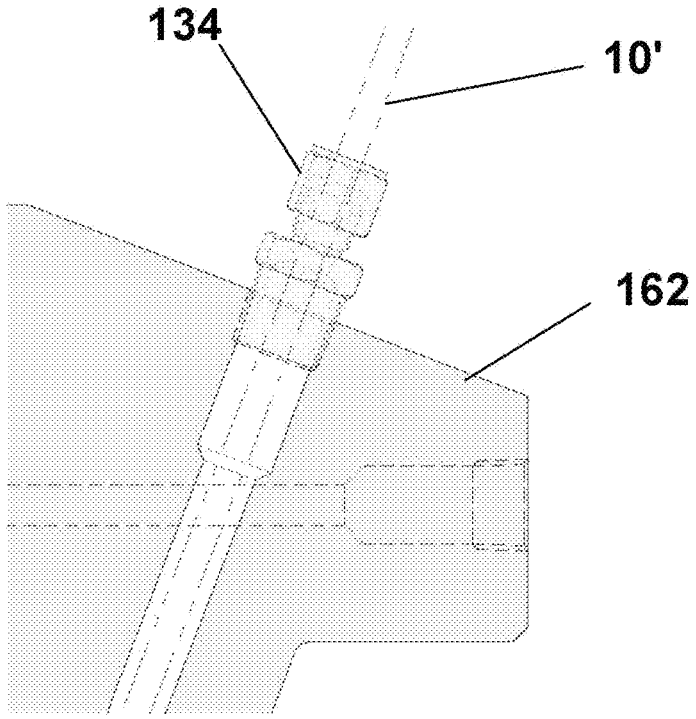
FIG. 25F is a side, partial, close-up, partially cut-away, partially cross-sectional view of the invention of FIG. 25E, showing a close up of compression fitting 134' mounted to threaded port 166, leading to passage 166', providing sealed passage through tubing head adapter 162 into well.

Referring to FIGS. 25C-D and 25F, compression fitting 134 may be mounted to pass-through adapter 132 for sealed pass through of capillary tube 10 therethrough, which passes through centralized port 164' formed in tubing head adapter to passage 164". As shown, passage 164" is formed to provide a socket 167 having ID 167', the socket underlying the pass through adapter 132 as discussed in the bowl cap embodiment, so as to facilitate a seal via O-ring 142 mounted to pass-through adapter sleeve 140, while allowing capillary tube 10 to pass through the tubing head adapter via passage 164" into the well.

It is noted that the surface component (whether it be a bowl cap, tubing head adapter as in the present case or another means of sealing the wellhead) may include one or more such pass-through adapters mounted thereto, the configuration and amount of which depending on the amount of components which must pass through in sealed fashion. Alternatively, a combination of pass-through adapters and simple passageways with threaded opening may be provided. For example, threaded port 166 may be provided on the surface component to facilitate the mounting of, for example, compression fitting 134' to provide sealed passage of capillary line 10' therethrough, the port leading to passage 166' through the surface component (in this case tubing head adapter 162)

FIG. 25E is a side, partially cut-away, partially cross-sectional view of the pass-through adapter 132' of FIG. 24E mounted to the tubing head adapter 162 of FIGS. 25A-25C, with a conduit connector 147 mounted to said pass-through adapter 132', and underlying compression seal comprising inserts and seals within the centralized passage formed in the tubing head adapter 162 as discussed herein to facilitate the sealed pass-through of a multi-conductor cable such as an ESP power cable 4 or the like via seal via compression socket or receiver 169, as will be more fully described infra.

As shown, the three-conductor power cable 4 passes through conduit connector 147 (i.e., 1.5" threadingly engaging centralized threaded bore 146, providing passage 146' to bowl cap, the passage having an ID 146' (for example, 1.5"). The cable 4 then passes into socket 177 formed in tubing head adapter 162 where it engages upper conduit compression flange 148, then seal element 149, and compression limiters 150 (in phantom), and lower split backup plate 151. Next is split wedge 152 having a generally frustoconical shape having an OD 152' engaging the tapering (from wide 168 to narrow 168') ID 169' of compression receiver 169, said split wedge 152 having a passage formed therethrough to engage power cable 4 in the compression receiver to as to provide a compressive seal against same, with compression applied by tightening 159 fasteners 158, 158' which provides force 157 via sleeve 160 of pass through adapter 132 applying pressure via socket 167 to stacked elements 148-151 (described above), respectively, to urge split wedge 152 into compression receiver 139, providing compression against power cable 4 (or any other component passing through), with the OD of split wedge engaging the ID of compression receiver 159, so as to provide sealed pass-through of the component (in this case cable 4) through the tubing head adapter 162. The power cable 4 having sealingly passed through tubing head adapter, it can then be threaded through any pass-through hanger (and/or other pass-through device including but not limited to a packer or the like) following the tubing head adapter (or other surface component having the aforementioned feature) as previously discussed, which pass through device can include reconfigurable inserts associated with the side doors, body, and mail seal of the unit to accommodate the component passing therethrough.

FIG. 25F is a side, partial, close-up, partially cut-away, partially cross-sectional view of the invention of FIG. 25E, showing a close up of compression fitting 134' mounted to threaded port 166, leading to passage 166', providing sealed passage through tubing head adapter 162 into well.

The present system therefore provides a useful, new, unique, effective and innovative system to reconfigure a sealed wellhead for changes in operation or production in a well, when a surface component such as a bowl cap or tubing head adapter is used to seal a wellhead, in conjunction the pass-through hanger (or packer or the like), comprising the following steps, for example:

1) mounting one or more of the pass-through adapter(s) to a surface component engaging a wellhead (i.e., bowl cap, tubing head adapter, etc), the pass-through adapter selected from a group of adapter's having different pass-through configurations formed to engage and receive therethrough, in sealed fashion, one or more component(s) therethrough;

2) configuring said pass-through adapter(s) with sealing apparatus formed to effect a seal in the component(s) passing therethrough;

3) if threading said component to a hanger, providing a hanger having pass-through capability via side doors, and mounting inserts to the body and inner side doors of said hanger, said inserts having a configuration formed to engage and grip, and/or seal said component(s) passing therethrough, or provide a seal if no component(s) where no component is used;

4) selecting and mounting a main seal in said hanger, said main seal having passage(s) having a profile formed to receive said component(s) therethrough, said passage(s) situated alignment with said inserts mounted in step 3, above, said passage(s) formed in said main seal aligned to receive said component(s) passing therethrough;

5) positioning said component(s) to pass through said pass-through adapter(s), gripping and/or sealing inserts, and main seal; while 6) using said sealing apparatus to effect a seal of said component(s) at said pass-through adapter(s); while 7) using said inserts to grip said component(s) at said side doors and/or seal same; while 8) compressing said main seal to effect a seal of said component(s) at said main seal.

Where no surface component is used to seal the wellhead, such as temporary ESP installation, the method may comprise the steps of, for example:

a) providing a hanger having a main seal;

b) mounting said hanger to a tubing string;

c) threading said component through a passage formed in said main seal, said passage having a profile formed to slidingly receive said component therethrough and engage the sidewalls thereof;

d) using side doors, removeable plates or the like associated with said hanger having gripping associated therewith to engage said component(s), griping same, while using said hanger to support the weight of a tubing string in said wellhead to compress said main seal, providing a compressed main seal; and e) utilizing said compressed main seal to seal said wellhead.

Further, as discussed, said gripping surfaces associated with said hanger doors and hanger body may be interchangeable via inserts mounted to the inner wall of said doors (or integrated with the doors themselves, as well as the body of said hanger to allow easy reconfiguration of the gripping surface to accommodate various configuration components passing therethrough. Likewise, the main seal is preferably swapped out or otherwise reconfigured to provide various profile pass-through passages to accommodate changes in the configuration of the component passing therethrough.

Finally, the side door/main seal pass-through features of the present invention is in no way intended to be limited to hangers, but may be likewise incorporated into other equipment where pass-through is desired, such as packers, tubing head caps or the like.

ELEMENTS OF THE INVENTION

A Pass-Through area
D Downhole pass-through apparatus
BC Alternative bowl cap with adapter
PA Pass through Adapter
SC Surface component
B Hanger Body
P, P' insert gripping profiles
S, S' insert seal
C Component
E Expand
L, L' load bearing shoulder
1 wrap-around Hanger
2 Tubing
3 Collar
4 Power Cable (ESP Conduit)
5 Wellhead
6 tubing head
7 bowl
8 ESP Pump
9 Casing
10, ' capillary line
11' protective jacket, insulated wires
12 hinged
13, ' first, second hanger sections
14, ' upper, lower hanger body
seal
16 pin
17, ' hinge buckles
18, ' bolt
19 OD
20 ID
21 receiver
22, ' gripping profiles
23 pivot
24, ' open, closed
25, ' bolts
26, ' first and second side doors or gates
27, ' upper, lower ESP power cable door sections
28, ' upper, lower control line door sections
29, ' bolt
30 component slot—first side door
31 component slot—second side door
32, ' bolt passages
33, ' main seal passage
34, ' inner gripping profile inserts
35, ' inserts
latch bolt
37, ' closed
tubing string lowered
39, ' hold down pins
40, ' positioned
41, ' slits
42-49 n/a
50 second embodiment
51 completion coupling
52 tubing
53 handling pup
54 special modular tubing head
55 neck
56 tubing head bowl
57 wrap around hanger, 57A alternative for heavy strings
58, " ID of hanger
59 ridge hanger
60 completion coupling slot
61 main seal
62, ' first, second side doors
63, ' locking bolts
64 bowl cap
64' flanged top bowl cap
64" conventional tubing spool flanged wellhead cap
65 groove at the base of the neck
66 slip over
67, metal spacer
68 elastomeric/rubber seal
69 threaded compression cap
70 profile
71 component width
72, ' first, second compression fittings
73, ' height, ID
74 top
75 first, second apertures
76 housing
77 conical insert/wedge-lock seal
78 threaded area
79, ' first, second ends
80 inner walls
81 taper
82 into
83 frustoconical form
84 gasket
85 threads
86 bolts
87 space
88 engage
89 weight, compress
90 seal
91, ', ", '" main seal compression limiters
92 flanged component
93 conventional wellhead
94, ' locking pin passage
95 compression limiter passage
96, 96', " threaded fastener

97, ', " insert receiver slot
98 door insert
99, ' downward pressure, outward
100, ', " component seal passages
101, 101' seal slit
102, ' inserts for single component
103, 103', 103" ESP, Gas, Rod lift Seal Configurations
104, 104', 104" ESP, Gas, Rod lift coupling configurations
105, ' Backpressure valve, thread and seal arrangement
106 coupling bore
110 Packer
111 Packing element or seal
112, 112' tubing, casing
113 clearance
114, ', " three conductor wire, control line
115, ' first, second upper hinged access panels
116, ' first, second lower hinged access panels
117 packer body
118, 118' upper lower sections
119, 119' inserts mounted to inner wall of access panel, door or plate
120, 120' inserted mounted to body of unit
121, 121' insert receiver slot
122 gripping configuration
123, ' threaded fasteners
124, 124' inner wall of access panel
125 closed
126, 126' fasteners
127, 127 opposing sides
128, 128', 128", component seal passages
129 seal slit
130 plug
131 alternative embodiment bowl cap
132, ' pass-through adapter, three conduit ESP embodiment
133, ' threaded opening, passage
134, ' compression fitting
135, ', " adapter body, first, second sides (i.e, top, bottom)
136, ', " fastener passages aligned with threaded passages on bowl cap
137, ' socket formed in bowl cap, ID
138, ', " tapered from wide to narrow ID, depth
139, ' compression receiver forming passage through bowl cap, ID
140, ' sleeve emanating from second side, OD,
141, ' end of sleeve, O-ring support or groove
142 O-ring
143, ', threaded fasteners
144 clearance
145, ' wide to narrow ID
146, ', " central threaded opening 1.5", passage to bowl cap, ID
147 conduit connector 1.5"
148 upper split compression flange
149 seal element
150 compression limiters
151 lower split backup plate
152, ' split wedge, OD
153, ' wide to narrow
154 through
155 passage
156, ' side port, plug
157 force
158, ' fasteners
159 tightening
160 sleeve
161 mounted
162 tubing head adapter
163, ' swivel flange
164, ', " mounting area, centralized port, passage
165, ' threaded apertures
166 threaded port for compression fitting, passage
167, ' socket formed in tubing head adapter, ID
168, ', " tapered from wide to narrow ID, depth
169, ' compression receiver forming passage through tubing head adapter, ID The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. A tubing hanger for sealing a wellhead, comprising:
a slot formed to receive a component,
a gripper to grip said component in said slot,
a main seal having a component passage formed therethrough in alignment with said slot,
whereby, upon mounting said hanger to a tubing associated with said wellhead and threading said component through said component passage and said slot, engaging said gripper to engage said component, and positioning said hanger into a bowl, force applied to said hanger causes said main seal to swell, sealing said wellhead while providing sealed passage of said component therethrough.

2. The apparatus of claim 1, wherein said gripper comprises a side door having a raised area positioned to grip said component upon closing said side door over said slot.

3. The apparatus of claim 2, wherein said raised area of said side door has a profile shaped to engage said component.

4. The apparatus of claim 3, wherein said raised area of said side door is situated to face said first slot.

5. The apparatus of claim 1, wherein said gripper further comprises a first insert situated in said slot.

6. The apparatus of claim 5, wherein there is further provided a second insert engaged to a side door pivotally engaging said hanger so that said second insert faces said slot.

7. The apparatus of claim 6, wherein said second insert comprises a raised area positioned to grip said component upon closing said side door over said slot.

8. The apparatus of claim 7, wherein said second insert has a profile shaped to engage said component.

9. The apparatus of claim 8, wherein said first and second inserts are selected from a group of inserts having different profiles formed to engage different components.

10. The apparatus of claim 9, wherein said component comprises an electric submersible pump power line.

11. The apparatus of claim 9, wherein said component passage of said main seal has a profile formed to slidingly receive said component, and said main seal is selected from a group of seals having different component passage profiles formed to engage various components.

12. The apparatus of claim 11, wherein said component comprises a first component, said component passage comprises a first component passage for receiving said first component, and said main seal has formed therein a second component passage formed for the passage of a second component therethrough.

13. The apparatus of claim 12, wherein said gripper comprises a first gripper, and wherein there is provided a second gripper associated with said hanger to engage said second component via a second slot.

14. The apparatus of claim 13, wherein said second component comprises a control line.

15. The apparatus of claim 14, wherein said hanger is formed to engage said tubing.

16. The apparatus of claim 11, wherein said wellhead comprises a tubing head.

17. The apparatus of claim 16, wherein there is further provided a bowl cap formed to engage said tubing head, said bowl cap having a compression seal associated therewith formed to receive said component therethrough.

18. The apparatus of claim 17, wherein said compression seal comprises a split insert formed to compress around and seal about said component.

19. The apparatus of claim 18, wherein said bowl cap has mounted thereto a pass through adapter having a passage formed to receive said component and engage said compression seal to seal about said component.

20. The apparatus of claim 19, wherein said bowl cap is formed to have mounted thereto a second compression seal for a second component.

21. The apparatus of claim 20, wherein said component comprises an electrical line, fluid conduit, rod or support cable.

22. The apparatus of claim 20, wherein said component comprises a length of flexible material emanating from outside said wellhead.

23. The apparatus of claim 6, wherein said hanger is formed to engage a coupling affixed to said tubing.

24. A hanger for sealing a wellhead having tubing and a component emanating therefrom, comprising:

a main seal formed to allow the passage of said component therethrough;

a gripper formed to engage and grip said component;

whereby, upon passing said component through said main seal, engaging said gripper to retain said component, engaging said hanger to said tubing, positioning said hanger to engage a bowl, and applying pressure to said hanger, said main seal is repositioned to seal said component, tubing, and bowl, so as to seal said wellhead.

25. The apparatus of claim 24, wherein said apparatus further comprises a slot formed to receive said component, and said gripper comprises a side door panel having a gripping area positioned to grip said component upon-closing said side door over said slot.

26. The apparatus of claim 25, wherein said gripping area of said side door comprises a profile shaped to engage said component.

27. The apparatus of claim 26, wherein said gripping area comprises a first insert mounted to said side door so as to face said slot.

28. The apparatus of claim 27, wherein said gripper further comprises a second insert situated in said slot, and wherein said side door is formed to be secured over said slot so as to urge said component against said second insert.

29. The apparatus of claim 28, wherein the component comprises an electric submersible pump power line.

30. The apparatus of claim 28, wherein said component passage of said main seal comprises a first component passage, and said component comprises a first component, and wherein said main seal has formed therein a second component passage for facilitating the passage of a second component therethrough.

31. The apparatus of claim 30, wherein said gripper comprises a first gripper, and wherein there is further provided a second gripper to engage said second component.

32. The apparatus of claim 31, wherein said second component comprises a capillary line.

* * * * *